US008305415B2

(12) United States Patent
Ohno

(10) Patent No.: US 8,305,415 B2
(45) Date of Patent: Nov. 6, 2012

(54) LIGHT-EMITTING DEVICE INCLUDING A LIGHT-UP CONTROLLER, DRIVING METHOD OF SELF-SCANNING LIGHT-EMITTING ELEMENT ARRAY AND PRINT HEAD INCLUDING THE SAME

(75) Inventor: Seiji Ohno, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 350 days.

(21) Appl. No.: 12/693,507

(22) Filed: Jan. 26, 2010

(65) Prior Publication Data

US 2011/0058009 A1 Mar. 10, 2011

(30) Foreign Application Priority Data

Sep. 4, 2009 (JP) ..... 2009-204982

(51) Int. Cl.
*B41J 2/47* (2006.01)
*B41J 2/435* (2006.01)

(52) U.S. Cl. ..... 347/237; 347/224

(58) Field of Classification Search ..... 347/237, 347/224; 315/320; 257/79
See application file for complete search history.

(56) References Cited

U.S. PATENT DOCUMENTS

2005/0224810 A1* 10/2005 Ohno ..... 257/79

FOREIGN PATENT DOCUMENTS

JP 2001219596 * 8/2001
JP 2004-181741 7/2004
JP 2007160930 * 6/2007

* cited by examiner

*Primary Examiner* — Stephen Meier
*Assistant Examiner* — Carlos A Martinez
(74) *Attorney, Agent, or Firm* — Fildes & Outland, P.C.

(57) ABSTRACT

The light-emitting device includes: a self-scanning light-emitting element array including: light-emitting elements; memory elements; and switch elements; and a light-up controller supplying a transfer signal setting ON of the switch elements, a memory signal causing, in a case where a switch element corresponding to a light-emitting element forming a group is set at the ON state, a corresponding memory element to be temporarily changed from OFF to ON if the light-emitting element is to light up, and the corresponding memory element to be kept in OFF if the light-emitting element is not to light up, and then causing the memory element having been temporarily changed to the ON state to be temporarily set at ON again, and a light-up signal for each group, the light-up signal causing a light-emitting element to be set at ON after causing a memory element to be set at ON.

8 Claims, 19 Drawing Sheets

LIGHT-EMITTING DEVICE INCLUDING A LIGHT-UP CONTROLLER, DRIVING METHOD OF SELF-SCANNING LIGHT-EMITTING ELEMENT ARRAY AND PRINT HEAD INCLUDING THE SAME

CROSS REFERENCE TO RELATED APPLICATIONS

This application is based on and claims priority under 35 USC §119 from Japanese Patent Application No. 2009-204982 filed Sep. 4, 2009.

BACKGROUND

1. Technical Field

The present invention relates to a light-emitting device, a driving method of a self-scanning light-emitting element array and a print head.

2. Related Art

In an electrophotographic image forming apparatus such as a printer, a copy machine or a facsimile machine, an image is formed on a recording sheet as follows. Firstly, an electrostatic latent image is formed on a uniformly charged photoconductor by causing an optical recording unit to emit light so as to transfer image information onto the photoconductor. Then, the electrostatic latent image is made visible by being developed with toner. Lastly, the toner image is transferred on and fixed to the recording sheet. In addition to an optical-scanning recording unit that performs exposure by laser scanning in the first scanning direction using a laser beam, a recording device using the following LED print head (LPH) has been employed as such an optical recording unit in recent years in response to demand for downsizing the apparatus. This LPH includes a large number of light-emitting diodes (LEDs), serving as light-emitting elements, arrayed in the first scanning direction.

SUMMARY

According to an aspect of the present invention, there is provided a light-emitting device including: a self-scanning light-emitting element array including: plural light-emitting elements that are arrayed in line; plural memory elements that are provided so as to correspond to the respective light-emitting elements, that are electrically connected to the respective light-emitting elements, that are each set at any one of an ON state and an OFF state, and that cause the respective light-emitting elements to be likely to be set at an ON state in a case of being set at the ON state in comparison with a case of being set at the OFF state; and plural switch elements that are provided so as to correspond to the respective memory elements, that are electrically connected to the respective memory elements, that are each set at any one of an ON state and an OFF state, that are set so as to allow a sequential shift of the ON state from one end side to the other end side, and that causes the respective memory elements to be likely to be set at the ON state in a case of being set at the ON state in comparison with a case of the OFF state; and a light-up controller including: a transfer signal generating unit that supplies, to the plurality of switch elements, a transfer signal that sets the plural switch elements so as to allow the sequential shift of the ON state from the one end side to the other end side; a memory signal generating unit that supplies a memory signal to a plurality of the memory elements corresponding to a plurality of the light-emitting elements of a group among plural groups into which the plural light-emitting elements are divided, the memory signal causing, in a case where a switch element corresponding to a light-emitting element forming the group is set at the ON state, a memory element corresponding to the switch element set at the ON state to be temporarily changed from the OFF state to the ON state if the light-emitting element corresponding to the switch element is intended to light up, and the memory element corresponding to the switch element set at the ON state to be kept in the OFF state if the light-emitting element corresponding to the switch element is not intended to light up, and then causing the memory element having been temporarily changed to the ON state to be temporarily set at the ON state again; and a light-up signal generating unit that supplies, to the plural light-emitting elements, for each group, a light-up signal that causes a light-emitting element intended to light up to be set at the ON state after causing a memory element corresponding to the light-emitting element intended to light up to be set at the ON state.

BRIEF DESCRIPTION OF THE DRAWINGS

Exemplary embodiment(s) of the present invention will be described in detail based on the following figures, wherein.

DETAILED DESCRIPTION

Image Forming Apparatus

Hereinafter, a description will be given of exemplary embodiments of the present invention in detail with reference to the accompanying drawings.

First Exemplary Embodiment

Figure 1:
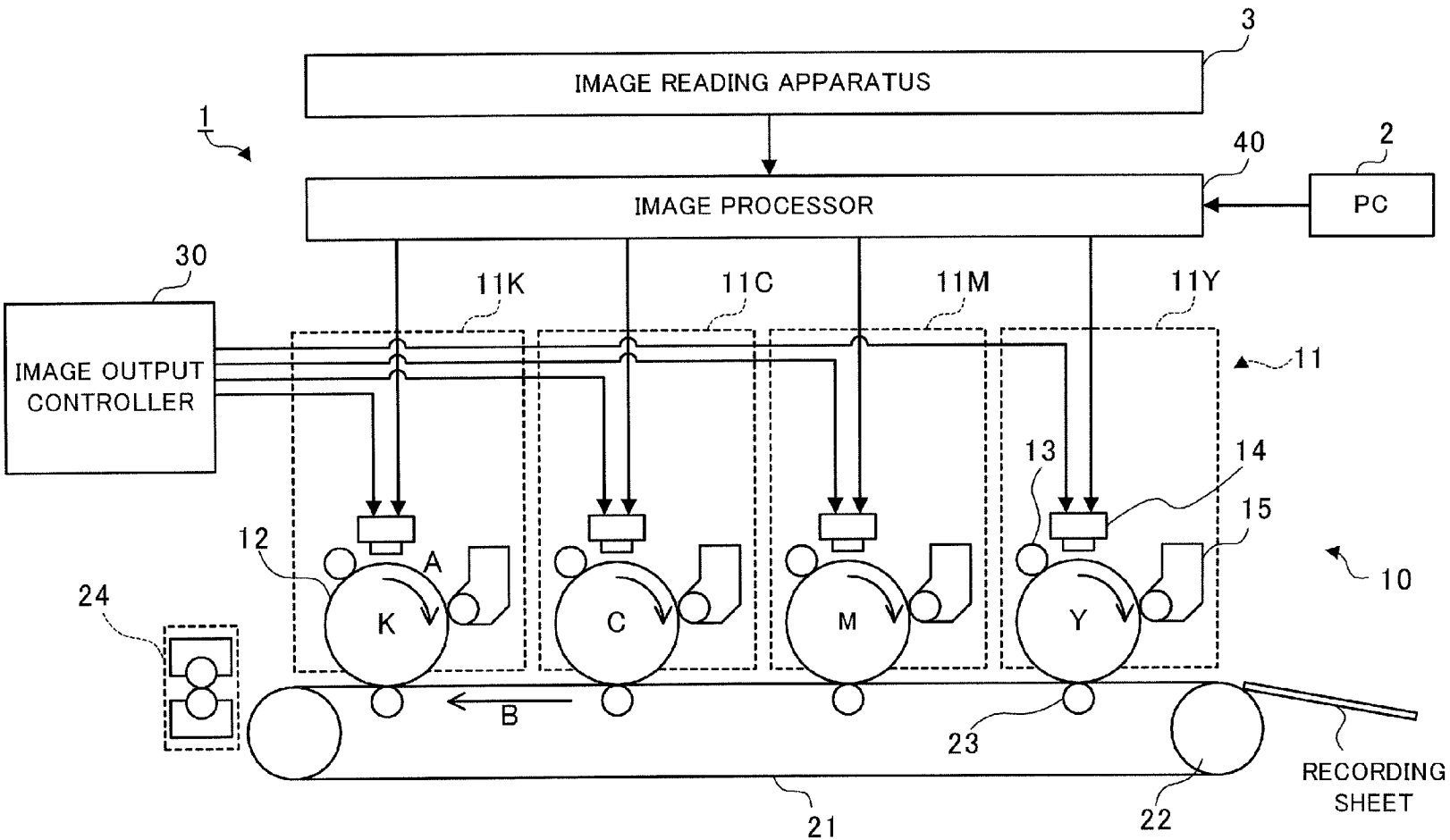
FIG. 1 shows an example of an overall configuration of an image forming apparatus to which the first exemplary embodiment is applied.

FIG. 1 shows an example of an overall configuration of an image forming apparatus 1 to which the first exemplary embodiment is applied. The image forming apparatus 1 shown in FIG. 1 is what is generally termed as a tandem image forming apparatus. The image forming apparatus 1 includes an image forming process unit 10, an image output controller 30 and an image processor 40. The image forming process unit 10 forms an image in accordance with different color image datasets. The image output controller 30 controls the image forming process unit 10. The image processor 40, which is connected to devices such as a personal computer (PC) 2 and an image reading apparatus 3, performs predefined image processing on image data received from the above devices.

The image forming process unit 10 includes image forming units 11. The image forming units 11 are formed of multiple engines arranged in parallel at regular intervals. Specifically, the image forming units 11 are formed of four image forming units 11Y, 11M, 11C and 11K. Each of the image forming units 11Y, 11M, 11C and 11K includes a photoconductive drum 12, a charging device 13, a print head 14 and a developing device 15. On the photoconductive drum 12, which is an example of an image carrier, an electrostatic latent image is formed, and the photoconductive drum 12 retains a toner image. The charging device 13, as an example of a charging unit, uniformly charges the surface of the photoconductive drum 12 at a predetermined potential. The print head 14 exposes the photoconductive drum 12 charged by the charging device 13. The developing device 15, as an example of a developing unit, develops an electrostatic latent image formed by the print head 14. Here, the image forming units 11Y, 11M, 11C and 11K have approximately the same configuration excluding color of toner put in the developing device 15. The image forming units 11Y, 11M, 11C and 11K form yellow (Y), magenta (M), cyan (C) and black (K) toner images, respectively.

In addition, the image forming process unit 10 further includes a sheet transport belt 21, a drive roll 22, transfer rolls 23 and a fixing device 24. The sheet transport belt 21 transports a recording sheet as a transferred body so that different color toner images respectively formed on the photoconductive drums 12 of the image forming units 11Y, 11M, 11C and 11K are transferred on the recording sheet by multilayer transfer. The drive roll 22 is a roll that drives the sheet transport belt 21. Each transfer roll 23, as an example of a transfer unit, transfers a toner image formed on the corresponding photoconductive drum 12 onto the recording sheet. The fixing device 24 fixes the toner images on the recording sheet.

In this image forming apparatus 1, the image forming process unit 10 performs an image forming operation on the basis of a various kinds of control signals supplied from the image output controller 30. Under the control by the image output controller 30, the image data received from the personal computer (PC) 2 or the image reading apparatus 3 is subjected to image processing by the image processor 40, and then the resultant dataset is supplied to the corresponding image forming unit 11. Then, for example in the black (K) color image forming unit 11K, the photoconductive drum 12 is charged at a predetermined potential by the charging device 13 while rotating in an arrow A direction, and then is exposed by the print head 14 emitting light on the basis of the image dataset supplied from the image processor 40. By this operation, the electrostatic latent image for the black (K) color image is formed on the photoconductive drum 12. Thereafter, the electrostatic latent image formed on the photoconductive drum 12 is developed by the developing device 15, and accordingly the black (K) color toner image is formed on the photoconductive drum 12. Similarly, yellow (Y), magenta (M) and cyan (C) color toner images are formed in the image forming units 11Y, 11M and 11C, respectively.

The respective color toner images on the photoconductive drums 12, which are formed in the respective image forming units 11, are electrostatically transferred to the recording sheet supplied with the movement of the sheet transport belt 21 by a transfer electric field applied to the transfer rolls 23, in sequence. Here, the sheet transport belt 21 moves in an arrow B direction. By this operation, a synthetic toner image, which is superimposed color-toner images, is formed on the recording paper.

Thereafter, the recording sheet on which the synthetic toner image is electrostatically transferred is transported to the fixing device 24. The synthetic toner image on the recording sheet transported to the fixing device 24 is fixed on the recording sheet through fixing processing using heat and pressure by the fixing device 24, and then is outputted from the image forming apparatus 1.

(Print Head)

Figure 2:
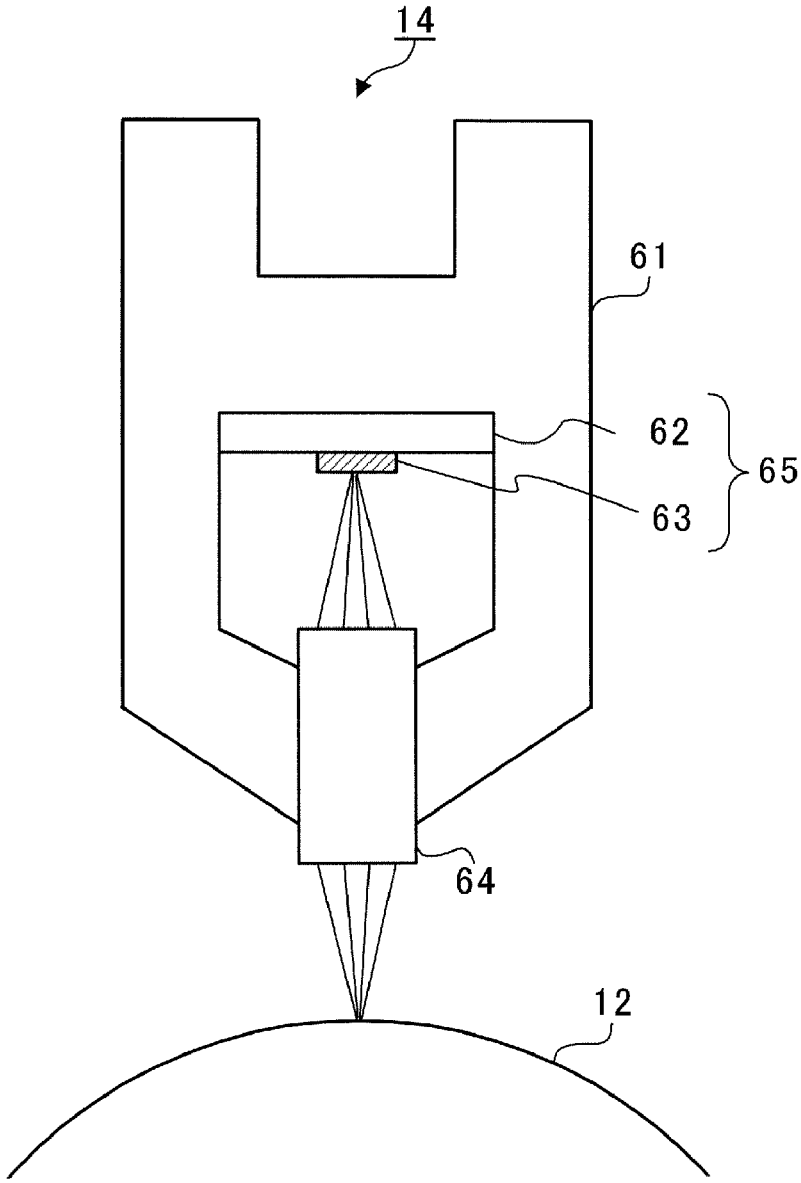
FIG. 2 is a view showing a structure of the print head to which the first exemplary embodiment is applied.

FIG. 2 is a view showing a structure of the print head 14 to which the first exemplary embodiment is applied. The print head 14 includes a housing 61, a light-emitting portion 63, a circuit board 62 and a rod lens array 64. The light-emitting portion 63 has multiple LEDs (which are light-emitting thyristors in the first exemplary embodiment). On the circuit board 62, the light-emitting portion 63, a signal generating circuit 100 (see FIG. 3 to be described later) as an example of a light-up controller that drives the light-emitting portion 63, and the like are mounted. The rod lens array 64, as an example of an optical unit, focuses light emitted by the light-emitting portion 63 onto the surface of the photoconductive drum 12. Here, the light-emitting portion 63, the signal generating circuit 100 and the circuit board 62 on which these components are mounted will be called a light-emitting device 65 as an example of an exposure unit.

The housing 61 is made of metal, for example, and supports the circuit board 62 and the rod lens array 64. The housing 61 is set so that the light-emitting point of the light-emitting portion 63 is located on the focal plane of the rod lens array 64. In addition, the rod lens array 64 is arranged along an axial direction of the photoconductive drum 12 (the first scanning direction).

(Light-Emitting Device)

Figure 3:
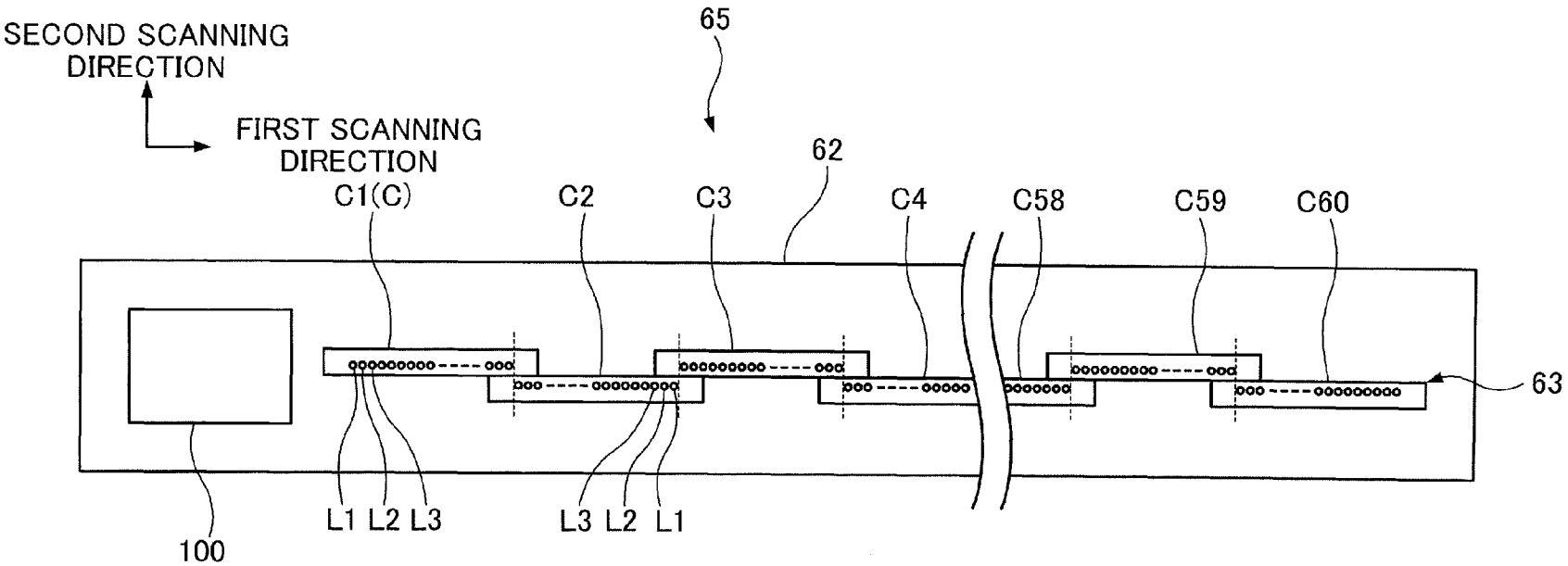
FIG. 3 is a top view of the light-emitting device.

FIG. 3 is a top view of the light-emitting device 65.

As shown in FIG. 3, the light-emitting portion 63 of the light-emitting device 65 is formed of 60 light-emitting chips C1 to C60 arranged in two lines in the first scanning direction on the circuit board 62. Here, the 60 light-emitting chips C1 to C60 are arrayed in a zigzag pattern in which each adjacent two of the light-emitting element chips C1 to C60 face each other. Note that, if the light-emitting chips C1 to C60 are not distinguished, they are described as light-emitting chips C (C1 to C60) or light-emitting chips C. The same is true for the other terms.

All of the light-emitting chips C (C1 to C60) have the same configuration. Each of the light-emitting chips C (C1 to C60) has a light-emitting thyristor array (light-emitting element array) formed of light-emitting thyristors L1, L2, L3 . . . which are an example of light-emitting elements, as described later. The light-emitting thyristor array is arranged along long sides of the rectangular of the light emitting chip C. The light-emitting thyristor array is arranged so as to come close to one of the long sides and to have the light-emitting thyristors L1, L2, L3 . . . at regular intervals. Here, odd-numbered light-emitting chips C1, C3, C5 . . . and even-numbered light-emitting chips C2, C4, C6 . . . are arranged so as to face each other. In addition, the light-emitting chips C1 to C60 are arranged so that the light-emitting thyristors are arranged at regular intervals in the first scanning direction also in connecting portions of the light-emitting chips C that are shown as dashed lines.

Further, the light-emitting device 65 includes the signal generating circuit 100 that drives the light-emitting portion 63, as described above.

Note that, if the light-emitting thyristors L1, L2, L3 . . . are not distinguished, they are called light-emitting thyristors L.

Figure 4:
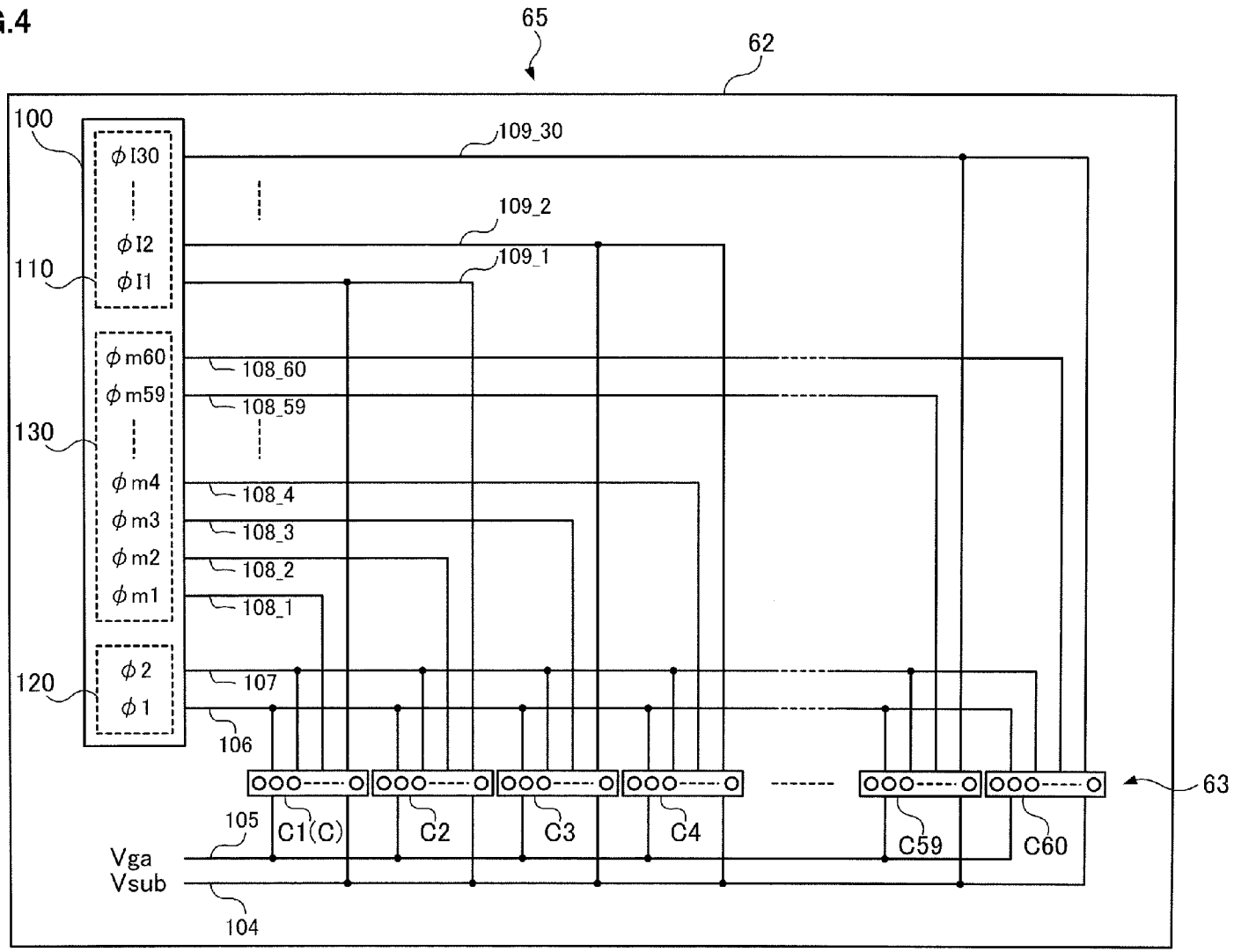
FIG. 4 is a diagram showing a configuration of the signal generating circuit and a wiring configuration of the signal generating circuit and the light-emitting chips in the light-emitting device in the first exemplary embodiment.

FIG. 4 is a diagram showing a configuration of the signal generating circuit 100 and a wiring configuration of the signal generating circuit 100 and the light-emitting chips C (C1 to C60) in the light-emitting device 65. Note that, in FIG. 4, since a description is given of the wiring configuration, the light-emitting chips C1 to C60 are not illustrated in the zigzag pattern.

To the signal generating circuit 100, image dataset subjected to the image processing and various kinds of control signals are inputted from the image output controller 30 and the image processor 40 (see FIG. 1), although the illustration thereof is omitted. Then, the signal generating circuit 100 performs rearrangement of image datasets, correction of intensity of the light emission and the like on the basis of the image dataset and the various kinds of control signals.

The signal generating circuit 100 includes a light-up signal generating unit 110 that transmits, to the light-emitting chips C (C1 to C60), light-up signals ϕI (ϕI1 to ϕI30) for supplying electric power for light emission to the light-emitting thyristors L.

The signal generating circuit 100 includes a transfer signal generating unit 120 that transmits, to the light-emitting chips C1 to C60, a first transfer signal ϕ1 and a second transfer signal ϕ2 on the basis of the various kinds of control signals. Further, the signal generating circuit 100 includes a memory signal generating unit 130 that transmits memory signals ϕm (ϕm1 to ϕm60) that designate the light-emitting thyristor L to be caused to light up, on the basis of the image dataset.

A power supply line 104 is provided to the circuit board 62 of the light-emitting device 65. The power supply line 104 is connected to Vsub terminals (see FIG. 5 to be described later) of the light-emitting chips C (C1 to C60), and supplies reference potential Vsub (for example, 0 V). In addition, another power supply line 105 is provided thereto. The power supply line 105 is connected to Vga terminals (see FIG. 5 to be described later) of the light-emitting chips (C1 to C60), and supplies power supply potential Vga for power supply (for example, −3.3 V).

Moreover, a first transfer signal line 106 and a second transfer signal line 107 are provided to the circuit board 62. The first transfer signal line 106 and the second transfer signal line 107 respectively transmit the first transfer signal ϕ1 and the second transfer signal ϕ2 from the transfer signal generating unit 120 of the signal generating circuit 100 to the light-emitting portion 63. The first transfer signal line 106 and the second transfer signal line 107 are parallely connected to ϕ1 terminals and ϕ2 terminals of the light-emitting chips C (C1 to C60), respectively (see FIG. 5 to be described later).

Further, 60 memory signal lines 108 (108_1 to 108_60) are provided to the circuit board 62. The memory signal lines 108 transmit the respective memory signals ϕm (ϕm1 to ϕm60) from the memory signal generating unit 130 of the signal generating circuit 100 to the corresponding light-emitting chips C (C1 to C60). The memory signal lines 108_1 to 108_60 are respectively connected to ϕm terminals (see FIG. 5 to be described later) of the light-emitting chips C1 to C60. That is, the memory signals ϕm (ϕm1 to ϕm60) are individually transmitted to the light-emitting chips C (C1 to C60).

Furthermore, 30 light-up signal lines 109 (109_1 to 109_30) are also provided to the circuit board 62. The light-up signal lines 109 transmit the respective light-up signals ϕI (ϕI1 to ϕI30) from the light-up signal generating unit 110 of the signal generating circuit 100 to the corresponding light-emitting chips C (C1 to C60). Each of the light-up signal lines 109 (109_1 to 109_30) is connected to two of ϕI terminals (see FIG. 5 to be described later) of the two light-emitting chips C as a pair. For example, the light-up signal line 109_1 is parallely connected to the ϕI terminals of the light-emitting chips C1 and C2, and the light-up signal ϕI1 is sharably supplied thereto. Similarly, the light-up signal line 109_2 is parallely connected to the ϕI terminals of the light-emitting chips C3 and C4, and the light-up signal ϕI2 is sharably supplied thereto. The others have the similar configuration. Thus, the number of the light-up signals ϕI (30) is a half of the number of the light-emitting chips C (60).

As described above, in the first exemplary embodiment, the reference potential Vsub, the power supply potential Vga, the first transfer signal ϕ1 and the second transfer signal ϕ2 are sharably transmitted to all of the light-emitting chips C (C1 to C60). The memory signals ϕm (ϕm1 to ϕm60) are individually transmitted to the light-emitting chips C (C1 to C60). Each of the light-up signals ϕI (ϕI1 to ϕI30) is transmitted to the corresponding two of the light emitting chips C (C1 to C60).

By this configuration, the number of the light-up signal lines 109 (109_1 to 109_30) is set smaller than the number of the light-emitting chips C (C1 to C60).

The light-up signal lines 109 are required to have a low resistance in order to supply a current for lighting-up (light emission) to the light-emitting thyristors L. For this reason, if the light-up signal lines 109 are configured of wide wirings, the width of the circuit board 62 becomes larger, which prevents downsizing of the print head 14. On the other hand, in order to make the width of the circuit board 62 narrower, if the signal lines are configured to have multiple layers, this configuration prevents cost reduction of the print head 14.

In the first exemplary embodiment, the number of the light-up signal lines 109 is reduced in comparison with a case where the light-up signal lines 109 are respectively provided for the light-emitting chips C, and thus the print head 14 may be downsized and produced at low cost.

On the other hand, in the first exemplary embodiment, the memory signal lines 108 are provided so that the number of the memory signal lines 108 is the same as the number of the light-emitting chips C. As described later, it is only necessary that the memory signal lines 108 supply the current that keeps the ON state of the memory thyristors M (see FIG. 5 to be described later). The current that keeps the ON state of the memory thyristors M is smaller than the current for the lighting-up (light emission) of the light-emitting thyristors L, and thus it is acceptable that the width of the memory signal lines 108 is set so as not to have a low resistance unlike the light-up signal lines 109.

In other words, reduction of the number of the light-up signal lines 109 may achieve the downsizing of the print head 14 and the production at low cost.

(Light-Emitting Chips)

Figure 5:
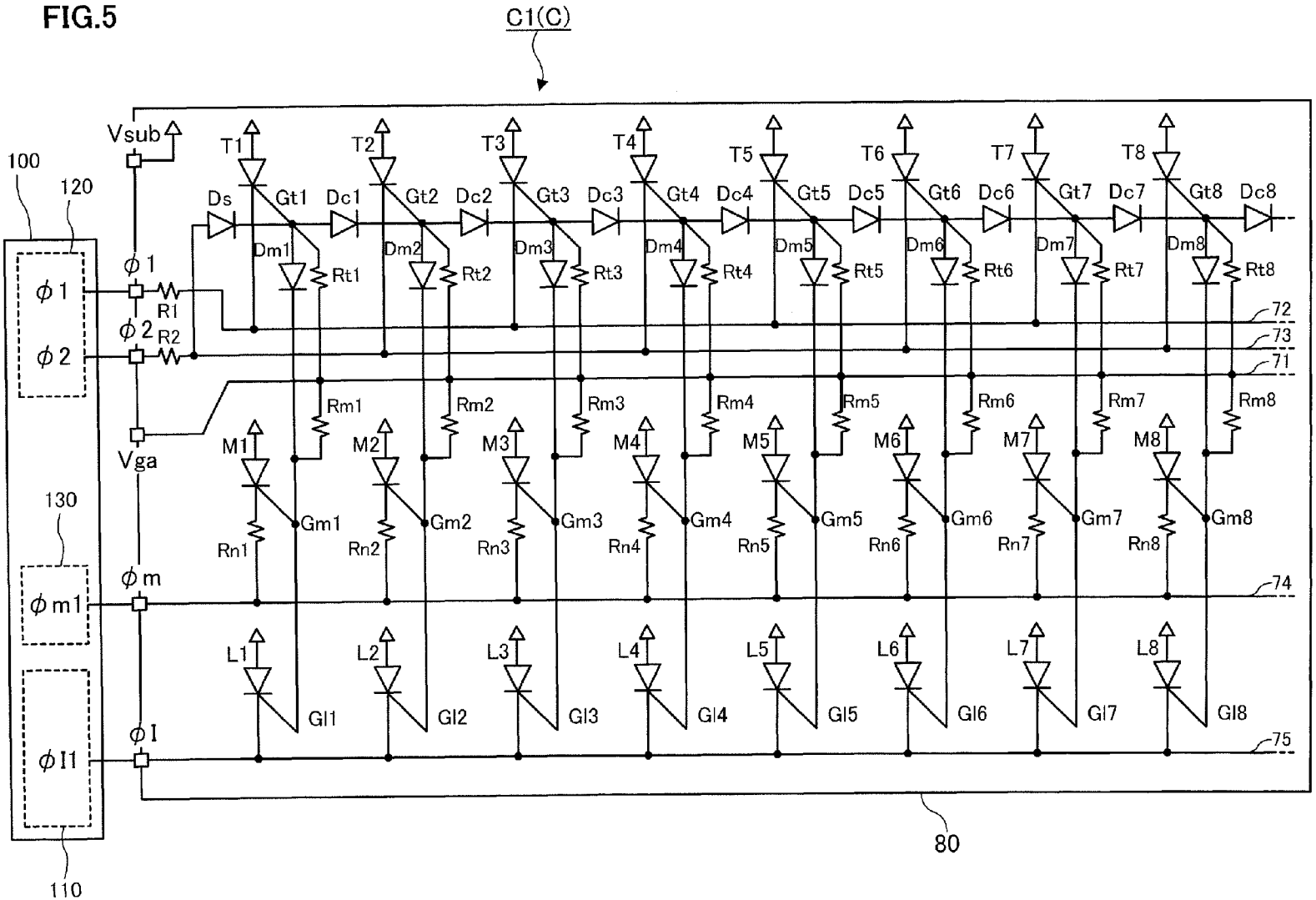
FIG. 5 is a diagram for explaining a wiring configuration of the light-emitting chips in the first exemplary embodiment.

FIG. 5 is a diagram for explaining a wiring configuration of the light-emitting chips C (C1 to C60) as self-scanning light-emitting element array (SLED) chips. Here, the light-emitting chip C1 is described as one example. However, the other light-emitting chips C2 to C60 have the same configuration as the light-emitting chip C1.

The light-emitting chip C1 (C) includes a transfer thyristor array (a switch element array) formed of the transfer thyristors T1, T2, T3 . . . as an example of switch elements arrayed in line, a memory thyristor array (memory element array) formed of the memory thyristors M1, M2, M3 . . . as an example of memory elements similarly arrayed in line, and a light-emitting thyristor array (light-emitting element array) formed of the light-emitting thyristors L1, L2, L3 . . . similarly arrayed in line, which are placed on a substrate 80.

Here, similarly to the light-emitting thyristors L, if the transfer thyristors T1, T2, T3 . . . are not distinguished, they are called transfer thyristors T. Similarly, if the memory thyristors M1, M2, M3 . . . are not distinguished, they are called memory thyristors M.

The light-emitting chip C1 (C) includes coupling diodes Dc1, Dc2, Dc3 . . . connecting respective pairs that are each two of the transfer thyristors T1, T2, T3 . . . and that are formed in numerical order. Moreover, the light-emitting chip C1 (C) includes connecting diodes Dm1, Dm2, Dm3 . . . .

In addition, the light-emitting chip C1 (C) includes power supply line resistances Rt1, Rt2, Rt3 . . . , power supply line resistances Rm1, Rm2, Rm3 . . . , and resistances Rn1, Rn2, Rn3 . . . .

Here, similarly to the light-emitting thyristors L and the like, if the coupling diodes Dc1, Dc2, Dc3 . . . , the connecting diodes Dm1, Dm2, Dm3 . . . , the power supply line resistances Rt1, Rt2, Rt3 . . . , the power supply line resistance Rm1, Rm2, Rm3 . . . , and the resistances Rn1, Rn2, Rn3 are not respectively distinguished, they are called coupling diodes Dc, connecting diodes Dm, power supply line resistances Rt, power supply line resistances Rm and resistances Rn, respectively.

In the first exemplary embodiment, if the number of the light-emitting thyristors L in the light-emitting thyristor array is set to be 128, the number of the transfer thyristors T and the number of the memory thyristors M are also set to be 128. Similarly, the number of the connecting diodes Dm, the number of each of the power supply line resistances Rt and Rm, the number of the resistances Rn are also 128. Meanwhile, the number of the coupling diodes Dc is 127, which is less by 1 than the number of the transfer thyristors T.

Note that, in FIG. 5, only a part mainly including the transfer thyristors T1 to T8, the memory thyristors M1 to M8, and the light-emitting thyristors L1 to L8 is shown. In the other part, the same pattern as this part is repeated.

The number of the transfer thyristors T is not necessarily the same as the number of the light-emitting thyristors L, and it may be larger than the number of the light-emitting thyristors L.

Further, the light-emitting chip C1 (C) includes one start diode Ds. In order to prevent an excessive current from flowing into a first transfer signal line 72 and a second transfer signal line 73, the light-emitting chip C1 (C) includes current-limiting resistances R1 and R2.

Note that, the transfer thyristors T1, T2, T3 . . . are arrayed in numerical order in FIG. 5. Here, the transfer thyristors T1, T2, T3 . . . are arrayed from the left side of FIG. 5, such as T1, T2, T3 . . . . Similarly, the memory thyristors M1, M2, M3 . . . and the light-emitting thyristors L1, L2, L3 . . . are also arrayed in numerical order from the left side of FIG. 5. Further, the coupling diodes Dc1, Dc2, Dc3 . . . , the connecting diodes Dm1, Dm2, Dm3 . . . , the power supply line resistances Rt1, Rt2, Rt3 . . . , the power supply line resistances Rm1, Rm2, Rm3 . . . , and the resistances Rn1, Rn2, Rn3 . . . are also arrayed in numerical order from the left side of FIG. 5.

Next, a description will be given of electric connections between elements in the light-emitting chip C1 (C).

Anode terminals of the transfer thyristors T1, T2, T3 . . . , anode terminals of the memory thyristors M1, M2, M3 . . . , and anode terminals of the light-emitting thyristors L1, L2, L3 . . . are connected to the substrate 80 of the light-emitting chip C1 (C) (anode common). These anode terminals are connected to the power supply line 104 (see FIG. 4) through the Vsub terminal provided to the substrate 80. To this power supply line 104, the reference potential Vsub is supplied.

Gate terminals Gt1, Gt2, Gt3 . . . of the transfer thyristors T1, T2, T3 . . . are connected to a power supply line 71 through the respective power supply line resistances Rt1, Rt2, Rt3 . . . which are provided so as to correspond to the respective transfer thyristors T1, T2, T3 . . . . The power supply line 71 is connected to the Vga terminal. The Vga terminal is connected to the power supply line 105 (see FIG. 4), and the power supply potential Vga is supplied thereto.

Cathode terminals of the odd-numbered transfer thyristors T1, T3, T5 . . . are connected to the first transfer signal line 72 in accordance with the array of the transfer thyristors T. The first transfer signal line 72 is connected to a $\phi$1 terminal that is an input terminal of the first transfer signal $\phi$1, through the current-limiting resistance R1. To this $\phi$1 terminal, the first transfer signal line 106 (see FIG. 4) is connected, and the first transfer signal $\phi$1 is supplied thereto.

Meanwhile, cathode terminals of the even-numbered transfer thyristors T2, T4, T6 . . . are connected to the second transfer signal line 73 in accordance with the array of the transfer thyristors T. The second transfer signal line 73 is connected to a $\phi$2 terminal that is an input terminal of the second transfer signal $\phi$2, through the current-limiting resistance R2. To this $\phi$2 terminal, the second transfer signal line 107 (see FIG. 4) is connected, and the second transfer signal $\phi$2 is supplied thereto.

Cathode terminals of the memory thyristors M1, M2, M3 . . . are connected to a memory signal line 74 through the corresponding resistances Rn1, Rn2, Rn3 . . . . The memory signal line 74 is connected to the $\phi$m terminal that is an input terminal of the memory signal $\phi$m ($\phi$m1 in the case of the light-emitting chip C1). To the $\phi$m terminal, the memory signal line 108 (see FIG. 4: the memory signal line 108_1 in the case of the light-emitting chip C1) is connected, and the memory signal ϕm (see FIG. 4: the memory signal ϕm1 in the case of the light-emitting chip C1) is supplied thereto.

Each of the gate terminals Gt1, Gt2, Gt3 . . . of the transfer thyristors T1, T2, T3 . . . is connected to one of gate terminals Gm1, Gm2, Gm3 of the memory thyristors M1, M2, M3 . . . , which has the same number as the gate terminal Gt to be connected thereto, through each of the connecting diodes Dm1, Dm2, Dm3 . . . , with a one-to-one relationship. In other words, the anode terminals of the connecting diodes Dm1, Dm2, Dm3 . . . are respectively connected to the gate terminals Gt1, Gt2, Gt3 . . . of the transfer thyristors T1, T2, T3 . . . , and the cathode terminals of the connecting diodes Dm1, Dm2, Dm3 . . . are respectively connected to the gate terminals Gm1, Gm2, Gm3 . . . of the memory thyristors M1, M2, M3 . . . .

Here, if the gate terminals Gt1, Gt2, Gt3 . . . and the gate terminals Gm1, Gm2, Gm3 . . . are not distinguished, they are called gate terminals Gt and gate terminals Gm, respectively.

Each of the gate terminals Gm1, Gm2, Gm3 . . . of the memory thyristors M1, M2, M3 . . . is connected to the power supply line 71 through each of the power supply line resistances Rm1, Rm2, Rm3 . . . , which is provided so as to correspond to each of the memory thyristors M1, M2, M3 . . . . The power supply line 71 is connected to the Vga terminal. The Vga terminal is connected to the power supply line 105 (see FIG. 4), and the power supply potential Vga is supplied thereto.

Further, each of the gate terminals Gm1, Gm2, Gm3 . . . of the memory thyristors M1, M2, M3 . . . is connected to corresponding one of gate terminals Gl1, Gl2, Gl3 . . . of the light-emitting thyristors L1, L2, L3 . . . , which has the same number as the gate terminal Gm to be connected thereto, with a one-to-one relationship.

Each of the coupling diodes Dc1, Dc2, Dc3 . . . is connected between each pair of the gate terminals Gt, which is two gate terminals Gt among the gate terminals Gt1, Gt2, Gt3 . . . of the light-emitting thyristors L1, L2, L3 . . . and is formed in numerical order. In other words, each of the coupling diodes Dc1, Dc2, Dc3 . . . is serially connected to the corresponding two of the gate terminals Gt1, Gt2, Gt3 . . . . The coupling diode Dc1 is connected thereto so that a direction thereof is a direction of the current flowing from the gate terminal Gt1 to the gate terminal Gt2. To the other coupling diodes Dc2, Dc3, Dc4 . . . , the same configuration is applied.

Cathode terminals of the light-emitting thyristors L1, L2, L3 . . . are connected to a light-up signal line 75, and the light-up signal line 75 is connected to a ϕI terminal that is an input terminal of the light-up signal ϕI (the light-up signal ϕI1 in the case of the light-emitting chip C1). To the ϕI terminal, the light-up signal line 109 (see FIG. 4: the light-up signal line 109_1 in the case of the light-emitting chip C1) is connected, and the light-up signal ϕI (see FIG. 4: the light-up signal ϕI1 in the case of the light-emitting chip C1) is supplied. Note that, as shown in FIG. 4, as to the ϕI terminals of the other light-emitting chips C2 to C60, the light-up signals ϕI1 to ϕI30 are respectively supplied to the corresponding pairs each formed of two of the light-emitting chips C.

The gate terminal Gt1 of the transfer thyristor T1, which is positioned on one end side of the transfer thyristor array, is connected to the cathode terminal of the start diode Ds. Meanwhile, an anode terminal of the start diode Ds is connected to the second transfer signal line 73.

(Operation of Light-Emitting Portion)

Next, a description will be given of the operation of the light-emitting portion 63. To the light-emitting chips C (C1 to C60) configuring the light-emitting portion 63, a pair of the first transfer signal ϕ1 and the second transfer signal ϕ2 are sharably supplied, as shown in FIG. 4. Meanwhile, to the light-emitting chips C (C1 to C60), the memory signals ϕm (ϕm1 to ϕm60) based on the image dataset are individually supplied. The light-up signals ϕI (ϕI1 to ϕI30) are respectively supplied to the corresponding pairs each formed of two of the light-emitting chips C so that each light-up signal ϕI is shared by the two of the light-emitting chips C configuring each pair, and are individually supplied to the light-emitting chips C configuring different pairs.

The light-emitting chips C (C1 to C60) perform sequential operation (light-up control) that causes the light-emitting thyristors L to light up (emit light) and to be put out by using the pair of the first transfer signal ϕ1 and the second transfer signal ϕ2, in parallel. Here, the sequential operation that causes the light-emitting thyristors L to light up (emit light) and to be put out is called the light-up control.

Accordingly, the operation of the light-emitting portion 63 is recognized if the operation of the light-emitting chip C1 is described. Hereinafter, the operation of the light-emitting chips C will be described by taking the light-emitting chip C1 as an example.

(Light-Up Control of Light-Emitting Chips)

Figure 6:
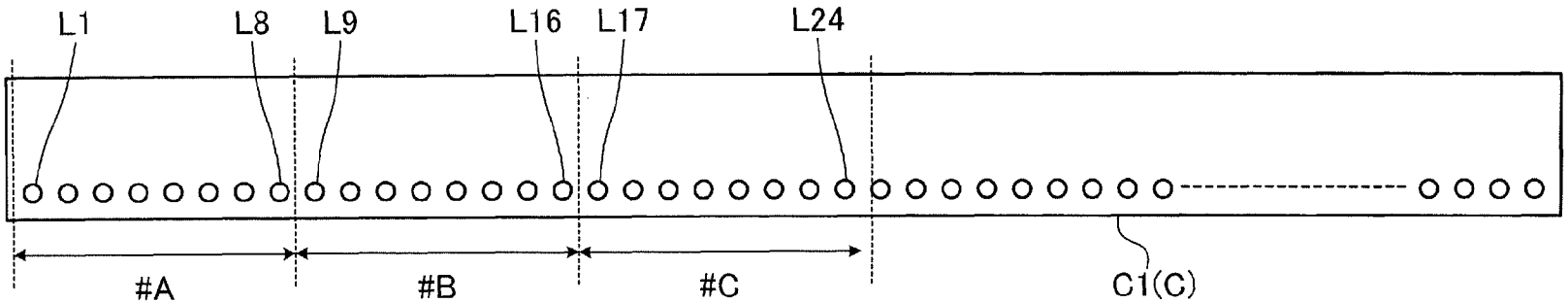
FIG. 6 is a view for explaining a summary of the operation of the light-emitting chip.

FIG. 6 is a view for explaining a summary of the operation of the light-emitting chip C1 (C).

In the first exemplary embodiment, the light-up control is performed in the light-emitting chip C1 (C), by using a group formed of multiple light-emitting points (light-emitting thyristors L) set in advance.

FIG. 6 shows a case where the light-up control is performed by using a group formed of 8 light-emitting thyristors L. In other words, in the first exemplary embodiment, Up to the 8 light-emitting thyristors L are caused to light up at the same time. First, in FIG. 6, light-up control is performed on 8 light-emitting thyristors L1 to L8, which are shown as a group #A starting from the left end of the light-emitting chip C1 (C) (a light-up control period T (#A) shown in FIG. 7 to be described later). Next, light-up control is performed on 8 light-emitting thyristors L9 to L16 in a group #B adjacent to the group #A (a light-up control period T (#B) shown in FIG. 7 to be described later). Then, light-up control is performed on 8 light-emitting thyristors L17 to L24 shown as a group #C. If the number of the light-emitting thyristors L provided to the light-emitting chip C is 128, light-up control is repeatedly performed on 8 light-emitting thyristors L until light-up control is performed on the light-emitting thyristor L128, in the similar manner.

In other words, in the first exemplary embodiment, the light-up control is performed on the groups #A, #B . . . in sequence, in chronological order, and the light-up control is performed on multiple light-emitting points (light-emitting thyristors L) at the same time in each of the groups #A, #B . . . .

(Driving Waveforms)

Figure 7:
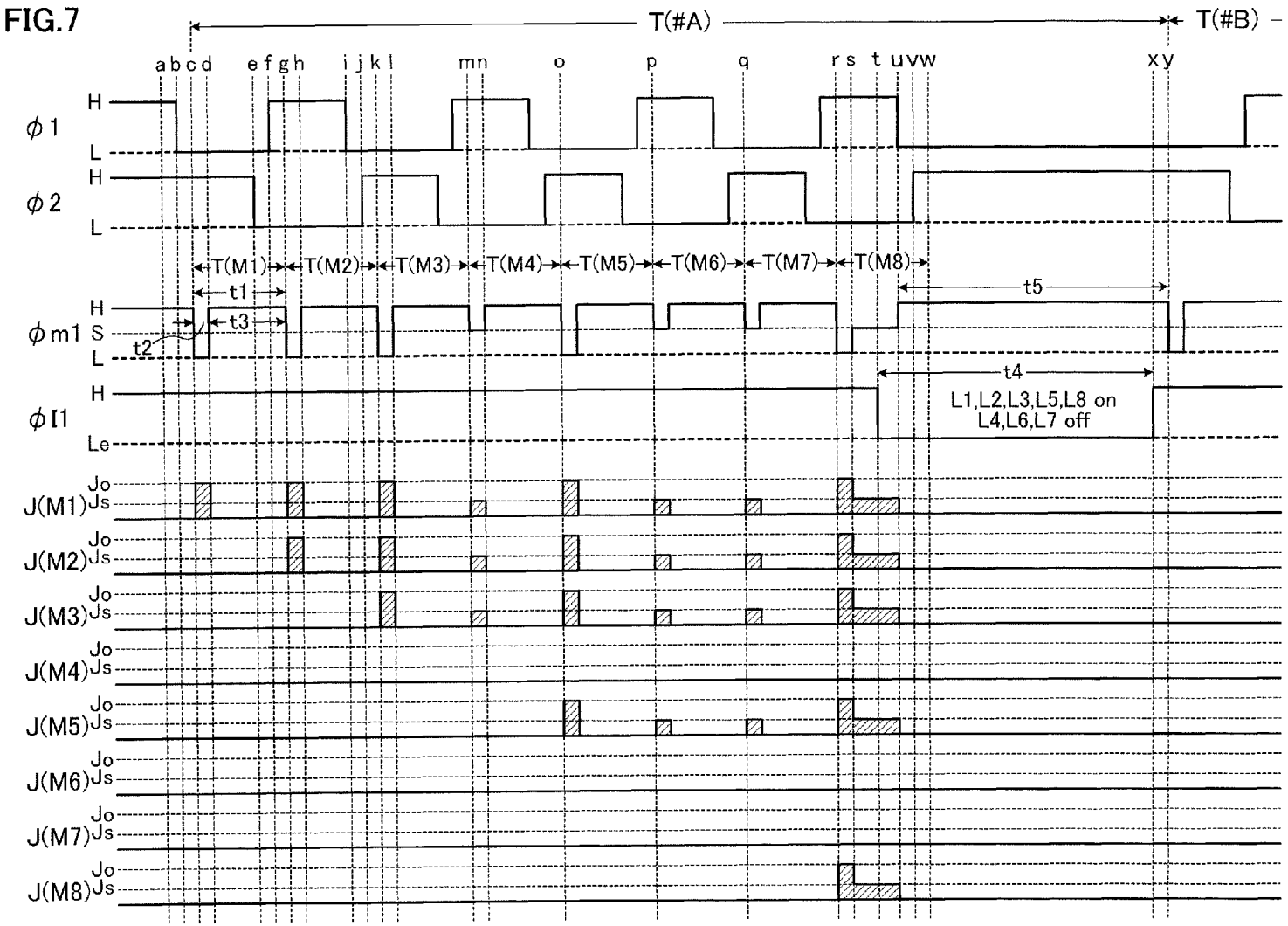
FIG. 7 is a timing chart for explaining the operation of the light-emitting chip in the first exemplary embodiment.

FIG. 7 is a timing chart for explaining the operation of the light-emitting chip C1 (C) in the first exemplary embodiment. In FIG. 7, it is assumed that time elapses from a time point a to a time point y in alphabetical order. Waveforms of the first transfer signal ϕ1, the second transfer signal ϕ2, the memory signals ϕm1, the light-up signal ϕI1 and currents J(M1) to J(M8) flowing between the anode terminals and the cathode terminals of the respective memory thyristors M1 to M8 are shown here.

FIG. 7 shows a case where the light-up control is performed on each group formed of 8 light-emitting thyristors L shown in FIG. 6, and mainly shows a light-up control period T(#A) from a time point c to the time point y, when the light-up control is performed on the light-emitting thyristors L1 to L8 in the group #A. Note that, the light-up control period T(#A) is followed by the light-up control period T(#B) when the light-up control is performed on the light-emitting thyristors L9 to L16 in the group #B, the light-up control period T(#C) when the light-up control is performed on the light-emitting thyristors L17 to L24 in the group #C, and the like.

FIG. 7 shows a case where the light-emitting thyristors L1, L2, L3, L5 and L8 among the 8 light-emitting thyristors L1 to L8 in the group #A are caused to light up (emit light), and the light-emitting thyristors L4, L6 and L7 among the 8 light-emitting thyristors L1 to L8 are kept to be out. In other words, it is assumed that printing of an image dataset "11101001" is performed in the light-up control period T(#A).

The same waveforms of the first transfer signal ϕ1, the second transfer signal ϕ2, and the light-up signal ϕI1 (ϕI) are repeated every light-up control period such as the light-up control period T(#A), the light-up control period T(#B) . . . . On the other hand, although the memory signal ϕm1 (ϕm) has a part changed on the basis of the image dataset, the basic part thereof is repeated in every light-up control period such as the light-up control period T(#A), the light-up control period T(#B) . . . . Accordingly, these waveforms are recognized if only the light-up control period T(#A) is described. Note that, a period from the time point a to the time point c, which is a prior period of the light-up control period T(#A), is a period for starting the operation of the light-emitting chip C1(C). This period will be explained in the description of the operation.

First, the waveforms of the first transfer signal ϕ1, the second transfer signal ϕ2, the memory signal ϕm1 (ϕm) and the light-up signal ϕI1 (ϕI) in the light-up control period T(#A) will be described.

The first transfer signal ϕ1 has a potential at a low level (hereinafter, referred to as "L") at the starting time point c of the light-up control period T(#A), and "L" is changed to a potential at a high level (hereinafter, referred to as "H") at a time point f, and then "H" is changed to "L" at a time point i. At a time point k, the potential thereof is maintained at "L." Thereafter, the same waveform as that in the period from the time point c to the time point k is repeated three times in a period from the time point k to a time point w. At the time point w, the potential thereof is "L," and at the time point y, which is a finish time of the light-up control period T(#A), the potential thereof is maintained at "L."

The second transfer signal ϕ2 has "H" at the time point c, and "H" is changed to "L" at a time point e, and then "L" is changed to "H" at a time point j. At the time point k, the potential thereof is maintained at "H." Thereafter, the same waveform as that in the period from the time point c to the time point k is repeated three times in a period from the time point k to the time point w. At the time point w, the potential thereof is "H," and at the time point y, which is the finish time of the light-up control period T(#A), the potential thereof is maintained at "H."

Here, in a case where the first transfer signal ϕ1 and the second transfer signal ϕ2 are compared with each other in the period from the time point c to the time point w, the first transfer signal ϕ1 and the second transfer signal ϕ2 each have the potential alternately repeating "H" and "L" with interposition of the period when both of the potentials thereof are "L" (for example, from the time point e to the time point f, or the time point i to the time point j), in the period from the time point c to the time point k. The period when the first transfer signal ϕ1 and the second transfer signal ϕ2 have "H" at the same time does not exist. The second transfer signal ϕ2 is a signal that is equal to the first transfer signal ϕ1 shifted to the right by a period corresponding to a period from the time point f to the time point j on the time axis. The period corresponding to the period from the time point f to the time point j is a half of a repeating cycle of each of the first transfer signal ϕ1 and the second transfer signal ϕ2 (double period of a period t1 to be described later).

Next, the memory signal ϕm1 (ϕm) will be described. The period from the time point c to a time point g is a writing period T(M1) when image dataset is written in the memory thyristor M1, and the period from the time point g to the time point k is a writing period T(M2) when image dataset is written in the memory thyristor M2. Similarly, in the light-up control period T(#A), writing periods T(M3) to T(M8) when image datasets are written in respective memory thyristors M3 to M8 are provided. Note that, if the writing periods T(M1) to T(M8) are not distinguished, they are called writing periods T(M).

These writing periods T(M1) to T(M8) are the same period t1.

The memory signal ϕm1 (ϕm) has the potential changed from "H" to "L" at the starting time point c of the writing period T(M1), in accordance with "1" of the first bit forming an image dataset "11101001," and the potential thereof is changed from "L" to "H" at a time point d. Then, the potential thereof is maintained at "H" until the time point g which is a finish time point of the writing period T(M1). At the time point g as a starting time point of the writing period T(M2), the potential thereof is changed from "H" to "L" again, in accordance with "1" of the second bit of the image dataset "11101001," and the potential thereof is changed from "L" to "H" at a time point h. Then, the potential thereof is maintained at "H" until the time point k which is a finish time point of the writing period T(M2). In other words, the waveform in the writing period T(M1) is repeated in the writing period T(M2). Further, the same waveform is repeated also in the writing period T(M3) corresponding to "1" of the third bit of the image dataset "11101001."

Meanwhile, at a time point m as the starting time point of the writing period T(M4), the potential thereof is changed from "H" to a memory level potential (hereinafter, referred to as "S") in accordance with "0" of the fourth bit of the image dataset "11101001," and the potential thereof is changed from "S" to "H" at a time point n. The potential thereof is maintained at "H" until a time point o which is a finish time of the writing period T(M4). In other words, the change from "H" to "S" at the time point m is different from the change from "H" to "L" at the time points c, g and k, which has been described. Note that, the memory level potential "S" is a potential between "H" and "L", and indicates a potential level that enables the memory thyristor M having been turned off after being turned on to be ready to be turned on after a predetermined period, although the detail description thereof will be given later. Note that, the detailed description will be given of turning on and turning off of the thyristor.

Then, in the writing period T(M5), the waveform in the writing period T(M1) is repeated in accordance with "1" of the fifth bit of the image dataset "11101001." In the next writing period T(M6) and the writing period T(M7), the waveform in the writing period T(M4) is repeated in accordance with "0" of the sixth bit and seventh bit of the image dataset "11101001," respectively.

Thereafter, the memory signal ϕm1 (ϕm) has a potential thereof changed from "H" to "L" in accordance with "1" of the eighth bit of the image dataset "11101001" at a time point r which is a starting time point of the writing period T(M8), and the potential thereof is changed from "L" to "S" at a time point s. Then, the potential is changed from "S" to "H" at a time point u. At the finish time point w of the writing period T(M8), the potential thereof is maintained at "H."

Then, the memory signal ϕm1 (ϕm) has the potential maintained at "H" until the time point y which is the finish time point of the light-up control period T(#A).

Note that, the change from "H" to "L" or the change from "H" to "S" in the memory signal ϕm1 (ϕm) at each of the starting time points of the above-mentioned writing periods T(M1) to T(M8) depends on the image dataset that sets the light-emitting thyristors L (each having the same number as the corresponding memory thyristor M) on which the light-up control is performed at the same time in the light-up control period T(#A), to light up or be put out. Specifically, when the image dataset is "1" and the light-emitting thyristor L is caused to light up (emit light), the memory signal ϕm1 (ϕm) has the potential changed from "H" to "L." Meanwhile, when the image dataset is "0" and the light-emitting thyristor L is kept to be out (to emit no light), the memory signal ϕm1 (ϕm) has the potential changed from "H" to "S."

As described above, the memory signal ϕm1 (ϕm) has the potential changed from "H" to any one of "L" and "S" on the basis of the image dataset at each of the starting time points of the writing periods T(M1) to T(M8). The potential thereof is changed from any one of "L" and "S" to "H" after the period t2 elapses, except in the writing period T(M8). Note that, in the writing period T(M8), after the period t2 elapses, the potential thereof is changed to "S." The operation in the writing period T(M8) will be described later.

In a relationship between the memory signal ϕm1 (ϕm) and each of the first transfer signal ϕ1 and the second transfer signal ϕ2, when any one of the first transfer signal ϕ1 and the second transfer signal ϕ2 has "L," the memory signal ϕm1 (ϕm) has the potential changed from "H" to any one of "L" and "S" at each of the starting time points of the writing periods T(M1) to T(M8). For example, the memory signal ϕm1 has "L" at the time point c when the first transfer signal ϕ1 has "L" in the writing period T(M1), and at the time point g when the second transfer signal ϕ2 has "L" in the writing period T(M2). Meanwhile, the memory signal ϕm1 has "S" at the time point m when the second transfer signal ϕ2 has "L." The same is true in the writing periods T(M3), and T(M5) to T(M8).

The light-up signal ϕI1 (ϕI) is a signal that supplies a current to the light-emitting thyristors L for lighting-up (light emission), as described later.

The light-up signal ϕI has "H" at the starting time point c of the light-up control period T(#A), and the potential thereof is changed to a lighting level potential (hereinafter, referred to as "Le") at a time point t. The potential thereof is changed from "Le" to "H" at a time point x. Then, the potential thereof is maintained at "H" at the finish time point y of the light-up control period T(#A).

Note that, the lighting level potential "Le" indicates a potential level (lighting level) at which the light-emitting thyristor L designated to light up on the basis of the image dataset is ready to be turned on, as described later. Turning on the thyristor will be described later.

(Basic Operation of Thyristors)

Prior to the description of the operation of the light-emitting chip C1 (C), the basic operation of the thyristors (transfer thyristors T, memory thyristors M and light-emitting thyristors L) will be described. These thyristors (transfer thyristors T, memory thyristors M and light-emitting thyristors L) are semiconductor devices each having 3 terminals which are an anode terminal (anode), a cathode terminal (cathode) and a gate terminal (gate).

Hereinbelow, as described in FIG. 5, the reference potential Vsub supplied to the anode terminals of the thyristors (Vsub terminal) is set at 0 V ("H"), and the power supply potential Vga supplied to the Vga terminal is set at −3.3 V ("L"), as an example. The thyristors each have a pnpn structure in which a p-type layer, a n-type layer, a p-type layer and a n-type layer, such as GaAs, GaAlAs and the like, are stacked in this order on the substrate 80 having the p-conductive type such as GaAs, GaAlAs or the like, and a diffusion potential (forward potential) Vd of the p-n junction is set at 1.3 V.

The thyristor having the above-mentioned configuration is turned on (sometimes referred to as on) when the lower potential than a threshold voltage (potential larger in negative values) is applied to the cathode terminal. When the thyristor is turned on, it goes into an ON state where the current flows between the anode terminal and the cathode terminal thereof. Here, the threshold voltage of the thyristor is a value obtained by subtracting the diffusion potential Vd from the potential of the gate terminal. Accordingly, if the potential of the gate terminal of the thyristor is −1.3 V, the diffusion potential Vd is 1.3 V, and thus the threshold voltage is −2.6 V. Therefore, the thyristor is turned on when the potential lower than −2.6 V (≦2.6V) is applied to the cathode terminal.

Then, when the thyristor is turned on, the gate terminal of the thyristor has a potential close to that of the anode terminal. The anode terminal is set at the reference potential Vsub (0 V), and thus the potential of the gate terminal becomes a potential close to 0 V (−0.2 V accurately, as described later). Note that, in the following description, the potential of the gate terminal of the thyristor that has been turned on is assumed to be 0 V in an easy-to-understand manner.

Here, the cathode terminal of the thyristor has the diffusion potential Vd. The diffusion potential Vd is 1.3 V, and thus the potential of the cathode terminal is −1.3 V.

Once the thyristor is turned on, the thyristor is kept in the ON state while the potential of the cathode terminal is equal to or less than the potential at the ON state of the thyristor. When the thyristor is in the ON state, the ON state of the thyristor may not be changed to an OFF state even if the potential of the gate terminal is variously changed. On the other hand, when the cathode terminal has a high potential exceeding the potential at the ON state (a potential smaller than the threshold voltage on the minus side (or smaller than that in absolute value) or potential equal to or more than 0 V), the thyristor may not be kept in the ON state and is turned off.

Here, in the thyristor in the ON state, the cathode terminal has the potential of −1.3 V. Accordingly, if the potential applied to the cathode terminal is equal to or less than −1.3 V (≦−1.3 V), the ON state is kept. Meanwhile, the high voltage exceeding −1.3V (>−1.3V) is applied to the cathode terminal, the thyristor is turned off (referred to as off, in some cases). In the case where the cathode terminal is set at "H" (0 V) so that the anode terminal and the cathode terminal have the same potential, the thyristor is also turned off. When the thyristor is turned off, the thyristor goes into a state (OFF state) where an on current does not flow between the anode terminal and the cathode terminal.

As described above, in the ON state, a state where the on current flows in the thyristor is kept, and the thyristor may not be turned off depending on the potential of the gate terminal. In other words, the thyristor has a memory or holding function by setting the ON state.

As described above, it is acceptable that the potential for keeping the ON state of the thyristor is low in comparison with the potential required for turning on the thyristor.

Note that, the light-emitting thyristor L lights up (emits light) when being turned on, whereas the light-emitting thyristor L puts out (emits no light) when being turned off.

As described above, the thyristor is turned on by changing the threshold voltage by using the potential of the gate terminal, and is turned off by changing the potential of the cathode terminal.

(Operation of Light-Emitting Chip)

With reference to FIG. 5, the operation of the light-emitting portion 63 and the light-emitting chip C will be described in accordance with the timing chart shown in FIG. 7.

(Initial State)

At the time point a in the timing chart shown in FIG. 7, the Vsub terminal, which is provided on each of the substrates 80 of the light-emitting chips C (C1 to C60) of the light-emitting portion 63, is set at the reference potential Vsub (0 V) ("H"). Meanwhile, each Vga terminal is set at the power supply potential Vga (−3.3 V) ("L") (see FIG. 4).

Further, the transfer signal generating unit 120 of the signal generating circuit 100 sets the first transfer signal ϕ1 and the second transfer signal ϕ2 at "H," the memory signal generating unit 130 sets the memory signals ϕm (ϕm1 to ϕm60) at "H", and the light-up signal generating unit 110 sets the light-up signals ϕI (ϕI1 to ϕI30) at "H" (see FIG. 4). By this operation, the first transfer signal line 106 becomes "H," and thus the first transfer signal line 72 of each light-emitting chip C becomes "H" through the ϕ1 terminal of each light-emitting chip C in the light-emitting portion 63. Similarly, the second transfer signal line 107 becomes "H," and thus the second transfer signal line 73 of each light-emitting chip C becomes "H" through the ϕ2 terminal of each light-emitting chip C. The memory signal lines 108 (108_1 to 108_60) become "H," and thus the memory signal line 74 of each light-emitting chip C becomes "H" through the ϕm terminal of each light-emitting chip C. Further, the light-up signal lines 109 (109_1 to 109_30) become "H," and thus the light-up signal line 75 of each light-emitting chip C becomes "H" through the ϕI terminal of each light-emitting chip C.

Hereinbelow, the operation of the light-emitting chip C will be described by taking the light-emitting chip C1 as an example. The other light-emitting chips C2 to C60 are similarly operated to the light-emitting chip C1 and are operated in parallel with the light-emitting chip C1 at the same time.

Since the anode terminals of the transfer thyristors T1, T2, T3 . . . , the memory thyristors M1, M2, M3 . . . , and the light-emitting thyristors L1, L2, L3 . . . of the light-emitting chip C1 (C) are connected to the Vsub terminal, "H" (0 V) is supplied thereto.

Meanwhile, since the cathode terminals of the odd-numbered transfer thyristors T1, T3, T5 . . . are connected to the first transfer signal line 72 set at "H," and the cathode terminals of the even-numbered transfer thyristors T2, T4, T6 . . . are connected to the second transfer signal line 73 set at "H," the anode terminals and the cathode terminals of the transfer thyristors T become "H." Thus, each of the transfer thyristors T is in the OFF state.

Similarly, since the cathode terminals of the memory thyristors M1, M2, M3 . . . are connected to the memory signal line 74 set at "H," the anode terminals and the cathode terminals become "H." Thus, each of the memory thyristors M is in the OFF state.

Further, since the cathode terminals of the light-emitting thyristors L1, L2, L3 . . . are connected to the light-up signal ϕI (light-up signal ϕI1 in the case of the light-emitting chip C1) set at "H," the anode terminals and the cathode terminals of the light-emitting thyristors L become "H." Thus, each of the light-emitting thyristors L is in the OFF state.

On the other hand, each of the gate terminals Gt of the transfer thyristors T, the gate terminals Gm of the memory thyristors M and the gate terminals Gl of the light-emitting thyristors L is connected to the power supply line 71 through any of the power supply line resistances Rt and Rn. The power supply line 71 is supplied with the power supply potential Vga through the Vga terminal. Thus, the potentials of these gate terminals Gt, Gm and Gl are the power supply potential Vga (−3.3 V) except in a case to be described later.

The gate terminal Gt1, which is located on the one end side of the transfer thyristor array in FIG. 5, is connected to the cathode terminal of the start diode Ds, as mentioned above. The anode terminal of the start diode Ds is connected to the second transfer signal line 73 set at "H." Thereby, since the cathode terminal of the start diode Ds connected to the gate terminal Gt1 is connected to the power supply line 71 through the power supply line resistance Rt, the cathode terminal thereof is intended to have the potential of "L" (−3.3 V). Meanwhile, the potential of the anode terminal is "H" (0 V), and thus the start diode Ds goes into a state where the electric field is applied thereto in the forward direction (a forward bias state). Consequently, the potential of the cathode terminal (gate terminal GM of the start diode Ds becomes −1.3 V obtained by subtracting the diffusion voltage Vd (1.3 V) from "H" (0 V) set for the anode terminal of the start diode Ds.

Accordingly, the threshold voltage of the transfer thyristor T1 becomes −2.6 V obtained by subtracting the diffusion potential Vd (1.3V) from the potential of the gate terminal Gt1 (−1.3 V), as mentioned above.

Note that, the gate terminal Gt2 of the transfer thyristor T2, which is adjacent to the transfer thyristor T1, is connected to the gate terminal Gt1 through the coupling diode Dc1, and thus the potential thereof becomes −2.6 V obtained by subtracting the diffusion potential Vd (1.3V) of the coupling diode Dc1 from the potential of the gate terminal Gt1 (−1.3 V). Accordingly, the threshold voltage of the transfer thyristor T2 becomes −3.9 V.

Note that, the gate terminal Gt3 of the transfer thyristor T3 is connected to the gate terminal Gt2 of the transfer thyristor T2 through the coupling diode Dc2, and thus the potential thereof is calculated to be −3.9 V according to the above-mentioned calculation method. However, the gate terminal Gt3 is connected to the power supply potential Vga ("L": −3.3 V) through the power supply line resistance Rt3. Thereby, the potential of the gate terminal Gt3 does not have a value less than −3.3 V, and thus it is −3.3 V. Accordingly, the threshold voltage of the transfer thyristor T3 is −4.6 V. The threshold voltages of the transfer thyristors T each having a number not less than 4 are similarly set.

Similarly, the gate terminal Gm1 of the memory thyristor M1 (and also the gate terminal Gl1 of the light-emitting thyristor L1) is connected to the gate terminal Gt1 through the connecting diode Dm1, and thus the potential of the gate terminal Gm1 of the memory thyristor M1 (and the Gate terminal Gl1) becomes −2.6 V obtained by subtracting the diffusion voltage Vd (1.3 V) of the connecting diode Dm1 from the potential of the gate terminal Gt1 (−1.3 V). Accordingly, the threshold voltage of the memory thyristor M1 (light-emitting thyristor L1) becomes −3.9 V.

Note that, the gate terminal Gm2 of the memory thyristor M2 (and also the gate terminal Gl2 of the light-emitting thyristor L2) is connected to the gate terminal Gt1 through the coupling diode Dc1 and the connecting diode Dm2. However, the gate terminal Gm2 is connected to the power supply line 71 through the power supply line resistance Rm2. Thereby, similarly to the case of the above-mentioned transfer thyristor T3, the potential of the gate terminal Gm2 of the memory thyristor M2 (and also the gate terminal Gl2 of the light-emitting thyristor L2) becomes −3.3 V. Accordingly, the threshold voltage of the memory thyristor M2 (light-emitting thyristor L2) becomes −4.6 V. The threshold voltages of the memory thyristors M (and the light emitting thyristors L) each having a number not less than 3 are similarly set.

Note that, even if the threshold values of the thyristors change, the first transfer signal φ1, the second transfer signal φ2, the memory signal φm1 (φm) and the light-up signal φI1 (φI) have "H" (0 V), and thus all of the transfer thyristors T, the memory thyristors M and the light-emitting thyristors L are in the OFF state.

When the potential of the first transfer signal φ1 is changed from "H" (0 V) to "L" (−3.3 V) at a time point b, the transfer thyristor T1, which has the threshold voltage of −2.6 V, is turned on. However, the odd-numbered transfer thyristors T subsequent to the transfer thyristor T3, which are supplied with the first transfer signal φ1, have the threshold voltage of −4.6 V, and thus they are not turned on. In addition, the transfer thyristor T2 having the threshold voltage of −3.9 V is not turned on since the second transfer signal φ2 has "H" (0 V). The even-numbered transfer thyristors T each having a number not less than 4 are not turned on since the threshold values thereof are −4.6 V.

Note that, at the time point b, since the potentials of the memory signal φm1 (φm) and the light-up signal φI1 (φI) are maintained at "H," none of the memory thyristors M and the light-emitting thyristors L are turned on. In other words, at the time point b, it is only the transfer thyristor T1 that is turned on.

When the transfer thyristor T1 is turned on, the potential of the gate terminal Gt1 becomes "H" (0 V) which is the potential of the anode terminal, as mentioned above. Further, the potential of the cathode terminal (the first transfer signal line 72) of the transfer thyristor T1 becomes −1.3 V obtained by subtracting the diffusion potential Vd (1.3V) from the potential of the anode terminal of "H" (0 V).

Thereby, the potential of the anode terminal of the coupling diode Dc1 becomes 0 V which is the potential of the gate terminal Gt1, and the potential of the gate terminal Gt2, which is the cathode terminal of the coupling diode Dc1, is −2.6V, and thus the coupling diode Dc1 goes into a forward bias state. In this state, the potential of the gate terminal Gt2 becomes −1.3 V obtained by subtracting the diffusion potential Vd of the coupling diode Dc1 (1.3 V) from the potential of the gate terminal Gt1 (0 V). Accordingly, the threshold voltage of the transfer thyristor T2 becomes −2.6V.

The potential of the gate terminal Gt3 connected to the gate terminal Gt2 of the transfer thyristor T2 through the coupling diode Dc2 may be calculated by use of the above-mentioned method, and becomes −2.6 V. Accordingly, the threshold voltage of the transfer thyristor T3 becomes −3.9 V. The potentials of the gate terminals Gt of the transfer thyristors T each having a number not less than 4, which follow the transfer thyristor T3, are maintained at the power supply potential Vga (−3.3 V), and thus the threshold voltages of the transfer thyristors T each having a number not less than 4 are maintained at −4.6 V.

When the transfer thyristor T1 is turned on and the potential of the gate terminal Gt1 becomes "H" (0 V), the connecting diode Dm1 is forward biased. Thus, the potential of the gate terminal Gm1 (and also the gate terminal Gl1) becomes −1.3 V obtained by subtracting the diffusion voltage Vd of the connecting diode Dm1 (1.3 V) from the potential of the gate terminal Gt1 (0 V). Accordingly, the threshold voltage of the memory thyristor M1 (and also the light-emitting thyristor L1) becomes −2.6 V.

Note that, the potential of the gate terminal Gm2 of the memory thyristor M2 (and also the gate terminal Gl2), which is adjacent thereto, becomes −2.6 V since the gate terminal Gm2 is connected to the gate terminal Gt1 through the coupling diode Dc1 and the connecting diode Dm2 serially connected to each other. Accordingly, the threshold voltage of the memory thyristor M2 (and also the light-emitting thyristor L2) becomes −3.9 V.

Further, the potentials of the gate terminals Gm of the memory thyristors M (the gate terminals Gl of the light-emitting thyristors L) each having a number not less than 3 are maintained at −3.3 V that is the power supply potential Vga. Accordingly, the threshold voltages of the memory thyristors M (light-emitting thyristors L) each having a number not less than 3 are maintained at −4.6 V.

As described above, immediately after the time point b (which indicates a time point after the state of the thyristor or the like is changed in accordance with the change of the potential of the signal at the time point b), only the transfer thyristor T1 is in the ON state.

(Operating State)

When the potential of the memory signal φm1 (φm) is changed from "H" (0 V) to "L" (−3.3 V) at the time point c, the memory thyristor M1, which has the threshold voltage of −2.6 V, is turned on. However, the memory thyristor M2 and the memory thyristors M each having a number not less than 3 are not turned on since the memory thyristor M2 has the threshold voltage of −3.9 V and the memory thyristors M each having the number not less than 3 have the threshold voltage of −4.6 V.

In other words, the memory thyristor M that is turned on at the time point c is only the memory thyristor M1.

Then, as shown in the current J(M1), an on current Jo flows into the memory thyristor M1 that has been turned on.

When the memory thyristor M1 is turned on, the potential of the gate terminal Gm1 becomes "H" (0 V), similarly to the case of the transfer thyristor T1. Then, the threshold voltage of the light-emitting thyristor L becomes −1.3 V since the gate terminal Gl1 of the light-emitting thyristor L1 is connected to the gate terminal Gm1.

Note that, the gate terminal Gm2 of the memory thyristor M2 (the gate terminal Gl2 of the light-emitting thyristor L2) has the potential of −2.6 V since the gate terminal Gm2 (the gate terminal Gl2) is connected to the gate terminal Gt2 that has become −1.3V through the forward-biased connecting diode Dm2. Thus, the threshold voltage of the memory thyristor M2 (light-emitting thyristor L2) becomes −3.9 V.

However, the threshold voltages of the memory thyristors M (light-emitting thyristors L) each having a number not less than 3 are −4.6 V since the voltages of the gate terminals Gm (gate terminals Gl) are −3.3 V.

Accordingly, at the time point c, the memory thyristors M each having a number not less than 2 may not be turned on.

In addition, since the light-up signal φI1 (φI) has "H" (0 V), no light-emitting thyristors L are turned on.

Therefore, immediately after the time point c, the transfer thyristor T1 and the memory thyristor M1 are kept in the ON state.

Note that, as described above, the potential of the cathode terminal of the memory thyristor M1 that has been turned on becomes −1.3 V obtained by subtracting the diffusion voltage Vd (1.3 V) from the potential of the anode terminal (0 V). However, since the memory thyristor M1 is connected to the memory signal line 74 through the resistance Rn1, the memory signal line 74 is maintained at the potential of "L" (−3.3 V).

Hereinabove, the operation of the thyristors (transfer thyristors T, memory thyristors M and light-emitting thyristors L) and the diodes (coupling diodes Dc and connecting diodes Dm) of the light-emitting chip C1 (C) has been individually described. However, the operation of the thyristors and the diodes will be described as follows.

Specifically, when the thyristor is turned on, the potential of the gate terminal (gate terminal Gt, gate terminal Gm and gate terminal Gl) thereof becomes "H" (0 V).

Then, a thyristor having a gate terminal, which is connected to the gate terminal that has the potential of "H" (0 V) without any diode, has the threshold voltage of −1.3 V.

Further, a potential of a gate terminal connected to the gate terminal having the potential of "H" (0 V) through one stage of a forward-biased diode (one diode) becomes −1.3 V obtained by subtracting the diffusion potential Vd (1.3V) from "H" (0 V). Thus, a threshold voltage of a thyristor having this gate terminal becomes −2.6 V.

Furthermore, a potential of a gate terminal connected to the gate terminal having the potential of "H" (0 V) through two stages of forward-biased diodes (two diodes serially connected to each other) becomes −2.6 V obtained by subtracting twice the diffusion voltage Vd (1.3 V) from "H" (0 V). Thus, a threshold voltage of a thyristor having this gate terminal becomes −3.9 V.

Furthermore, a gate terminal connected to the gate terminal having the potential of "H" (0 V) through 3 stages of diodes or more is provided with the power supply potential Vga (−3.3 V) through the power supply line resistance (Rt or Rm), and accordingly is affected by the gate terminal having the potential of "H" (0 V) any longer. Thus, the potential thereof is maintained at the power supply potential Vga (−3.3 V). Accordingly, a threshold voltage of a thyristor having this gate terminal becomes −4.6 V.

The thyristor connected to the gate terminal having the potential of "H" (0 V) without any diode and the thyristor having the gate terminal connected thereto through the one stage of the forward-biased diode are ready to be turned on at the potential of "L" (−3.3 V) or less (or larger in absolute value). Meanwhile, the thyristor having the gate terminal connected thereto through the two stages of the forward-biased diodes or more is not turned on at the potential of "L" (−3.3 V).

Therefore, it is only necessary to focus on the thyristor having the gate terminal connected to the gate terminal having the potential of "H" (0 V) without any diode and the thyristor having the gate terminal connected thereto through the one stage of the forward-biased diode.

Hereinafter, a description will be given of only the thyristor having the gate terminal connected to the gate terminal having the potential of "H" (0 V) without any diode and the thyristor having the gate terminal connected thereto through the one stage of the forward-biased diode at the respective timing. At the respective timing, descriptions of the thyristors that are not turned on, the potential of the gate terminals of these thyristors, and the change of the threshold voltages thereof will be omitted.

With reference back to FIG. 7, the rest of the operation of the light-emitting chip C1 (C) will be described.

At the time point d, the potential of the memory signal ϕm1 (ϕm) is changed from "L" to "H." Then, since the anode terminal and the cathode terminal of the memory thyristor M1 have the same potential of "H," the memory thyristor M1 is turned off. Accordingly, as shown in the current J(M1), the current stops flowing into the memory thyristor M1.

Since the gate terminal Gm1 is connected to the power supply potential Vga (−3.3 V) through the power supply line resistance Rm1, the potential of the gate terminal Gm1 starts to change from "H" (0 V) to the power supply potential Vga (−3.3 V). In other words, electric charge accumulated in a parasitic capacity of the gate terminal Gm1 is discharged through the power supply line resistance Rm1.

Immediately after the time point d, only the transfer thyristor T1 is kept in the ON state.

At the time point e, the potential of the second transfer signal ϕ2 is changed from "H" to "L." Then, the transfer thyristor T2 having the threshold voltage of −2.6 V is turned on.

When the transfer thyristor T2 is turned on, the potential of the gate terminal Gt2 is increased up to "H" (0 V). Further, the threshold voltage of the transfer thyristor T3 connected to the gate terminal Gt2 through one stage of the forward-biased diode (coupling diode Dc2) becomes −2.6 V. Similarly, both of the threshold voltages of the memory thyristor M2 and the light-emitting thyristor L2 which are connected to the gate terminal Gt2 through the one stage of the diode (connecting diode Dm2) become −2.6 V.

At this time, the transfer thyristor T1 is kept in the ON state. Accordingly, the potential of the first transfer signal line 72 to which the cathode terminals of the odd-numbered transfer thyristors T1, T3 . . . are connected is maintained at the diffusion potential Vd (−1.3 V) by the transfer thyristor T1 which is in the ON state. Accordingly, the transfer thyristor T3 may not be turned on.

Immediately after the time point e, both of the transfer thyristors T1 and T2 are kept in the ON state.

At the time point f, the potential ϕ1 of the first transfer signal ϕ1 is changed from "L" to "H." Then, the cathode terminal and the anode terminal of the transfer thyristor T1 become the same potential "H." Accordingly, the transfer thyristor T1 may not be kept in the ON state any longer, and thus it is turned off.

At this time, the gate terminal Gt1 of the transfer thyristor T1 starts to change toward the power supply potential Vga (−3.3 V) since the gate terminal Gt1 is connected to the power supply line 71 through the power supply line resistance Rt1. By this change, the coupling diode Dc1 between the transfer thyristor T1 and the transfer thyristor T2 becomes a reverse bias. Thus, the potential "H" (0 V) of the gate terminal Gt2 does not affect the gate terminal Gt1 any longer.

In other words, as described above, the potential of "H" (0 V) does not affect the gate terminal connected thereto through the reverse-biased diode.

Immediately after the time point f, the transfer thyristor T2 is kept in the ON state.

At the time point g, the potential of the memory signal ϕm1 (ϕm) is changed from "H" (0 V) to "L" (−3.3 V). Then, the memory thyristor M2 is turned on since the threshold voltage thereof is −2.6 V.

The gate terminal Gm1 starts to change the potential from "H" (0 V) to the power supply potential Vga (−3.3 V) at the time point d. This potential change is determined by a time constant defined by the parasitic capacity of the gate terminal Gm1 and the power supply line resistance Rm1. At the time point g, if the gate terminal Gm1 is maintained at the potential of −2 V or more, the threshold voltage of the memory thyristor M1 is −3.3 V or more. Accordingly, at the time point g when the potential of the memory signal ϕm1 (ϕm) is changed from "H" (0 V) to "L" (−3.3 V), if the gate terminal Gm1 is maintained at the potential of −2 V or more, the memory thyristor M1 is also turned on.

When the memory thyristors M1 and M2 are turned on, the on current Jo flows into the memory thyristors M1 and M2, as described in the currents J(M1) and J(M2). Then, the potentials of the gate terminals Gm1 and Gm2 become "H" (0 V).

In other words, immediately after the time point g, the transfer thyristor T2 and the memory thyristors M1 and M2 are in the ON state.

Then, when the potential of the memory signal φm1 (φm) is changed from "L" to "H" at the time point h, all of the potentials of the anode terminals and the cathode terminals of the memory thyristors M1 and M2 become "H," and thus both of the memory thyristors M1 and M2 are turned off. Similarly to the case at the time point d, the potentials of the gate terminals Gm1 and Gm2 start to change from "H" (0 V) toward the power supply potential Vga (−3.3 V). Accordingly, the current does not flow into the memory thyristors M1 and M2, as described in the currents J(M1) and J(M2).

Immediately after the time point h, the transfer thyristor T2 is kept in the ON state.

When the potential of the first transfer signal φ1 is changed from "H" to "L" at the time point i, the transfer thyristor T3 having the threshold voltage of −2.6 V is turned on. Then, the potential of the gate terminal Gt3 is increased up to "H" (0 V). In addition, the threshold voltage of the transfer thyristor T4 connected to the gate terminal Gt3 through the one stage of the forward-biased diode (coupling diode Dc3) becomes −2.6 V. Similarly, the threshold voltage of the memory thyristor M3 having the gate terminal Gm3 (the light-emitting thyristor L3 having the gate terminal G3) connected to the gate terminal Gt3 through the one stage of the diode (connecting diode Dm3) becomes −2.6V.

At this time, since the transfer thyristor T2 is kept in the ON state, the second transfer signal line 73 to which the cathode terminals of the even-numbered transfer thyristors T2, T4 . . . are connected is maintained at the potential of the diffusion potential Vd (−1.3 V) by the transfer thyristor T2 being in the ON state. Accordingly, the transfer thyristor T4 is not turned on.

Immediately after the time point i, both of the transfer thyristors T2 and T3 are kept in the ON state.

At the time point j, the potential of the second transfer signal φ2 is changed from "L" to "H." Then, since both of the cathode terminal and the anode terminal of the transfer thyristor T2 become the potential "H," the transfer thyristor T2 may not be kept in the ON state any longer, and thus the transfer thyristor T2 is turned off.

At this time, since the gate terminal Gt2 of the transfer thyristor T2 is connected to the power supply line 71 through the power supply line resistance Rt2, the potential of the gate terminal Gt2 starts to change from "H" (0 V) to the power supply potential Vga (−3.3 V). Then, the coupling diode Dc2 between the transfer thyristor T2 and the transfer thyristor T3 becomes a reverse bias, and thus the gate terminal Gt3 that has become "H" (0 V) does not affect the gate terminal Gt2.

Immediately after the time point j, the transfer thyristor T3 is kept in the ON state.

The writing period T(M3) from the time point k to the time point m repeats the writing period T(M1). As described in the operation at the time point g, at the time point k, the gate terminals Gm1 and Gm2 of the memory thyristors M1 and M2 have the potential of −2 V or more, the threshold voltages of the memory thyristors M1 and M2 are −3.3 V or more. Accordingly, at the time point k, if the memory signal φm1 (φm) is changed from "H" (0 V) to "L" (−3.3 V), the memory thyristors M1 and M2 are ready to be turned on in addition to the memory thyristor M3 having the threshold potential of −2.6 V. Then, as shown in the currents J(M1), J(M2) and J(M3), the on current Jo flows into the memory thyristors M1, M2 and M3. The potentials of the gate terminals Gm1, Gm2 and Gm3 become 0 V.

In other words, immediately after the time point k, the transfer thyristor T3 and the memory thyristors M1, M2 and M3 are kept in the ON state. The threshold voltage of the memory thyristor M4 is −2.6 V.

Then, when the potential of the memory signal φm1 (φm) is changed from "L" (−3.3 V) to "H" (0 V) at a time point 1, the memory thyristors M1, M2 and M3 are turned off, and the current does not flow into the memory thyristors M1, M2 and M3, as shown in the currents J(M1), J(M2) and J(M3). In addition, the potentials of the gate terminals Gm1, Gm2 and Gm3 of the memory thyristors M1, M2 and M3 starts to change from 0 V toward the power supply potential Vga (−3.3 V).

Next, the writing period T (M4) from the time point m to the time point o will be described. At the time point m, the potential of the memory signal φm1 (φm) is changed from "H" to "S." At the time point m, the threshold voltage of the memory thyristor M4 is −2.6 V. However, unlike "L," "S" is set at a potential at which the memory thyristor M having the threshold voltage of −2.6 V is not turned on. For example, "S" is set at −2.5 V.

However, the potential of the gate terminals Gm1, Gm2 and Gm3 of the memory thyristors M1, M2 and M3 start to change from 0 V to −3.3 V at the time point 1. Then, at the time point m, if the potentials of these gate terminals Gm1, Gm2 and Gm3 are −1.2 V or more, the threshold voltages of the memory thyristors M1, M2 and M3 become −2.5 V or more. Accordingly, when the memory signal φm1 (φm) is changed from "H" to "S" (−2.5V) at the time point m, the memory thyristors M1, M2 and M3 are turned on again. However, the memory thyristor M4 is not turned on, as mentioned above.

Since the memory signal φm1 (φm) has the potential of "S," the current flowing into the memory thyristors M1, M2 and M3 that have been turned on becomes a holding current Js smaller than the on current Jo, as described in the currents J(M1), J(M2) and J(M3). Note that, since the memory thyristor M4 is in the OFF state, no current flows thereinto, as shown in the current J(M4).

Therefore, immediately after the time point m, the transfer thyristor T4 and the memory thyristors M1, M2 and M3 are in ON state.

As described above, at the time point m, the memory thyristors M1, M2 and M3 are set to be in the ON state, and the memory thyristor M4 is set to be in the OFF state.

In other words, by setting the potential level of "S" in addition to "H" and "L" for the memory signal φm, when the potential of the memory signal φm is changed from "H" to "S," the memory thyristor M that has been turned off after being turned on is caused to be turned on again, and the memory thyristor M that has not been turned on yet is kept so as not to be turned on. That is, by using these two levels of "S" and "L" depending on the situation, whether the transfer thyristor M is turned on or not is selected.

Thus, when the potential of the memory signal φm1 (φm) is changed from "H" to "L," or from "H" to "S," the potential of the gate terminal Gm of the memory thyristor M that has been turned off after being turned on (for example, the memory thyristors M1, M2 and M3) may have a value obtained by adding the diffusion potential Vd (1.3 V) to the potential of "S" (−1.2 V in the case of "S" of −2.5 V) or more.

The next writing period T(M5) from the time point o to a time point p repeats the writing period T(M3), although the transfer thyristor T and the memory thyristor M have a different number. Similarly, the writing period T(M6) from the time point p to a time point q and the writing period T(M7) from the time point q to the time point r repeat the writing period T(M4). Accordingly, the detailed description thereof will be omitted.

Next, a description will be given of the time point r and the subsequent period.

At the time point r, the potential of the memory signal φm1 (φm) is changed from "H" (0 V) to "L" (−3.3 V). Then, since the memory thyristor M8 has the threshold voltage of −2.6 V at the writing period T (M7), the memory thyristor M8 is turned on. The gate terminals Gm1, Gm2, Gm3 and Gm5 of the memory thyristors M1, M2, M3 and M5 are maintained at the voltage of −1.2V or more, and thus the threshold voltages of the memory thyristors M1, M2, M3 and M5 are −2.5 V or more. Accordingly, at the time point r, the memory thyristors M1, M2, M3 and M5 are turned on.

In other words, immediately after the time point r, the transfer thyristor T8 and the memory thyristors M1, M2, M3 and M5 are in the ON state.

As for the current flowing into the memory thyristors M, at the time point r, the on current Jo flows into the memory thyristors M1, M2, M3, M5 and M8, as shown in the currents J(M1), J(M2), J(M3), J(M5) and J(M8). Meanwhile, no current flows into the memory thyristors M4, M6 and M7, as shown in the currents J(M4), J(M6) and J(M7).

At the time point s, the potential of the memory signal φm1 (φm) is changed from "L" to "S." Since the cathode voltages of the memory thyristors M being in the ON state are −1.3 V, the memory thyristors M are kept in the ON state by the memory level potential "S" (−2.5 V).

At this time, a holding current Js flows into the memory thyristors M1, M2, M3, M5 and M8, as shown in the currents J(M1), J(M2), J(M3), J(M5) and J(M8). Meanwhile, no current flows into the memory thyristors M4, M6 and M7 being in the OFF state.

The potentials of the gate terminals Gm1, Gm2, Gm3, Gm5 and Gm8 of the memory thyristors M1, M2, M3, M5 and M8 being in the ON state are "H" (0 V). Thus, the light-emitting thyristors L1, L2, L3, L5 and L8 having the gate terminals Gl1, Gl2, Gl3, Gl5, and Gl8 respectively connected to the respective gate terminals Gm1, Gm2, Gm3, Gm5 and Gm8 have the threshold voltage of −1.3 V. Meanwhile, since the gate terminals Gm4, Gm6 and Gm7 of the respective memory thyristors M4, M6 and M7 being in the OFF state are connected to the power supply potential Vga (−3.3 V) through the respective power supply line resistances Rm4, Rm6 and Rm7, the gate terminals Gm4, Gm6 and Gm7 are maintained at −3.3V. Accordingly, the light-emitting thyristors L4, L6 and L7 having the respective gate terminals Gl4, Gl6 and Gl7 connected to the respective gate terminals Gm4, Gm6 and Gm7 have the threshold voltage of −4.6V.

Since the transfer thyristor T8 is in the ON state, the potential of the gate terminal Gt8 is 0 V. The potential of the gate terminal Gl9 (not shown in the figure) of the light-emitting thyristor L9 (not shown in the figure), which is provided so as to be adjacent to the light-emitting thyristor L8 and is connected to the gate terminal Gt8 through the two stages of the forward-biased diodes (coupling diode Dc8 and the connecting diode Dm9 which is not shown in the figure), is −2.6 V. Accordingly, the threshold voltage of the light-emitting thyristor L9 is −3.9 V. In addition, the threshold voltages of the light-emitting thyristors L each having a number not less than 10 are −4.6 V since the potentials of the gate terminals Gl thereof are equal to the power supply potential Vga (−3.3 V).

In other words, the threshold voltages of the light-emitting thyristors L1, L2, L3, L5 and L8 are −1.3 V, the threshold voltages of the light-emitting thyristors L4, L6 and L7 are −4.6 V, the threshold voltage of the light-emitting thyristor L9 is −3.9 V, and the threshold voltages of the light-emitting thyristors L each having a number not less than 10 are −4.6 V.

Then, the memory signal φm1 (φm) is maintained at the potential of "S" until the time point u. In this period, the memory thyristors M1, M2, M3, M5 and M8 are kept in the ON state.

In the above description, the potential of the memory signal φm1 (φm) is changed from "H" to "L" at the time point r of the writing period T(M8) in order to cause the light-emitting thyristor L8 to light up in addition to the light-emitting thyristors L1, L2, L3 and L5. However, in a case where the light-emitting thyristor L8 is not caused to light up, the potential of the memory signal φm1 (φm) is to be changed from "H" to "S" at the starting time point r of the writing period T(M8).

Here, in order to describe the potential "Le" of the light-up signal φl1 (φl), a description will be given of the threshold voltage of the light-emitting thyristor L8 in the case where the light-emitting thyristor L8 is not caused to light up.

In the case where the light-emitting thyristor L8 is not caused to light up, the potential of the memory signal φm1 (φm) is changed from "H" (0 V) to "S" (−2.5V) at the time point r. However, since the threshold voltage of the memory thyristor M8 is −2.6 V, the memory thyristor M8 is not turned on. Meanwhile, since the potentials of the gate terminals Gm1, Gm2, Gm3 and Gm5 of the memory thyristors M1, M2, M3 and M5 are maintained at −1.2 V or more, as mentioned above, the threshold voltages of the memory thyristors M1, M2, M3 and M5 are −2.5 V or more. Accordingly, at the time point r, the memory thyristors M1, M2, M3 and M5 are turned on. Then, all of the gate terminals Gm1, Gm2, Gm3 and Gm5 of the memory thyristors M1, M2, M3 and M5 become 0 V. Thus, all of the threshold voltages of the light-emitting thyristors L1, L2, L3 and L5 become −1.3 V, since all of the potentials of the gate terminals Gl1, Gl2, Gl3 and Gl5 connected to the respective gate terminals Gm1, Gm2, Gm3 and Gm5 become 0 V.

Since the transfer thyristor T8 is in the ON state, the potential of the gate terminal Gt8 thereof is 0 V. Further, since the gate terminal Gl8 of the light-emitting thyristor L8 is connected to the gate terminal Gt8 through the one stage of the forward-biased diode (connecting diode Dm8), the potential of the gate terminal Gl8 becomes −1.3 V. Accordingly, the threshold voltage of the light-emitting thyristor L8 becomes −2.6 V. That is, it is found that the threshold voltages of the light-emitting thyristors L, which is not caused to light up, become −2.6 V in some cases.

Note that, the threshold voltages of the other light-emitting thyristors L except the light-emitting thyristor L8 are the same as those in the above-mentioned case where the light-emitting thyristor L8 is also caused to light up.

Specifically, the threshold voltages of the light-emitting thyristors L1, L2, L3 and L5 are −1.3 V, the threshold voltages of the light-emitting thyristors L4, L6 and L7 are −4.6 V, the threshold voltage of the light-emitting thyristor L8 is −2.6 V, the threshold voltage of the light-emitting thyristor L9 is −3.9 V, and the threshold voltages of the light-emitting thyristors L each having a number not less than 10 are −4.6 V.

In this period, the memory thyristors M1, M2, M3 and M5 are kept in the ON state.

As described above, while the threshold voltages of the light-emitting thyristors L to be caused to light up are −1.3 V, the threshold voltages of the light-emitting thyristors L not to be caused to light up are −2.6 V or less (≦−2.6V).

Accordingly, in order to cause the light-emitting thyristors L that are to light up to light up, the lighting level potential "Le" of the light-up signal ϕI1 (ϕI) is set at a value larger than −2.6 V and not more than −1.3 V (−2.6 V<"Le"≦−1.3 V).

At the time point t, the potential of the light-up signal ϕI1 (ϕI) is changed from "H" to "Le." Then, the light-emitting thyristors L1, L2, L3, L5 and L8 are turned on and light up (emit light) since the threshold voltages thereof are −1.3 V. At this time, since the light-up signal ϕI1 (ϕI) is supplied with the current driving, the potential of the light-up signal line 75 does not become the potentials of the cathode terminals of the light-emitting thyristors L being in the ON state, and multiple light-emitting thyristors L may be caused to light up at the same time.

However, since the other light-emitting thyristors L except these light-emitting thyristors L have the threshold voltage of −2.6V or less, they are not turned on and not light up (emit no light).

Accordingly, immediately after the time point t, the transfer thyristor T8 and the memory thyristors M1, M2, M3, M5 and M8 are kept in the ON state, and the light-emitting thyristors L1, L2, L3, L5 and L8 are kept in a lighting-up (on) state.

At the time point u, the potential of the memory signal ϕm1 (ϕm) is changed from "S" to "H." Then, since all of the cathode terminals and the anode terminals of the memory thyristors M1, M2, M3, M5 and M8 become the potential "H," the memory thyristors M1, M2, M3, M5 and M8 may not be kept in the ON state any longer and thus they are turned off. Thus, no current flows into the memory thyristors M1, M2, M3, M5 and M8 as shown in the currents J(M1) to J(M8).

At the same time point u, the potential of the first transfer signal ϕ1 is changed from "H" to "L." Then, the transfer thyristor T9 having the threshold voltage of −2.6 V is turned on. Further, the threshold voltage of the transfer thyristor T10 is set at −2.6 V. Furthermore, since the potential of the gate terminal Gt9 (not shown in FIG. 5) of the transfer thyristor T9 (not shown in FIG. 5) becomes 0 V, and thus the potential of the gate terminal Gm9 (not shown in FIG. 5) of the memory thyristor M9 (not shown in FIG. 5) connected thereto through the one stage of the forward-direction diode (connecting diode Dm9 (not shown in FIG. 5)) becomes −1.3 V, and the threshold voltage of the memory thyristor M9 becomes −2.6 V. At this time, even if the memory signal ϕm1 (ϕm) is maintained at the potential of "S," the memory thyristor M9 is not turned on. In addition, even if the potential of the memory signal ϕm1 (ϕm) is changed to "H," the memory thyristor M9 is not turned on.

Immediately after the time point u, the transfer thyristors T8 and T9 are kept in the ON state, and the light-emitting thyristors L1, L2, L3, L5 and L8 are kept in the lighting-up (on) state.

Note that, in the first exemplary embodiment, at the time point u, the potential change of the memory signal ϕm1 (ϕm) from "S" to "H" and the potential change of the first transfer signal ϕ1 from "H" to "L" are simultaneously performed. As described above, even if the potential of the memory signal ϕm1 (ϕm) is "S" or "H," the memory thyristor M9 is not turned on. Thus, there is no problem even if any one of these changes is firstly performed.

At a time point v, the potential of the second transfer signal ϕ2 is changed from "L" to "H." Then, since both of the potentials of the cathode terminal and the anode terminal of the transfer thyristor T8 become "H," the transfer thyristor T8 may not be kept in the ON state any longer and thus the transfer thyristor T8 is turned off.

Immediately after the time point v, the transfer thyristor T9 is kept in the ON state, and the light-emitting thyristors L1, L2, L3, L5 and L8 are kept in the lighting-up (on) state.

At the time point x, the potential of the light-up signal ϕI1 (ϕI) is changed from "Le" to "H." Then, since all of the potentials of the cathode terminals and the anode terminals of the light-emitting thyristors L1, L2, L3, L5 and L8 become "H," the light-emitting thyristors L1, L2, L3, L5 and L8 may not be kept in the ON state any longer and thus they are turned off and put out. In other words, the light-emitting thyristors L1, L2, L3, L5 and L8 have lighted up during a period from the time point t to the time point x (lighting period T4).

Immediately after the time point x, the transfer thyristor T9 is kept in the ON state.

At the time point y, the potential of the memory signal ϕm1 (ϕm) is changed from "H" to "L." Then, the memory thyristor M9 having the threshold voltage of −2.6 V is turned on.

A period from the time point y is a light-up control period T(#B) when the group #B shown in FIG. 6 (light-emitting thyristors L9 to L16) are driven. The light-up control period T(#B) repeats the light-up control period (#A) except the memory signal ϕm1 (ϕm) set on the basis of the image dataset. In other words, the time point y of the light-up control period T(#B) corresponds to the time point c of the light-up control period T(#A). The subsequent light-up control periods T(#C) . . . are the same as the above.

In the first exemplary embodiment, the light-emitting thyristors L1, L2, L3, L5 and L8 are caused to simultaneously light up (emit light) in the lighting period t4 of the light-up control period T(#A) in accordance with the image dataset "11101001."

The above description will be summarized as follows.

In the first exemplary embodiment, while the transfer thyristors T have a period (for example, a period from the time point e to the time point f) when the two adjacent transfer thyristors T both go into the ON state by use of the first transfer signal ϕ1 and the second transfer signal ϕ2, the transfer thyristors T are set to be changed from the OFF state to the ON state, and changed from the ON state to the OFF state, in numerical order. In other words, the ON state is shifted in the numerical order of the transfer thyristor array.

In the period when any one of the first transfer signal ϕ1 and the second transfer signal ϕ2 has the potential of "L," only one of the transfer thyristors T is in the ON state (for example, only the transfer thyristor T2 is in the ON state in the period from the time point f to the time point i in FIG. 7).

When the transfer thyristor T goes into the ON state, the potential of the gate terminal Gt thereof is increased to "H" (0 V), and the threshold voltage of the memory thyristor M to which the gate terminal Gm is connected is increased (−2.6 V). At the timing when only one transfer thyristor T is in the ON state (for example, the time points c, g, and k in FIG. 7), if the potential of the memory signal ϕm is set at "L" (−3.3 V), the memory thyristor M having the increased threshold voltage is turned on. Then, the potential of the gate terminal Gm is increased to "H" (0 V). Meanwhile, if the potential of the memory signal ϕm is set at "S" (−2.5 V) between "H" and "L," the memory thyristor M having the increased threshold voltage is not turned on.

Thereafter, the memory thyristor M that has been turned on is turned off. Thereby, the potential of the gate terminal Gm of the memory thyristor M that is turned off after being turned on is changed from "H" (0 V) toward "L" (−3.3 V). However, before the potential of the gate terminal Gm is lower than the predetermined potential (−1.2 V), the potential of the memory signal ϕm is caused to be changed to "L" (−3.3 V) or "S" (−2.5 V) again, and thus the memory thyristor M that has been turned off after being turned on is caused to be turned on again (for example, the time points g, k, and m.)

As described above, at the timing when only one transfer thyristor T is in the ON state, in a case where the light-emitting thyristor L is caused to light up in accordance with the image dataset (for example, in a case of the image dataset "1"), the potential of the memory signal ϕm is changed to "L" (−3.3 V), and in a case where the light-emitting thyristor L is not caused to light up (for example, in a case of the image dataset "0"), the potential of the memory signal ϕm is changed to "S" (−2.5 V). Accordingly, only the memory thyristor M having the same number as the light-emitting thyristor L corresponding to the image dataset "1" (being caused to light up) is caused to be turned on.

If the memory thyristor M that has been turned on is turned off, it is turned on again. Thus, a position (number) of the light-emitting thyristor L that is caused to light up is memorized. At this time, the number of the light-emitting thyristors L that are caused to light up may be plural. At the time point (the time point r in the first exemplary embodiment) when the writing periods T(M) corresponding to the predetermined number of bits are finished, all of the memory thyristors M corresponding to the light-emitting thyristors L that is caused to light up are turned on.

When the memory thyristor M is in the ON state, the threshold voltage of the light-emitting thyristor L having the same number as the memory thyristor M is increased (to −1.3V). Thus, by changing the potential of the light-up signal ϕI from "H" to "Le," the light-emitting thyristor L having the same number as the memory thyristor M being in the ON state is turned on and lights up (emits light).

In other words, the memory thyristor M has a function (latch function) that memorizes the position (number) of the transfer thyristor L caused to light up in accordance with the image dataset.

The potential "L" of the memory signal ϕm works as a signal for memorizing the position (number) of the light-emitting thyristor L to light up on the basis of the image dataset, and the potential "S" of the memory signal ϕm works as a signal (refresh signal) for causing the memory thyristor M that has been turned off after being turn on to be turned on again. However, the potential "S" does not causes another memory thyristor M to be turned on. In other words, the memory in which the memory thyristor M has been turned on is kept until the light-emitting thyristor L is turned on and lights up (emits light).

Note that, when the light-emitting thyristor L lights up (emits light), the memory thyristor M is not necessary to memorize the position (number) of the light-emitting thyristor L to light up any longer. For resetting the memory of the memory thyristor M (history of turning on the memory thyristor M), it is only necessary to cause the threshold voltage of the memory thyristor M to be low (<−3.3 V), that is, to cause the potential of the gate terminal Gm to be low (<−2V) in order to prevent the memory thyristor M that has been turned off after being turned on from being turned on again even when the potential of the memory signal ϕm is changed to "L" (−3.3 V). As described above, the potential of the gate terminal Gm changes in accordance with the time constant defined by the parasitic capacity of the gate terminal Gm and the power supply line resistance Rm. Thus, for example, a reset period t5 (from the time point u to the time point y in FIG. 7) until the potential of the memory signal ϕm is set at "L" again after setting at "H" may be set to be long so that the potential of the gate terminal Gm becomes lower.

A driving method in the first exemplary embodiment is a so-called dynamic driving. While the potential (electric charge) of the gate terminal Gm of the memory thyristor M is not lower than the predetermined voltage, the refresh is repeated. By this operation, the memory thyristor M that has been turned on is continued to be memorized.

Note that, since the threshold voltage of the memory thyristor M that is not turned on is maintained at −3.9 V or −4.6 V as described above, the memory thyristor M is kept in the OFF state.

The cathode terminals of the memory thyristors M are connected, through the respective resistances Rn, to the memory signal line 74 supplying with the memory signal ϕm. Although the cathode terminal of the memory thyristor M being in the ON state has the potential obtained by subtracting the diffusion potential Vd (1.3V) from the anode terminal (0 V), the memory signal line 74 is maintained at the potential of the memory signal ϕm by use of the resistance Rn. Thereby, the plural memory thyristors M may be caused to go into the ON state at the same time.

Note that, in the circuit in FIG. 4, the light-up signal ϕI may be driven with a current. In addition, in order to suppress the variation of the light emission amounts of the light-emitting points (light-emitting thyristors L), the value of the current to be supplied may be caused to be changed in accordance with the number of the light-emitting points (light-emitting thyristors L) caused to light up at the same time. In the above description, it has been described that the light-up signal ϕI is supplied by driving with a current, and the current according to the number of the light-emitting thyristors L is supplied when the plural light-emitting thyristors L are caused to light up in the one lighting period t4.

In contrast, when the light-up signal ϕI is driven at a predetermined voltage (driven with voltage), the current flowing into the light-emitting thyristor L that is lighting up (emitting light) becomes constant. In this case, in order to cause plural light-emitting thyristors L to light up in one lighting period, it is only necessary to provide a resistance between the light-up signal line 75 and each of the cathode terminals of the light-emitting thyristors L, like the resistance Rn provided between the memory signal line 74 and each of the memory thyristors M. If not, the potential of the light-up signal line 75 is caused to become the potential (−1.3 V) obtained by subtracting the diffusion potential Vd from the potential of the anode terminal by the one light-emitting thyristor L being in the ON state, and accordingly, the other light-emitting thyristors L are not turned on any longer, and do not light up.

If the light-up signal ϕI is driven with a current, it is acceptable that the resistance is not provided between the light-up signal line 75 and each of the cathode terminals of the light-emitting thyristors L. In this case, the current I flowing into the light-emitting chip C is defined as $I=(V-Vd)/R$, by using the potential V of the power supply, the diffusion potential Vd and an external resistance R. Accordingly, the current flowing into each of the plural light-emitting thyristors L, which are lighting up (emitting light) at the same time in the one lighting period t4, has a value obtained by dividing I by the number of the light-emitting thyristors L that are lighting up (emitting light). Thus, the current flowing into each of the light-emitting thyristors L is different depending on the number of the light-emitting thyristors L that is lighting up (emitting light) at the same time in one lighting period, and accordingly, the light intensity of each of the light-emitting thyristors L is different. To avoid this, the current value to be supplied may be changed in accordance with the number of the light-emitting thyristors L that are caused to light up.

The number of the light-emitting thyristors L caused to light up at the same time in the one lighting period t4 is found out by using the image dataset given to the light-emitting chip C, and thus the current value may be set in accordance with the number of the light-emitting thyristors L to light up at the same time.

A description will be given of the current flowing into the memory thyristors M by use of FIG. 7. Note that, the light-up control period T(#A) from the time point c to the time point y is described here.

As mentioned above, the memory thyristor M1 is turned on by changing the potential of the memory signal ϕm from "H" to "L" at the time point c. Then, at the time point d, the memory thyristor M1 is turned off by changing the potential of the memory signal ϕm from "L" to "H." In other words, the memory thyristor M1 goes into the ON state in the period t2 when the potential of the memory signal ϕm is "L", which is the period from the time point c to the time point d, and the on current Jo flows thereinto. The memory thyristor M1 is turned on again at the time point g, and is turned off at the time point h. Also during the period, the on current Jo flows thereinto. The same operation is repeated in the period from the time point k to the time point 1. The memory thyristor M1 is turned on by changing the potential of the memory signal ϕm from "H" to "S" at the time point m, and then is turned off by changing the potential of the memory signal ϕm from "S" to "H" at the time point n. During the period, the holding current Js, which is smaller than the on current Jo, flows thereinto since the potential of the cathode terminal thereof is "S." Similarly, during the time periods t2 from the respective time points o, p, q and r, the on current Jo, the holding current Js, the holding current Js and the on current Jo flow thereinto, respectively. Accordingly, the period from the time point c to the time point s includes 5 periods when the on current Jo flows thereinto, and 3 periods when the holding current Js flows thereinto.

Similarly, as to the memory thyristor M2, the period from the time point c to the time point s includes 4 periods when the on current Jo flows into the memory thyristor M2, and 3 periods when the holding current Js flows thereinto.

Similarly, as to the memory thyristor M3, the period from the time point c to the time point s includes 3 periods when the on current Jo flows into the memory thyristor M3, and 3 periods when the holding current Js flows thereinto.

Similarly, as to the memory thyristor M5, the period from the time point c to the time point s includes 2 periods when the on current Jo flows into the memory thyristor M5, and 2 periods when the holding current Js flows thereinto.

As to the memory thyristor M8, the period from the time point c to the time point s includes 1 period when the on current Jo flows into the memory thyristor M8.

On the other hand, as to the memory thyristors M4, M6 and M7, during the period from the time point c to the time point s, neither the on current Jo nor the holding current Js flow thereinto.

Accordingly, as to the memory thyristors M1 to M8, there are 15 periods when the on current Jo flows thereinto and 11 periods when the holding current Js flows thereinto.

Note that, in the light-up control period T(#A), the period, when the holding current Js flows therein, from the time point s to the time point u is ignored.

It is assumed that "L" is set at −3.3 V, "S" is set at −2.5 V, the period t1 (same as the writing period T(M1)) is set at 100 nsec, and the period t2 is set at 10 nsec. In addition, the resistance Rn connected to the each of the cathode terminals of the memory thyristors M is set at 1 kΩ. The potential of the cathode terminal of the memory thyristor M being in the ON state is −1.3 V obtained by subtracting the diffusion potential Vd (1.3 V) from the potential of the anode terminal ("H" (0 V)).

Therefore, during the period when the on current Jo flows thereinto, the voltage of −2 V (=(−3.3 V)−(−1.3 V)) is applied to both sides of the resistance Rn. Thus, the on current Jo becomes 2 mA (=2 V/1 kΩ).

Meanwhile, during the period when the holding current Js flows thereinto, the voltage of −1.2 V (=(−2.5 V)−(−1.3 V)) is applied to the both sides of the resistance Rn. Thus, the holding current Js becomes 1.2 mA (=1.2 V/1 kΩ).

Accordingly, the energy consumed by the memory thyristor M and the resistance Rn in the period from the time point c to the time point s is calculated to be 1.32 nJ (=15 times*10 nsec*2 mA*3.3 V+11 times*10 nsec*1.2 mA*2.5 V).

The period from the time point c to the time point s is 710 nsec. If a light emission duty (a ratio of the light emission period t4 to the light-up control signal T(#A)) is set at 50%, the light-up control period T(#A) is set at 1420 nsec.

Thereby, the energy consumed by the memory thyristor M and the resistance Rn during the above period from the time point c to the time point y becomes average power consumption of 0.93 mW.

By returning to the light-emitting portion 63, the operation will be further considered. As described above, the light-emitting chips C2 to C60 of the light-emitting portion 63 are operated in parallel with the light-emitting chip C1, as mentioned above. In the light-up control period T(#A) for the light-up control of the light-emitting thyristors L1 to L8 of the light-emitting chip C1, the light-emitting thyristors L1 to L8 of each of the other light-emitting chips C2 to C60 are light-controlled in parallel.

Similarly, in the light-up control period T(#B) for the light-up control of the light-emitting thyristors L9 to L16 of the light-emitting chip C1, the light-emitting thyristors L9 to L16 of each of the other light-emitting chips C2 to C60 of the light-emitting portion 63 are light-controlled in parallel. In the other light-up control periods T(#C) . . . , the same light-up control is performed.

The lighting period t4 of the light-emitting thyristors L is determined by a period when the potential of the light-up signal ϕI is set at "Le" (from the time point t to the time point x in FIG. 7). In the first exemplary embodiment, each of the light-up signals ϕI (ϕI1 to ϕI30) is supplied to the corresponding two of the light-emitting chips C. Thus, in the light-emitting chips C to which the one light-up signal ϕI is supplied (for example, the light-emitting chips C1 and C2 to which the light-up signal ϕI1 in FIG. 4 is supplied), the lighting periods t4 thereof are the same as each other. However, since different lighting periods t4 may be set for the respective groups (for example, for the groups #A and #B), the variation of the light intensity may be corrected for each of the groups of the light-emitting chips C.

Alternatively, the variation of the light intensity between the light-emitting chips C may be corrected by setting the lighting period t4 for each of the light-up signal ϕI.

Note that, it has been described that the light-emitting thyristors L1, L2, L3, L5 and L8 are caused to light up (emit light) and the light-emitting thyristor L4, L6 and L7 are not caused to light up (are put out) in the light-up control period T(#A). As mentioned above, when the light-emitting thyristor L is caused to light up, it is only necessary that the potential of the memory signal ϕm be set at "L." Meanwhile, when the light-emitting thyristor L is caused not to light up, it is only necessary that the potential of the memory signal ϕm be set at "S." Since the memory signals ϕm are supplied to the individual light-emitting chips C as shown in FIG. 4, whether the light-emitting thyristors L are caused to light up (emit light) or not is controllable on the basis of the image dataset.

Figure 8:
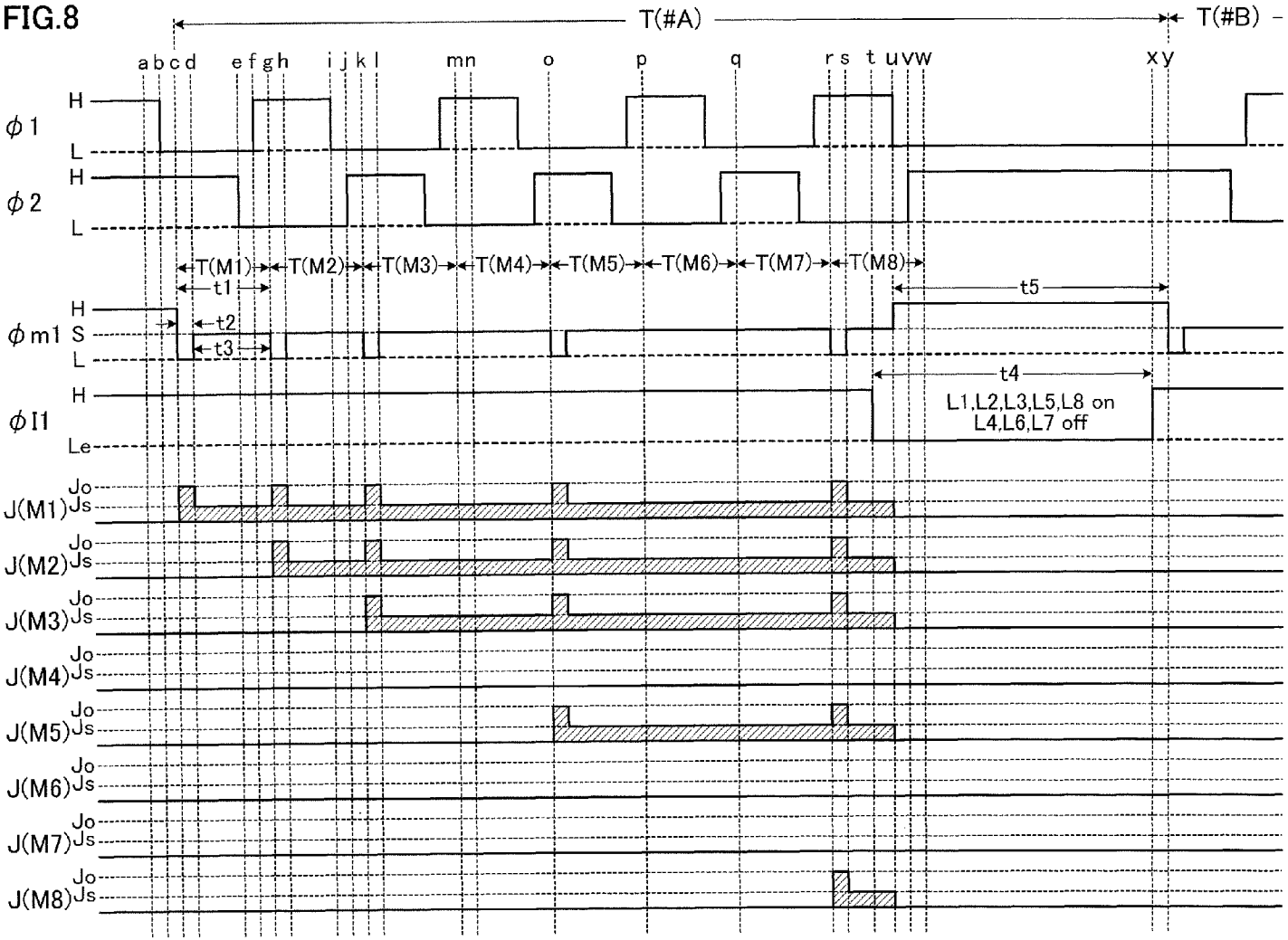
FIG. 8 is a timing chart for explaining the operation of the light-emitting chip in a case where the first exemplary embodiment is not applied thereto.

FIG. 8 is a timing chart for explaining the operation of the light-emitting chip C1 (C) in a case where the first exemplary embodiment is not applied. The operation is the same as the case where the first exemplary embodiment is applied, which is shown in FIG. 7, except the following description. In other words, the configuration of the signal generating circuit 100 in the light-emitting device 65 and the wiring configuration between the signal generating circuit 100 and each of the light-emitting chips C (C1 to C60) are the same as those shown in FIG. 4. In addition, the circuit configuration of the light-emitting chip C is the same as that shown in FIG. 5. In the light-up control period T(#A), it is assumed that the image dataset "11101001" is printed.

The difference between FIG. 8 and the case where the first exemplary embodiment (FIG. 7) is a waveform of the memory signal ϕm1 (ϕm) in the period from the time point c to the time point r. The driving method here is not the dynamic driving but static driving.

In the case where the first exemplary embodiment is applied (FIG. 7), the memory in which the memory thyristor M has been turned on is prevented from being lost by causing the potential of the memory signal ϕm to be set at "L" or "S" in order to turn on the memory thyristor M that has been turned off after being turned on, before the potential of the gate terminal Gm of the memory thyristor M get lower than the predetermined value.

On the other hand, in the case where the first present exemplary embodiment is not applied, the memory thyristor M that has been turned on is not turned off, and is kept in the ON state.

A description will be given of the waveform of the memory signal ϕm1 (ϕm).

The potential of the memory signal ϕm1 (ϕm) is changed from "H" to "L" at the starting time point c of the writing period T(M1), and is changed from "L" to "S" at the time point d. Then, the potential thereof is maintained at "S" until the time point g which is the finish time point of the writing period T(M1). At the time point g, which is also the starting time point of the writing period T(M2), the potential thereof is changed from "S" to "L", and then is changed from "L" to "S" at the time point h. The potential thereof is maintained at "S" until the time point k which is the finish time of the writing period T(M2). That is, the waveform in the writing period T(M2) repeats the waveform in the writing period T(M1). Then, also in the subsequent writing period T(M3), the same waveform is repeated.

However, the potential of the memory signal ϕm1 (ϕm) is maintained at "S" at the time point m which is the starting time point of the writing period T(M4), and is changed from "S" to "L" at the time point o which is the starting time of the writing period T(M5). The waveform of the memory signal ϕm1 (ϕm) in the writing period T(M5) repeats the waveform in the writing period T(M1). The waveform of the memory signal ϕm1 (ϕm) in the writing periods T(M6) and T(M7) repeats the waveform in the writing period T(M4). Further, the waveform of the memory signal ϕm1 (ϕm) in the writing period T(M8) is the same as that in the writing period T(M8) in the present exemplary embodiment.

Next, a description will be given of the operation of the memory thyristors M.

Immediately after the time point b in FIG. 8, the transfer thyristor T1 is in the ON state, and the threshold voltage of the memory thyristor M1 is −2.6 V. When the potential of the memory signal ϕm1 (ϕm) is changed from "H" (0 V) to "L" (−3.3 V) at the time point c, the memory thyristor M1 having the threshold voltage of −2.6 V is turned on.

Then, at the time point d, the potential of the memory signal ϕm1 (ϕm) is changed from "L" to "S." The potential of the cathode terminal of the memory thyristor M1 being in the ON state is −1.3 V obtained by subtracting the diffusion potential Vd (1.3 V) from the potential of the anode terminal ("H" (0 V)). Thus, the ON state of the memory thyristor M1 is maintained by use of "S" of −2.5 V. In other words, at the time point d, the memory thyristor M1 is not turned off, but is kept in the ON state.

Accordingly, as shown in the current J(M1), the on current Jo flows into the memory thyristor M1 from the time point c to the time point d, and the holding current Js flows thereinto from the time point d to the time point f.

Similarly, when the potential of the memory signal ϕm1 (ϕm) is changed from "H" (0 V) to "L" (−3.3 V) at the time point g, the memory thyristor M2 is turned on. Meanwhile, since the memory thyristor M1 is kept in the ON state, the current flowing thereinto is changed from the holding current Js to the on current Jo. Into the memory thyristor M1, the on current Jo flows from the time point g to the time point h, and the holding current Js flows from the time point h to the time point k. Meanwhile, as shown in the current J(M2), also into the memory thyristor M2, the on current Jo flows from the time point g to the time point h, and the holding current Js flows from the time point h to the time point k.

The writing period T(M3) is a repeat of the writing period T(M1), and the memory thyristor M3 is newly turned on. At the finish time point m of the writing period T(M3), the memory thyristors M1, M2 and M3 are kept in the ON state.

At the starting time point m of the writing period T(M4), the potential of the memory signal ϕm1 (ϕm) is maintained at "S". Thus, in the writing period T(M3), the memory thyristor M4 having the threshold voltage of −2.6 V may not be turned on. Accordingly, at the time point m, the memory thyristors M1, M2 and M3 are kept in the ON state.

At the writing period T(M5), since the potential of the memory signal ϕm1 (ϕm) is changed from "H" to "L," the memory thyristor M5 is turned on. However, in the writing periods T(M6) and T(M7), since the potential of the memory signal ϕm1 (ϕm) is maintained at "S," the memory thyristors M6 and M7 may not be turned on. Thereafter, at the starting time point r of the writing period T(M8), since the potential of the memory signal ϕm1 (ϕm) is changed from "H" to "L," the memory thyristor M8 is turned on.

Although the detailed description thereof will be omitted, the current flows into the memory thyristors M1 to M8 as shown in the currents J(M1) to J(M8) in the writing periods T(M3) to T(M7).

The operation from the time point r to the time point y is the same as that having been described in the case where the first exemplary embodiment is applied (FIG. 7). In other words, when the potential of the light-up signal ϕI1 (ϕi) is changed from "H" to "Le" at the time point t, the light-emitting thyristors L each having the same number as each of the memory thyristors M being in the ON state (here, the light-emitting thyristors L1, L2, L3, L5 and L8) are turned on and light up (emit light).

As described above, in the case where the first exemplary embodiment is not applied, the memory thyristors M that have been turned on are kept in the ON state, and the potentials of the gate terminals Gm thereof are maintained at "H" (0 V). Accordingly, it is not necessary to change the potential of the memory signal ϕm1 (ϕm) to "L" or "S" before the potential of the gate terminal Gm becomes the predetermined potential unlike in the first exemplary embodiment. In other words, in FIG. 8, the length of the period t3 from the time point d to the time point g is not limited.

However, in the case where the first exemplary embodiment is not applied (FIG. 8), the power consumption of the memory thyristors M increases. For example, during the period from the time point d to the time point g in the writing period T(M1), the holding current Js flows thereinto. There are 21 periods when the holding current Js flows thereinto. Accordingly, the energy consumed by the memory thyristors M and the resistances Rn during the period from the time point c to the time point s has a value (6.99 nJ) obtained by adding 5.67 nJ (=21 times*90 nsec*1.2 mA*2.5 V) to the value 1.32 nJ described in FIG. 7. Thus, the average power consumption of 4.92 mW is obtained by dividing this value by 1420 nsec that is the period from the time point c to the time point y.

Therefore, the average power consumption (0.93 mW) in the first exemplary embodiment described in FIG. 7 is one fifth of that (4.92 mW) in the case where the first exemplary embodiment is not applied, which is shown in FIG. 8.

It is assumed that the current in the case where the light-emitting thyristor L is lighting up (emitting light) is 10 mA. In this state, the current in the case where the 5 light-emitting thyristors L1, L2, L3, L5 and L8 light up as shown in FIGS. 7 and 8 becomes 50 mA. It is also assumed that the lighting period t4 from the time point t to the time point x in FIGS. 7 and 8 has the light emission duty of 50%, and the potential applied to the light-emitting thyristor L is −2 V. In this state, the power consumption of the 5 light-emitting thyristors L being in the ON state becomes 50 mW (=0.5*5 light-emitting thyristors*10 mA*2 V).

The power consumption in the memory thyristors M in the case where the first exemplary embodiment is not applied is 10% of the power consumption of the light-emitting thyristors L.

Therefore, in the first exemplary embodiment, since the power consumption of the memory thyristors M may be reduced, the power consumption of the light-emitting chips C may be suppressed.

Note that, the above-mentioned power consumption is only one example, and it is changed depending on the number of the light-emitting thyristors L to light up and the light emission duty.

Next, a description will be given of potential change of the gate terminal Gm of the memory thyristor M after the memory thyristor M is turned off in the first exemplary embodiment.

Figure 9:
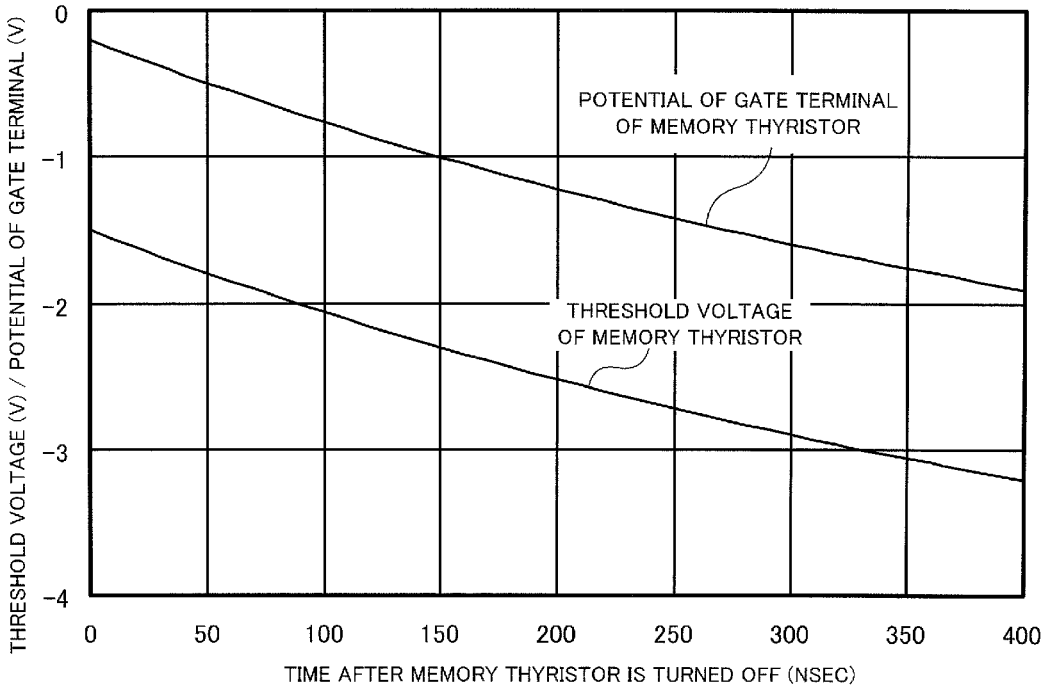
FIG. 9 is a graph showing one example of the change of the threshold voltage of the memory thyristor and the potential of the gate terminal after the memory thyristor is turned off.

FIG. 9 is a graph showing one example of the change of the threshold voltage of the memory thyristor M and the potential of the gate terminal Gm after the memory thyristor M is turned off. The horizontal axis indicates the time after the memory thyristor M is turned off (nsec), and the vertical axis indicates the potential (V) of the gate terminal Gm and the threshold voltage (V) of the memory thyristor M. Although, in the above description, the potential of the gate terminal Gm of the memory thyristor M being in the ON state is assumed to be 0 V, it is set at −0.2 V which is the actual value, here (the potential of the gate terminal at 0 nsec after the memory thyristor M is turned off).

Here, it is assumed that the parasitic capacity of the gate terminal Gm is 25 pF, and the power supply line resistance Rm is 20 kΩ. Accordingly, the potential of the gate terminal Gm of the memory thyristor M is decreased in accordance with the time constant 500 nsec (=25 pF*20 kΩ).

The potential of the gate terminal Gm of the memory thyristor M decreases from −0.2 V toward the power supply potential Vga (−3.3 V) in response to elapsed time after the memory thyristor M is turned off. The threshold voltage of the memory thyristor M has a value obtained by subtracting the diffusion potential Vd (1.3 V) from the potential of the gate terminal Gm, and thus it decreases from −1.5 V toward −4.6 V.

It is at 200 nsec after the memory thyristor M is turned off that the potential of the gate terminal Gm decreases to −1.2 V, that is, the threshold voltage of the memory thyristor M decreases to −2.5 V, with reference to FIG. 9.

Accordingly, in the first exemplary embodiment shown in FIG. 7, it is only necessary to set the period t3 (for example, the period from the time point d to the time point g, from the time point 1 to the time point m or the like in FIG. 7) within 200 nsec in order to turn on the memory thyristor M that has been turned off after being turned on, again. If the period t3 exceeds 200 nsec, the memory thyristor M is not turned on any longer with the potential "S" (−2.5 V) of the memory signal ϕm1 (ϕm) since the threshold voltage is lower than −2.5 V, and thus the memory in which the memory thyristor M has been turned on is lost from the memory thyristor M.

Note that, the values shown in FIG. 9 is one example, and the permissible length of the period t3 varies depending on the values of the parasitic capacity of the gate terminal Gm of the memory thyristor M and the power supply line resistance Rm. For example, if the power supply line resistance Rm is caused to be large, the time constant becomes large, and thus the time for decrease of the potential of the gate terminal Gm to −1.2 V becomes longer than 200 nsec. On the contrary, if the power supply line resistance Rm is caused to be small, the time constant becomes small, and thus the time for decrease of the potential of the gate terminal Gm to −1.2 V becomes shorter than 200 nsec. Similarly, the length varies by the parasitic capacity of the gate terminal Gm.

Thus, the time constant is adjustable by using the values of the parasitic capacity of the gate terminal Gm of the memory thyristor M and the power supply line resistance Rm.

Second Exemplary Embodiment

Figure 10:
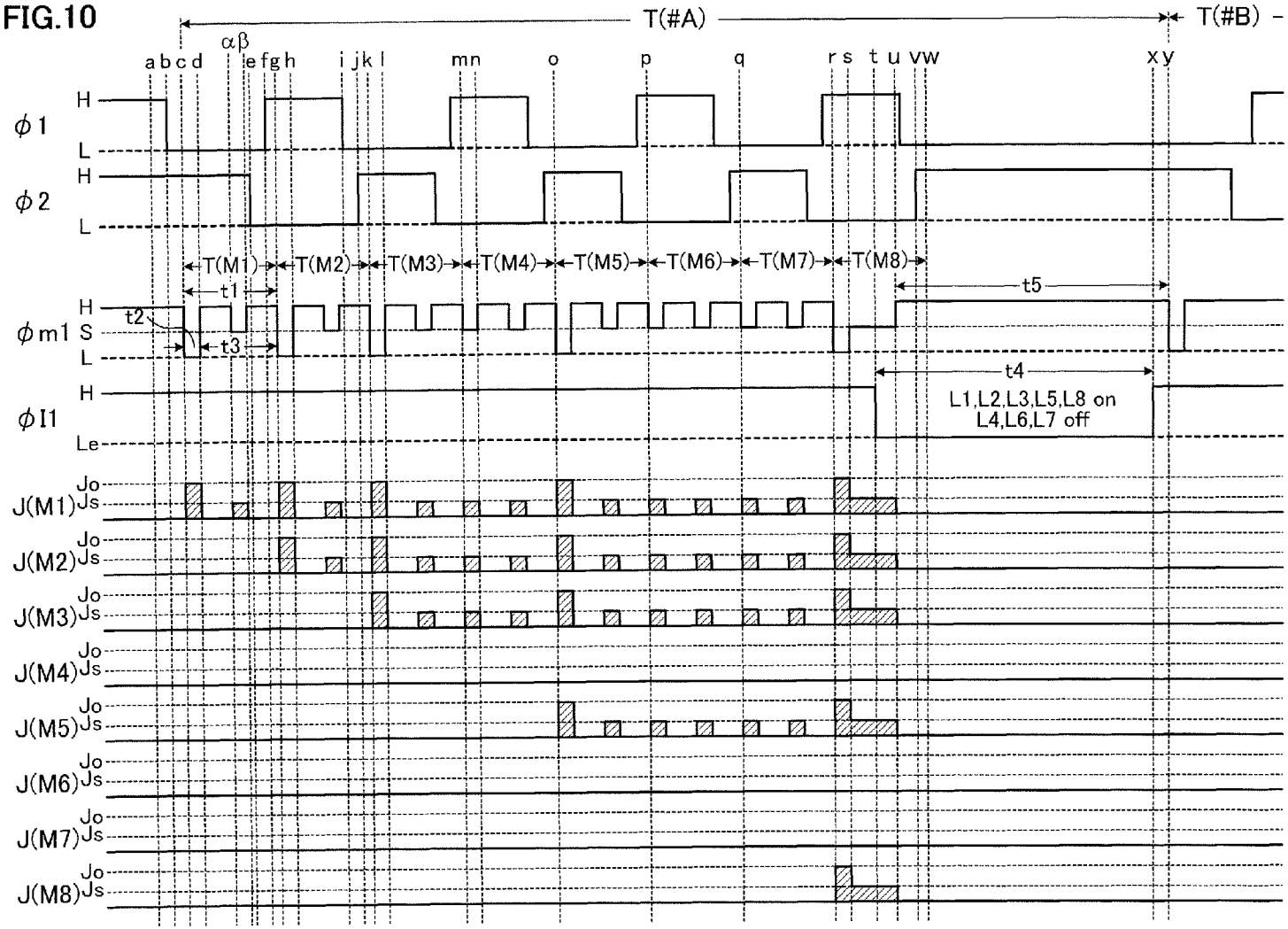
FIG. 10 is a timing chart for explaining the operation of the light-emitting chip in the second exemplary embodiment.

FIG. 10 is a timing chart for explaining the operation of the light-emitting chip C1 (C) in the second exemplary embodiment.

In the second exemplary embodiment, the configuration of the signal generating circuit 100 and the wiring configuration between the signal generating circuit 100 and each of the light-emitting chips C (C1 to C60) in the light-emitting device 65 are the same as those in the first exemplary embodiment shown in FIG. 4. The circuit configuration of the light-emitting chip C is the same as that in the first exemplary embodiment shown in FIG. 5.

In the first exemplary embodiment, before the potential of the gate terminal Gm of the memory thyristor M that has been turned off after being turned on is lower than the predetermined potential, the signal "L" or "S" (memory signal ϕm) for writing a next bit of the image dataset is supplied.

However, the period t3 until the memory thyristor M is turned on again after the memory thyristor M that has been turned on is turned off is 200 nsec as an example, as mentioned above. The period t3 is determined by the parasitic capacity of the gate terminal Gm and the power supply line resistance Rm, and thus the changeable range thereof is limited.

In the starting time point of the light-up control period T(#B) (time point y in FIGS. 7 and 10), the memory in which the memory thyristor M has been turned on should be reset in each memory thyristor M for the light-up control period T(#A). In order to reset the memory, the potential of the gate terminal Gm is required to be lower than −2V at a reset period t5 from the time point u when the potential of the memory signal φm1 (φm) is lastly changed from "S" to "H" in the light-up control period T(#A) to the time point y when the potential of the memory signal φm1 (φm) is firstly changed from "H" to "L" or "S" in the light-up control period T(#B). In the example shown in FIG. 9, in order to make the potential of the gate terminal Gm lower than −2 V, not less than 400 nsec after turning off the memory thyristor M is required. Thus, the reset period t5 may be too long in some cases.

Meanwhile, if the time constant is set to be short by adjusting at least any one of the parasitic capacity of the gate terminal Gm of the memory thyristor M and the power supply line resistance Rm, the period t4 may be shorter. However, the period t3 is also shorter.

To avoid this, in the second exemplary embodiment, a period in which the potential of the memory signal φm becomes "S" is newly added in order to refresh the memory in which the memory thyristor M has been turned on, within the writing period T(M) of the memory signal φm when the image dataset is written in the memory thyristor M. Thereby, the period t3 may be set to be longer than the period determined by the time constant defined by the parasitic capacity of the gate terminal Gm of the memory thyristor M and the power supply line resistance Rm.

In FIG. 10, the period when the potential of the memory signal φm1 (φm) is newly set at "S" is added in the writing period T(M) in FIG. 7 in the first exemplary embodiment. In other words, the potential of the memory signal φm1 (φm) is changed from "H" to "S" at a time point α after the time point d and before the time point e in the writing period T(M1), and is changed from "S" to "H" at a time point β after the time point α and before the time point e.

The operation of the light-emitting chip C1 (C) at the time point α is the same as the operation at the time point m in FIG. 7 in the first exemplary embodiment that has been described. Specifically, the memory thyristor M1 that is turned on at the time point c and turned off at the time point d has the threshold voltage of not less than −2.5 V if the potential of the gate terminal Gm1 thereof is not less than −1.2 V at the time point α. Accordingly, by changing the potential of the memory signal φm1 (φm) from "H" (0 V) to "S" (−2.5 V) at the time point α, the memory thyristor M1 is turned on again. Similarly, the memory thyristor M1 that has been turned off at the time point β has the threshold voltage of not less than −2.5 V at the time point g if the potential of the gate terminal Gm1 is not less than −1.2 V. Thus, by changing the potential of the memory signal φm1 (φm) from "H" (0 V) to "L" (−3.3 V) at the time point g, the memory thyristor M1 is turned on again.

In the other writing periods T(M2) to T(M7), the same is true. As for these periods T(M2) to T(M7), the detailed description will be omitted. Note that, in the writing period T(M8), the operation is the same as that in the first exemplary embodiment.

As described above, in the second exemplary embodiment, in the middle of the writing period T(M) (for example, the period from the time point α to the time point β in the writing period T(M1)), the period in which the potential of the memory signal φm1 (φm) is set at "S" is provided. This is because the memory in which the memory thyristor M has been turned on is refreshed, as mentioned above. Note that, the potential of the memory signal φm1 (φm) is set at "S" not "L" in order to prevent the new memory thyristor M from being turned on.

In addition, in the second exemplary embodiment, although one period when the potential is set at "S" in order to refresh the memory is provided in the middle of the writing period T(M), plural periods may be provided therein. It is only necessary to provide the periods when the potential is set at "S" for the refresh, in order to turn on the memory thyristor M having been turned off after being turned on, again. Thereby, the length of the period t3 and the reset period t5 are individually settable.

Third Exemplary Embodiment

Figure 11:
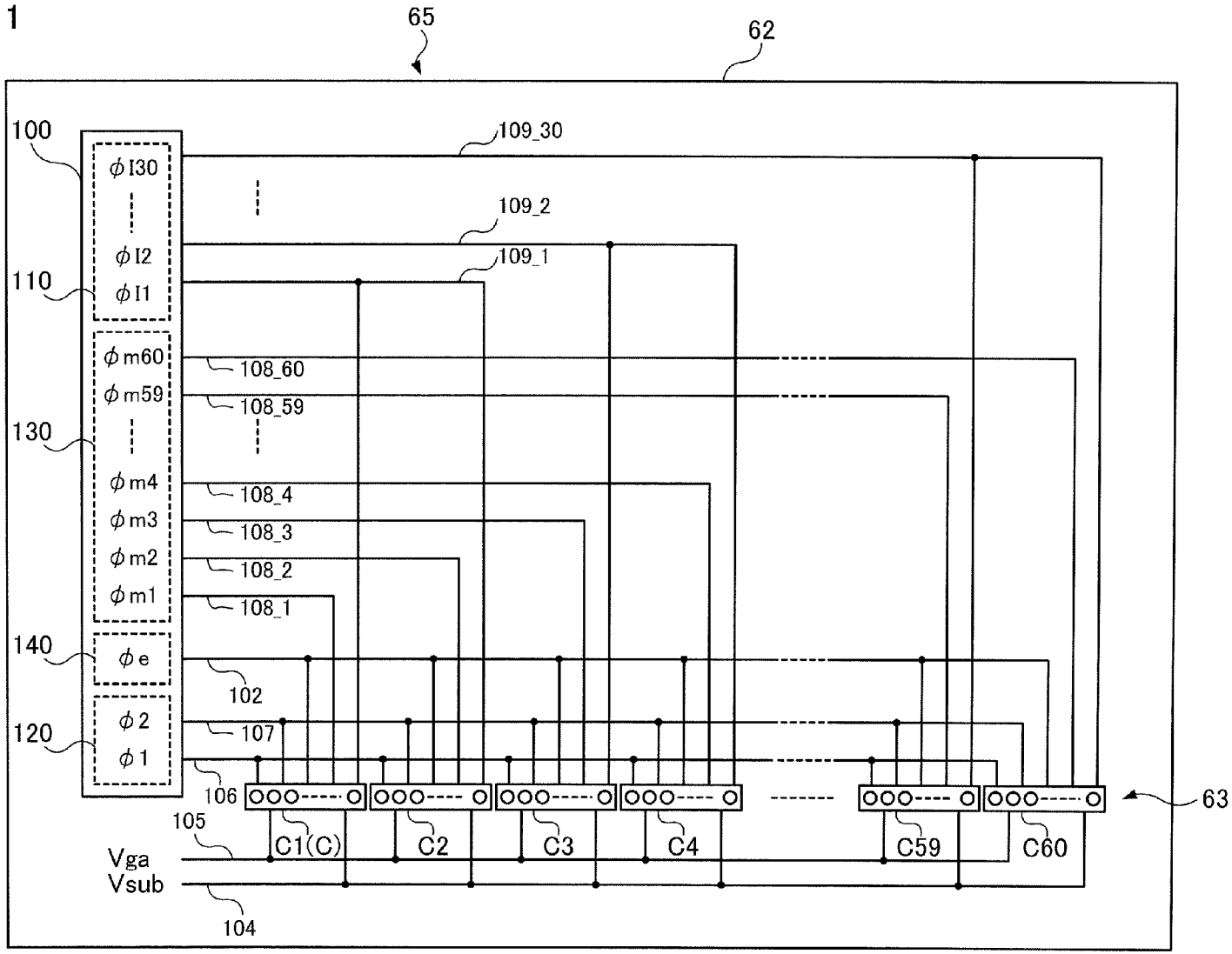
FIG. 11 is a diagram showing a configuration of the signal generating circuit and a wiring configuration between the signal generating circuit and each of the light-emitting chips in the light-emitting device in the third exemplary embodiment.

FIG. 11 is a diagram showing a configuration of the signal generating circuit 100 and a wiring configuration between the signal generating circuit 100 and each of the light-emitting chips C (C1 to C60) in the light-emitting device 65 in the third exemplary embodiment.

A difference between the third exemplary embodiment and the first exemplary embodiment shown in FIG. 4 is a newly-provided elimination signal generating unit 140 in the third exemplary embodiment. The elimination signal generating unit 140 is used for the signal generating circuit 100 to transmit, to the light-emitting chips C (C1 to C60), an elimination signal φe for eliminating the electric charge accumulated in the parasitic capacity of each of the gate terminals Gm.

On the circuit board 62, an elimination signal line 102 is newly provided in addition to the configuration of the first exemplary embodiment shown in FIG. 4. The elimination signal line 102 transmits the elimination signal φe from the elimination signal generating unit 140 of the signal generating circuit 100 to the light-emitting portion 63. The elimination signal line 102 is connected to φe terminals (see FIG. 12 to be described later) of the light-emitting chips C (C1 to C60) in parallel.

The other configuration is the same as that in the first exemplary embodiment shown in FIG. 4. Thus, in the third exemplary embodiment, the same reference numerals are given to the same components as those in the first exemplary embodiment, and the detailed description thereof will be omitted.

In the first exemplary embodiment, the potential of the gate terminal Gm of the memory thyristor M that has been turned off after being turned on changes from 0 V to −3.3 V after the memory thyristor M is turned off. The rate of this change is determined by the time constant defined by the parasitic capacity of the gate terminal Gm of the memory thyristor M and the power supply line resistance Rm. Thus, the reset period t5 for resetting the memory of the memory thyristor M, in which the memory thyristor M has been turned on, is not allowed to be set independently of the period t3. In the third exemplary embodiment, the reset period t5 is set to be short by forcibly setting the potential of the gate terminal Gm with the elimination signal φe.

In the third exemplary embodiment, the reference potential Vsub, the power supply potential Vga, the first transfer signal φ1, the second transfer signal φ2 and the elimination signal φe are sharably transmitted to all of the light-emitting chips C (C1 to C60). The memory signals φm (φm1 to φm60) are individually transmitted to the light-emitting chips C (C1 to C60) on the basis of the image dataset. Each of the light-up signals φI (φI1 to φI60) is transmitted to the corresponding two of the light emitting chips C (C1 to C60).

Figure 12:
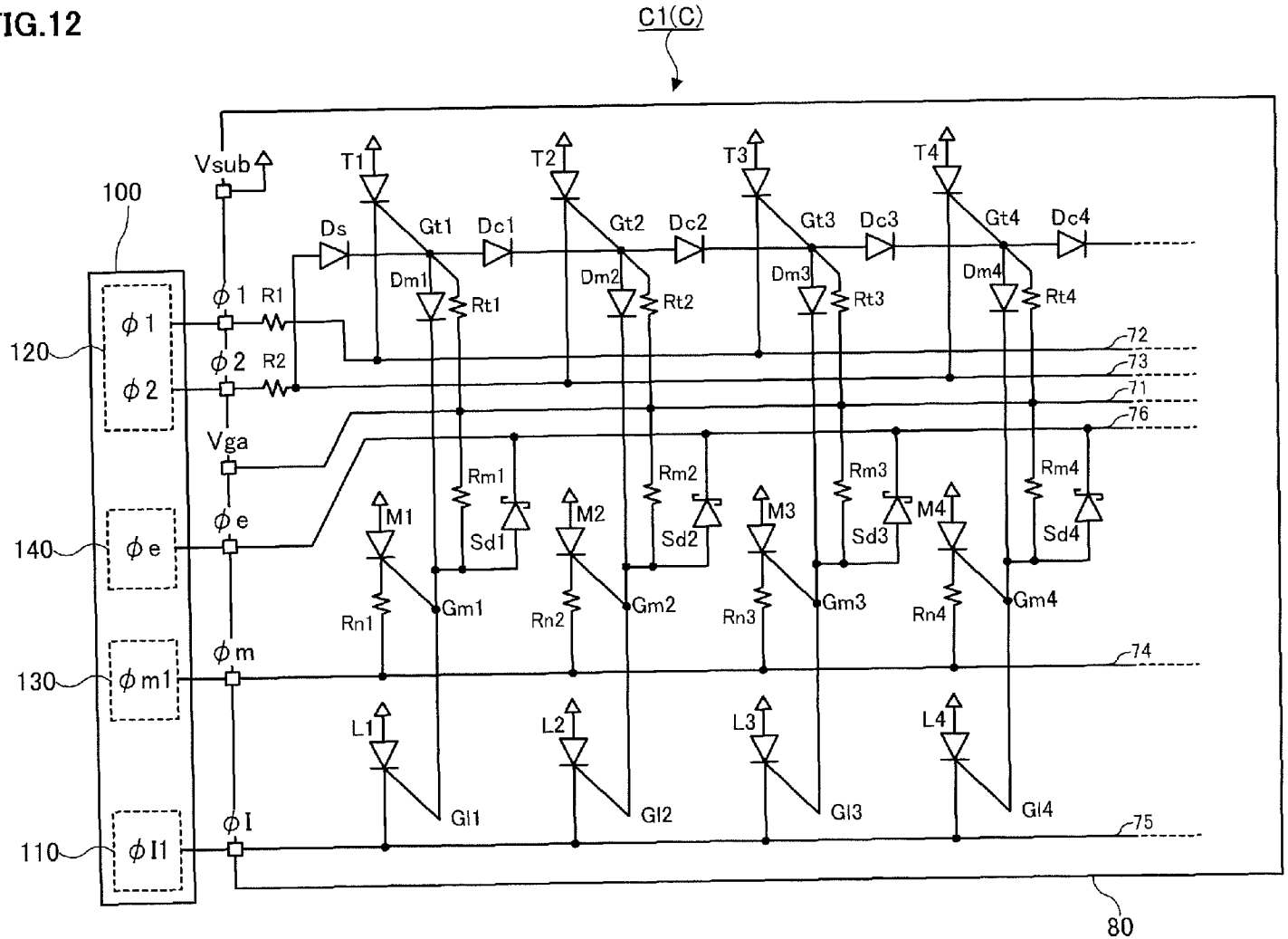
FIG. 12 is a diagram for explaining the circuit configuration of the light-emitting chips in the third exemplary embodiment.

FIG. 12 is a diagram for explaining the circuit configuration of the light-emitting chips C (C1 to C60), which are self-scanning light-emitting element array (SLED) chip, in the third exemplary embodiment. Here, a description will be given by taking the light-emitting chip C1 as an example. However, the other light-emitting chips C2 to C60 have the same configuration as the light-emitting chip C1. Note that, in FIG. 12, a portion including the transfer thyristors T1 to T4, the memory thyristors M1 to M4 and the light-emitting thyristors L1 to L4 is mainly shown.

A difference between the third exemplary embodiment and the first exemplary embodiment shown in FIG. 5 is newly-provided elimination diodes Sd1, Sd2, Sd3 . . . as an example of elimination elements.

The light-emitting chip C1 (C) includes the elimination diodes Sd1, Sd2, Sd3 . . . arrayed in line on the substrates 80. The elimination diodes Sd1, Sd2, Sd3 . . . may be schottky diodes. If the elimination diodes Sd1, Sd2, Sd3 . . . are not distinguished, they are called elimination diodes Sd.

Next, a description will be given of the electric connection of the elimination diodes Sd in the light-emitting chip C1 (C).

Each of the anode terminals of the elimination diodes Sd1, Sd2, Sd3 . . . is connected to corresponding one of the gate terminals Gm1, Gm2, Gm3 . . . of the memory thyristors M1, M2, M3 . . . .

The cathode terminals of the elimination diodes Sd1, Sd2, Sd3 . . . are connected to an elimination signal line 76. Further, the elimination signal line 76 is connected to a φe terminal that is an input terminal of the elimination signal φe. To the φe terminal, the elimination signal line 102 (see FIG. 11) is connected, and the elimination signal φe is supplied thereto.

Next, a description will be given of the operation of the light-emitting portion 63 in the third exemplary embodiment. The pair of the first transfer signal φ1 and the second transfer signal φ2 and the elimination signal φe are sharably supplied to the light-emitting chips C (C1 To C60) configuring the light-emitting portion 63, as show in FIG. 11. Meanwhile, the memory signals φm (φm1 to φm60) based on the image dataset are individually supplied to the light-emitting chips C (C1 to C60). The light-up signals φI (φI1 to φI30) are respectively supplied to the corresponding pairs each formed of two of the light-emitting chips C so that each light-up signal φI is shared by the two of the light-emitting chips C configuring each pair, and are individually supplied to the light-emitting chips C configuring different pairs.

The third exemplary embodiment differs from the first exemplary embodiment only in the additionally-provided elimination diodes Sd. The operation of the light-emitting portion 63 is recognized if the operation of the light-emitting chip C1 is described, similarly to the description in the first exemplary embodiment. Accordingly, the description will be given of the operation of the light-emitting chips C by taking the light-emitting chip C1 as an example.

Figure 13:
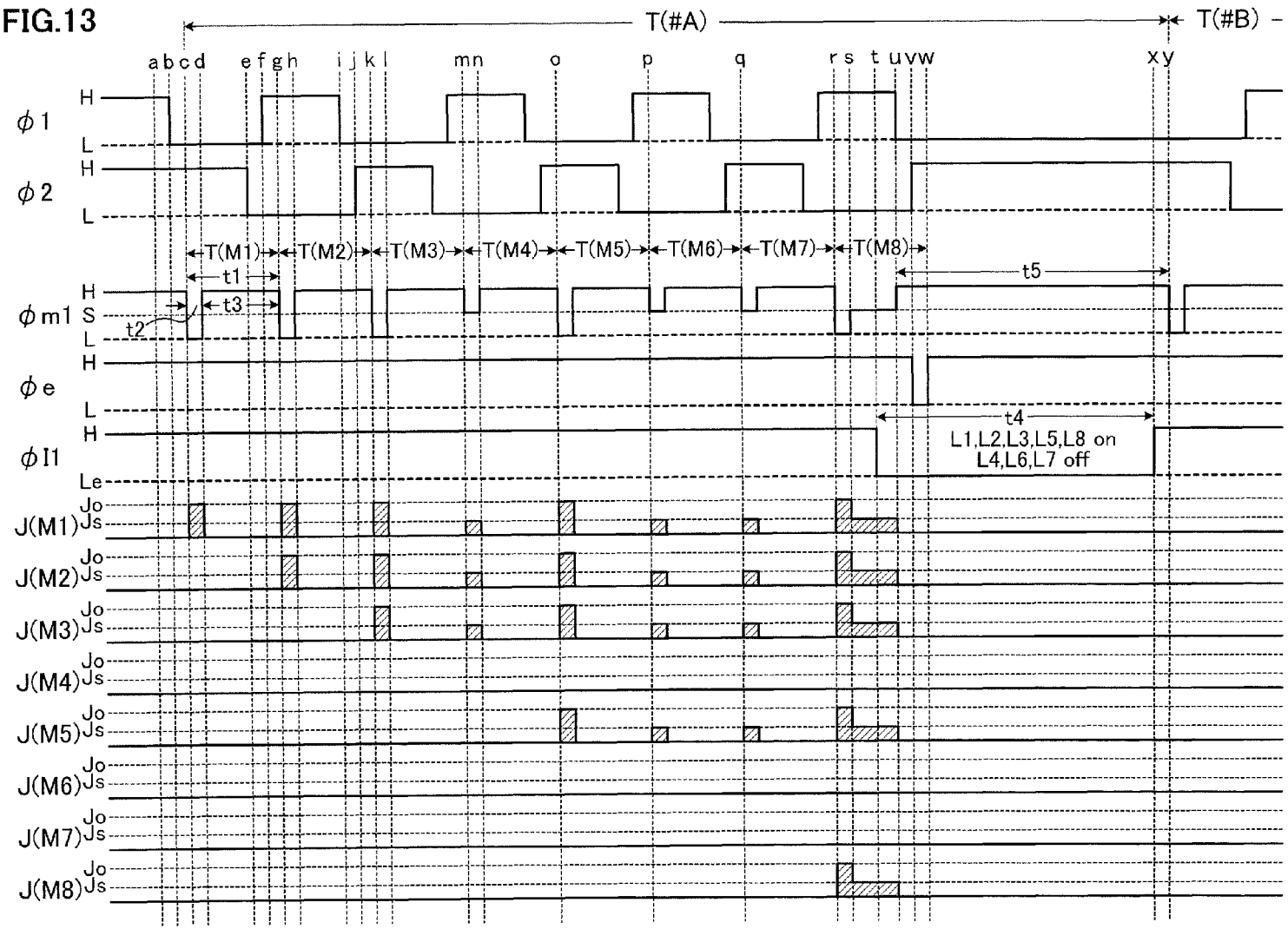
FIG. 13 is a timing chart for explaining the operation of the light-emitting chip in the third exemplary embodiment.

FIG. 13 is a timing chart for explaining the operation of the light-emitting chip C1 (C) in the third exemplary embodiment.

Also in FIG. 13, it is assumed that time elapses from the time point a to the time point y in alphabetical order. In FIG. 13, the first transfer signal φ1, the second transfer signal φ2, the memory signal φm1, the elimination signal φe, the light-up signal φI1 and the currents J(M1) to J(M8) flowing into the respective memory elements M1 to M8 are shown.

FIG. 13 shows the light-up control period T(#A) in the case where the light-up control is performed by using groups each formed of 8 light-emitting thyristors L shown in FIG. 6. Here, in the light-up control period T(#A), the light-emitting thyristors L1 to L8 in the group #A are light-controlled. Note that, the light-up control period T(#A) is followed by the light-up control period T(#B) when the light-emitting thyristors L9 to L16 in the group #B are light-controlled, the light-up control period T(#C) when the light-emitting thyristors L17 to L24 in the group #C are light-controlled . . . , although the illustration thereof is omitted.

Note that, in the light-up control period T(#A) in FIG. 13, the light-emitting thyristors L1, L2, L3, L5 and L8 among the 8 light-emitting thyristors L1 to L8 in the group #A are caused to light up (emit light), while the light-emitting thyristors L4, L6 and L7 are maintained not to light up (to be off), similarly to the first exemplary embodiment. In other words, it is assumed that the image dataset "11101001" is printed.

In FIG. 13, the waveforms of the signals other than the elimination signal φe are the same as those shown in FIG. 7. Thus, only the elimination signal φe will be described.

Here, a description will be given of a waveform of the elimination signal φe in the light-up control period T(#A).

The potential of the elimination signal φe is "H" at the starting time point c of the light-up control period T(#A), and is changed from "H" to "L" at the time point v. Then, the potential thereof is changed from "L" to "H" at the time point w. At the finish time point y of the light-up control period T(#A), the potential thereof is maintained at "H."

In other words, the elimination signal φe has the potential of "L" once in the light-up control period T(#A).

The operation of the elimination signal φe will be described.

As mentioned above, the potential of the gate terminal Gm of the memory thyristor M that has been turned off after turned on changes from 0 V toward −3.3 V. The rate of this change is determined by the time constant defined by the parasitic capacity of the gate terminal Gm and the power supply line resistance Rm. As described above, if the potential change of the gate terminal Gm is slow, it may be good since the period t3 is set to be long, but it may be bad since the reset period t5 becomes longer.

In the third exemplary embodiment, in order to control the reset period t5, the elimination signal φe, which forcibly eliminates the electric charge accumulated in the parasitic capacity of the gate terminal Gm and eliminates the memory in which the memory thyristor M has been turned on from the memory thyristor M, is provided.

A description will be given of the operation of the light-emitting portion 63 and the light-emitting chip C1 (C) in accordance with the timing chart in FIG. 13, with reference to FIG. 12.

Note that, in FIG. 12, only a portion including the transfer thyristors T, the memory thyristors M, the light-emitting thyristors L and the like each having numbers of 1 to 4 is shown. The other portion (not shown in the figure) including these thyristors and the like each having numbers not less than 5 is a repeat of the above portion. In the following description, elements not only respectively having numbers of 1 to 4 but also respectively having the other numbers may be described.

(Initial State)

At the time point a in the timing chart shown in FIG. 13, the Vsub terminal, which is provided on each of the light-emitting chips C (C1 to C60) of the light-emitting portion 63, is set at the reference potential Vsub (0 V). Meanwhile, each Vga terminal is set at the power supply potential Vga (−3.3 V) (see FIG. 11).

Further, the transfer signal generating unit 120 of the signal generating circuit 100 sets the potentials of the first transfer signal φ1 and the second transfer signal φ2 at "H," the memory signal generating unit 130 sets the potentials of the memory signals φm (φm1 to φm60) at "H", the elimination signal generating unit 140 sets the potential of the elimination signal φe at "H," and the light-up signal generating unit 110 sets the potentials of the light-up signals φI (φI1 to φI30) at "H" (see FIG. 11).

The states of the light-emitting portion 63 and the light-emitting chips C (C1 to C60) caused by the signals other than the elimination signal φe are the same as those described in the first exemplary embodiments. Hereinafter, a part related to the elimination signal φe is mainly described.

When the potential of the elimination signal φe becomes "H," the potential of the elimination signal line 102 becomes "H," and thus the elimination signal line 76 of each light-emitting chip C becomes "H" through the φe terminal of each light-emitting chip C. Since the elimination signal φe is sharably transmitted to the light-emitting chips C, the operation of the light-emitting chips C is recognized if the operation of the light-emitting chip C1 is described.

Hereinafter, the operation related to the elimination signal φe of the light-emitting chips C are mainly described by taking the light-emitting chip C1 as an example. The operation of the other light-emitting chips C2 to C60 is performed similarly to that of the light-emitting chip C1, in parallel with the light-emitting chip C1.

When the potential of the elimination signal φe becomes "H," the potentials of the cathode terminals of the elimination diodes Sd1, Sd2, Sd3 . . . become "H" (0 V).

On the other hand, as described in the first exemplary embodiment, the potential of the gate terminal Gm1 of the memory thyristor M1 becomes −2.6 V by the forward-biased start diode Ds and the connecting diode Dm1. The gate terminals Gm of the memory thyristors M each having a number not less than 2 are connected to the anode terminal of the start diode Ds set at the potential of "H" (0 V) through three or more stages of the forward-direction diodes (for example, the gate terminal Gm2 is connected thereto through the three stages of the start diode Ds, the coupling diode Dc1 and the connecting diode Dm2). Thus, the potentials of these gate terminals Gm become the power supply potential Vga (−3.3 V). The anode terminals of the elimination diodes Sd are connected to the gate terminals Gm, respectively.

Therefore, all of the elimination diodes Sd have a reverse bias. Thus, the potentials of the gate terminals Gm are not affected by the elimination signal φe.

(Start of Operation and Operating Condition)

The period from the time point b to the time point s in the light-up control period T(#A) is a period in which the image dataset is written in the memory thyristors M1 to M8. In this period, the potential of the elimination signal φe is maintained at "H." Accordingly, the potentials of the cathode terminals of the elimination diodes Sd are set at 0 V ("H"). Meanwhile, each of the potentials of the gate terminals Gm connected to the anode terminals of the elimination diodes Sd has a value between 0 V to −3.3 V. The potential of the gate terminal Gm becomes 0 V when the memory thyristor M is turned on. Meanwhile, the potential thereof becomes −3.3 V, when the memory thyristor M is kept in the OFF state without turning on. Then, the gate terminal Gm of the memory thyristor M that has been turned off after being turned on changes from 0 V toward −3.3 V, and thus the gate terminal Gm thereof has a value between 0 V to −3.3 V.

Thereby, in a period from the time point b to the time point s, the elimination diodes Sd are not forward-biased at least. Thus, the potentials of the gate terminals Gm are not affected by the elimination signal φe.

Therefore, the operation of the light-emitting chip C1 (C) in the period from the time point b to the time point s is the same as that in the first exemplary embodiment.

At the time point t, the light-emitting thyristors L1, L2, L3, L5 and L8 are caused to be turned on to light up (emit light) by changing the potential of the light-up signal φI1 (φI) from "H" to "Le," similarly to the first exemplary embodiment. Also in this state, the elimination diodes Sd are not forward-biased at least. Thus, the potentials of the gate terminals Gm are not affected by the elimination signal φe.

Then, at the time point u, the potential of the memory signal φm1 (φm) is changed from "S" to "H." Thereby, the memory thyristors M1, M2, M3, M5 and M8, which are in the ON state, are turned off, and the potentials of the gate terminals Gm1, Gm2, Gm3, Gm5 and Gm8 start to change from 0 V toward −3.3 V. Meanwhile, the potentials of the gate terminals Gm4, Gm6 and Gm7 of the memory thyristors M4, M6 and M7 kept in the OFF state are maintained at −3.3 V by the power supply potential Vga.

As described above, in the third exemplary embodiment in which "S" is set at −2.5 V and the "L" is set at "−3.3 V", it is required to make the potentials of the gate terminals Gm lower than −2 V in order to reset the memory of the memory thyristor M in which the memory thyristor M has been turned on.

At the time point v, the potential of the elimination signal φe is changed from "H" (0 V) to "L" (−3.3 V). Thereby, the cathode terminals of the elimination diodes Sd become the potentials of −3.3 V. Meanwhile, the anode terminals of the elimination diodes Sd are connected to the gate terminals Gm of the above-mentioned memory thyristors M, respectively. The potentials of the gate terminals Gm of the memory thyristors M1, M2, M3, M5 and M8 that have been turned off after being turned on start to change from 0 V toward −3.3 V at the time point u. Thus, the elimination diodes Sd1, Sd2, Sd3, Sd5 and Sd8 are forward-biased. Thereby, the potentials of the gate terminals Gm1, Gm2, Gm3, Gm5 and Gm8 become a value (−2.5 V) obtained by subtracting forward-direction potentials Vs (0.8 V) of the elimination diodes Sd from −3.3 V ("L"). In other words, by changing the potential of the elimination signal φe from "H" to "L," the potentials of the gate terminals Gm of the memory thyristors M that have been turned on are forcibly set at −2.5 V, and the potential change of the gate terminals Gm1, Gm2, Gm3, Gm5 and Gm8 are accelerated.

Since the forward-direction potential Vs (0.8 V) of the schottky diode using Al electrodes is lower than the diffusion potential Vd (1.3 V) of the p-n junction, the potentials of the gate terminals Gm of the memory thyristors M that have been turned on are settable at a lower potential. Note that, Au, Pt, Ti, Mo, W, WSi, TaSi or the like other than Al may be used for the electrodes of the schottky diode.

Note that, the potentials of the gate terminals Gm4, Gm6 and Gm7 of the memory thyristors M4, M6 and M7 do not change from −3.3 V.

At the time point v, the potential of the second transfer signal φ2 is changed from "L" to "H," and the transfer thyristor T8 is turned off. If the transfer thyristor T8 is in the ON state, the potential of the gate terminal Gt8 is 0V. Further, the gate terminal Gm8, which is connected to the gate terminal Gt8 through the connecting diode Dm8, is −1.3 V. However, when the transfer thyristor T8 is turned off, the potential of the gate terminal Gt8 changes from 0 V to −3.3 V.

At the time point v, the potential change of the elimination signal φe from "H" to "L" and the potential change of the second transfer signal φ2 from "L" to "H" are performed at the same time. If the potential change of the elimination signal φe from "H" to "L" is performed before the potential change of the second transfer signal φ2 from "L" to "H" is performed, the potential of the gate terminal Gm is fixed at −1.3 V by the forward-biased connecting diode Dm8. Thus, the effect of the elimination diode Sd8 for setting the potential of the gate terminal Gm8 at a lower value (−2.5 V) is lost. Accordingly, the potential change of the second transfer signal φ2 from "L" to "H" may be performed before the potential change of the elimination signal φe from "H" to "L".

At the time point w, the potential of the elimination signal φe is changed from "L" to "H." Thereby, the potentials of the cathode terminals become 0 V and the terminals of the anode terminals (gate terminals Gm) become −2.5 V, and thus the elimination diodes Sd are reverse-biased. Thereby, the potentials of the gate terminals Gm are not affected by the elimination signal φe, and further change toward the power supply potential Vga (−3.3 V) to which the gate terminals Gm are connected through the respective power supply line resistances Rm.

As described above, by the elimination signal φe (by changing the potential thereof from "H" to "L"), the potential of the gate terminal Gm of the memory thyristor M that has been turned off after being turned on is forcibly set at a value obtained by subtracting the forward-direction potential Vs of the elimination diode Sd from "L" (−3.3 V), and thus the memory of the memory thyristor M in which the memory thyristor M has been turned on is forcibly reset, and the reset period t5 is made to be shorter. Thereby, the reset period t5 is settable independently of the time constant defined by the parasitic capacity of the gate terminal Gm and the power supply line resistance Rm. Accordingly, the period t3 and the reset period t5 are independently settable.

Note that, in the third exemplary embodiment, schottky diodes are used as the elimination diodes Sd.

The thyristors (light-emitting thyristors L, transfer thyristors T, memory thyristors M) used in the third exemplary embodiment may be each configured by a pnpn structure in which a first p-type semiconductor layer, a second n-type semiconductor layer, a third p-type semiconductor layer and a fourth n-type semiconductor layer are stacked on the substrate in this order, although the detailed description thereof is omitted here. In this case, a p-n junction between the fourth n-type semiconductor layer as the uppermost layer and the third p-type semiconductor layer subsequent thereto may be used as a diode. However, under this diode, the second n-type semiconductor layer and the first p-type semiconductor layer exist. By this configuration, if the p-n junction between the fourth n-type semiconductor layer and the third p-type semiconductor layer is intended to be used as a diode, the thyristor (parasitic thyristor) having the pnpn structure configured of the first p-type semiconductor layer, the second n-type semiconductor layer, the third p-type semiconductor layer and the fourth n-type semiconductor layer may possibly be turned on (latched up).

Alternatively, if a schottky diode is configured by removing the fourth n-type semiconductor layer as the uppermost layer, and by providing a material making schottky-contact with the third p-type semiconductor layer whose surface is exposed, the pnpn structure is not configured any longer. Thus, the turning on (latching up) of the parasitic thyristor is suppressible.

Fourth Exemplary Embodiment

Figure 14:
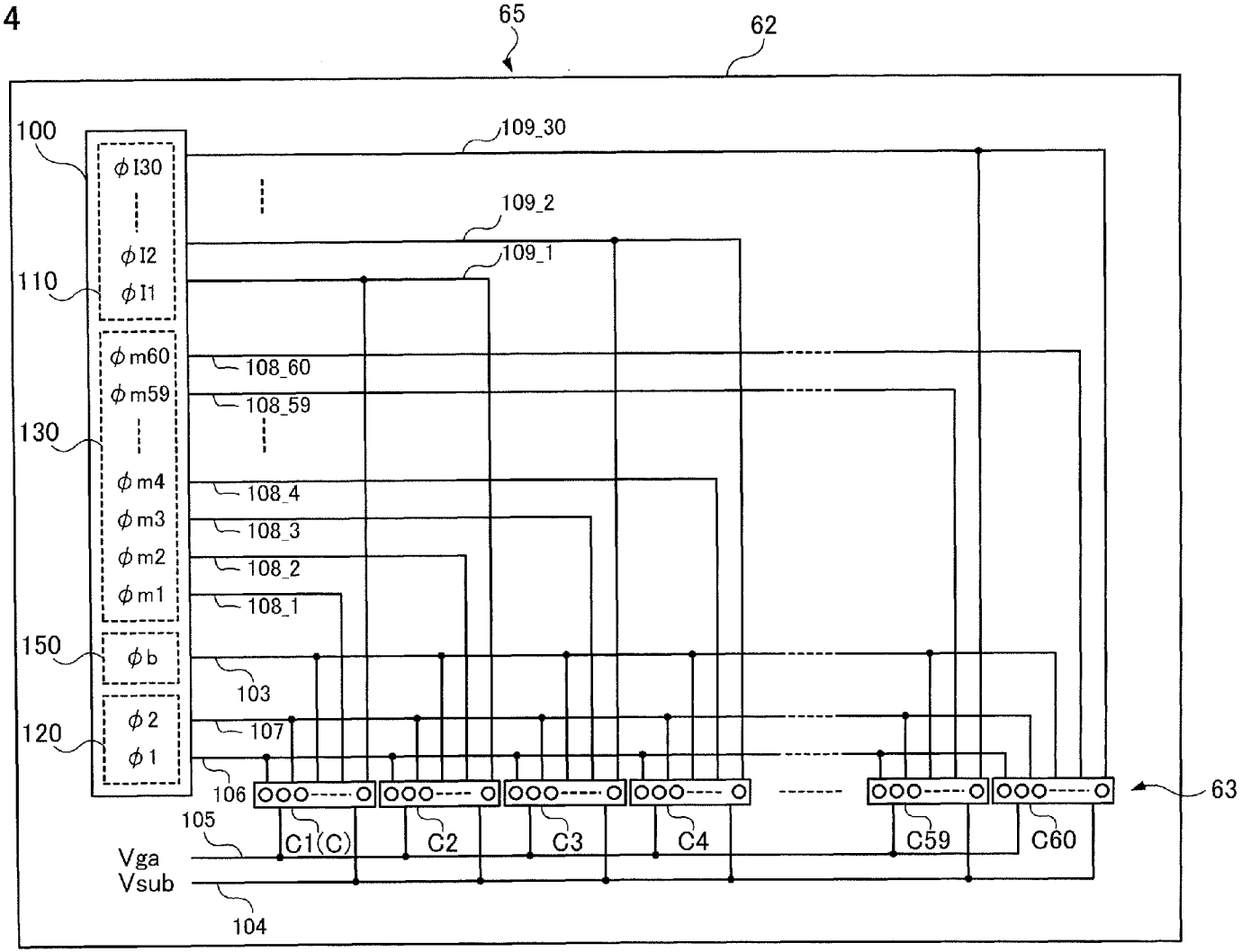
FIG. 14 is a diagram showing a configuration of the signal generating circuit and the wiring configuration between the signal generating circuit and each of the light-emitting chips in the light-emitting device in the fourth exemplary embodiment.

FIG. 14 is a diagram showing a configuration of the signal generating circuit 100 and the wiring configuration between the signal generating circuit 100 and each of the light-emitting chips C (C1 to C60) in the light-emitting device 65 in the fourth exemplary embodiment.

The difference between the fourth exemplary embodiment and the first exemplary embodiment shown in FIG. 4 is a newly-provided holding signal generating unit 150 in the fourth exemplary embodiment. The holding signal generating unit 150 is used for the signal generating circuit 100 to transmit, to the light-emitting chips C (C1 to C60), a holding signal φb for temporarily holding a position (number) of the light-emitting thyristor L to be caused to light up.

Thus, a holding signal line 103 is newly provided on the circuit board 62, in addition to the configuration of the first exemplary embodiment shown in FIG. 4. Here, the holding signal line 103 transmits the holding signal φb from the holding signal generating unit 150 of the signal generating circuit 100 to the light-emitting portion 63. The holding signal line 103 is connected to φb terminals of the light-emitting chips C (C1 to C60) (see FIG. 15 to be described later) in parallel.

The other configuration is the same as that in the first exemplary embodiment shown in FIG. 4. Thus, in the fourth exemplary embodiment, the same reference numerals are given to the same components as those in the first exemplary embodiment, and the detailed description thereof will be omitted.

In the first exemplary embodiment, the positions (numbers) of the light-emitting thyristors L to be caused to light up are memorized by turning on the plural memory thyristors M corresponding to the plural light-emitting thyristors L to be caused to light up in sequence on the basis of the image dataset. Then, after all of the memory thyristors M corresponding to the light-emitting thyristors L to be caused to light up are set to be in the ON state, the light-up signal φI is supplied thereto, and the light-emitting thyristors L are turned on to light up (emit light). For example, as shown in FIG. 7, in the period from the time point c to the time point s in the light-up control period T(#A), the image dataset is written in the memory thyristors M, and, in the lighting period t4 from the time point t to the time point x, the light-emitting thyristors L are set to be the lighting-up (on) state.

However, in the first exemplary embodiment, the image dataset corresponding to the light-up control period T(#B) may not be written in the memory thyristors M until the lighting period t4 of the light-emitting thyristors L is finished.

In the fourth exemplary embodiment, also in the lighting period t4 of the light-emitting thyristors L in a group, writing in the next group may be performed. Thereby, the light emission duty, which is a ratio of the light emission period per unit time, may be increased.

Figure 15:
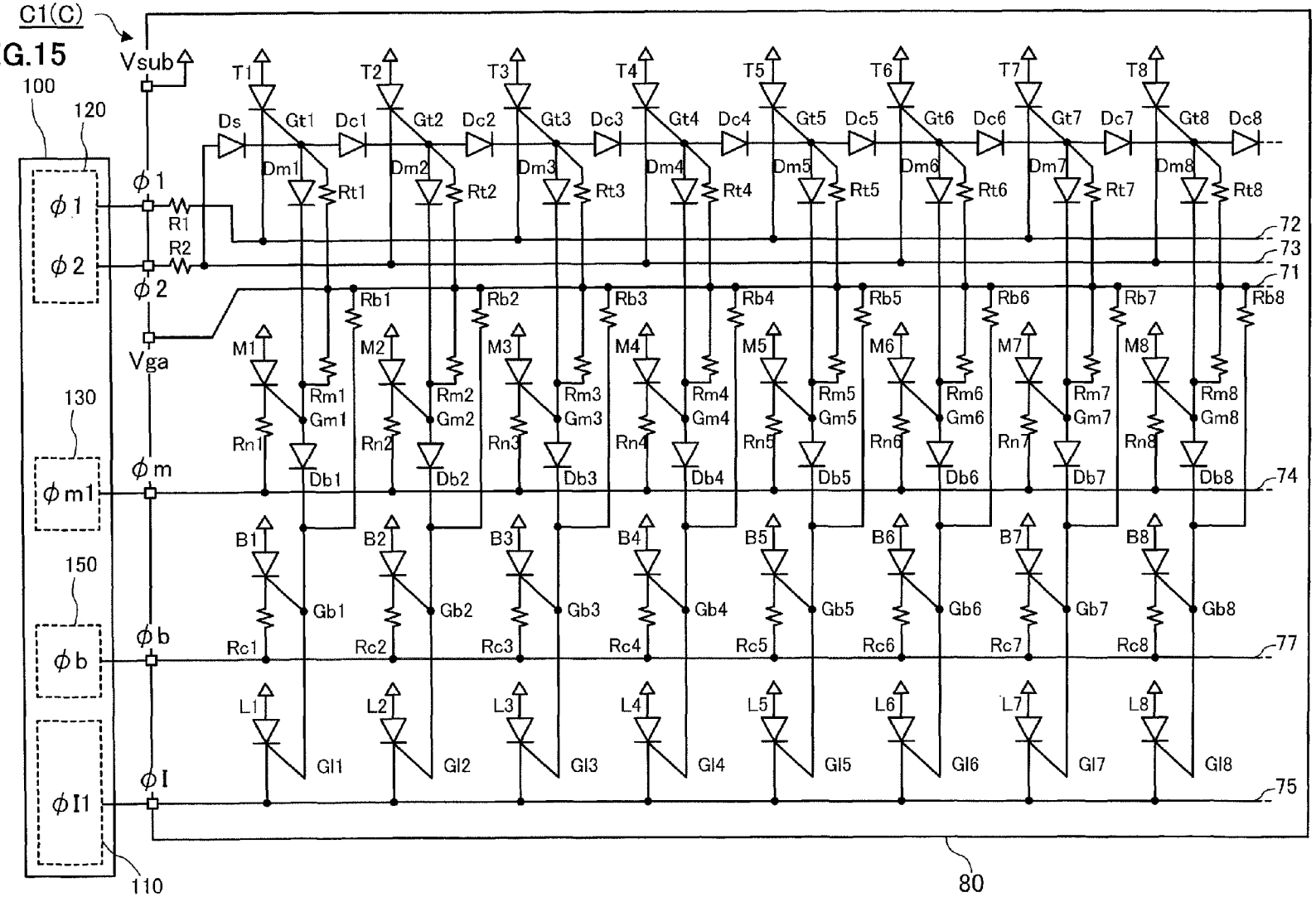
FIG. 15 is a diagram for explaining a circuit configuration of the light-emitting chips in the fourth exemplary embodiment.

FIG. 15 is a diagram for explaining a circuit configuration of the light-emitting chips C, which are self-scanning light-emitting element array (SLED) chips, in the fourth exemplary embodiment. Note that, a description is given here by taking the light-emitting chip C1 as an example. However, the other light-emitting chips C2 to C60 have the same configuration as the light-emitting chip C1.

The light-emitting chip C1 in the fourth exemplary embodiment includes a holding thyristor array (holding element array) formed of holding thyristors B1, B2, B3 . . . as an example of holding elements arrayed in line on the substrate 80, in addition to the configuration of the light-emitting chip C1 in the first exemplary embodiment shown in FIG. 5. The light-emitting chip C1 includes connecting diodes Db1, Db2, Db3 . . . in addition to the configuration of the light-emitting chip C1 in the first exemplary embodiment. Further, the light-emitting chip C1 includes power supply line resistances Rb1, Rb2, Rb3 . . . , and resistances Rc1, Rc2, Rc3 . . . , in addition to the configuration of the light-emitting chip C1 in the first exemplary embodiment.

Here, similarly to the first exemplary embodiment, if the holding thyristors B1, B2, B3 . . . are not distinguished, they are called holding thyristors B. Also, if the connecting diodes Db1, Db2, Db3 . . . , the power supply line resistances Rb1, Rb2, Rb3 . . . , and the resistances Rc1, Rc2, Rc3 . . . are not respectively distinguished, they are called connecting diodes Db, power supply line resistance Rb and resistances Rc, respectively.

Note that, the holding thyristors B are semiconductor elements each having three terminals of an anode terminal (anode), a cathode terminal (cathode) and a gate terminal (gate), similarly to those in the transfer thyristors T, the memory thyristors M and the light-emitting thyristors L.

If it is assumed that the number of the transfer thyristors T is set at 128 similarly to that in the light-emitting chip C1 in the first exemplary embodiment, and each of the number of the holding thyristors B, the number of the power supply line resistances Rb and the number of the resistances Rc is set at 128.

Similarly to the transfer thyristors T1, T2, T3 . . . in the first exemplary embodiment, the holding thyristors B1, B2, B3 . . . are arrayed in numerical order from the left side in FIG. 15, such as B1, B2, B3 . . . . Similarly, the connecting diodes Db1, Db2, Db3 . . . , the power supply line resistances Rb1, Rb2, Rb3 . . . , and the resistances Rc1, Rc2, Rc3 . . . are respectively arrayed in numerical order from the left side in FIG. 15.

The other configuration is the same as that in the first exemplary embodiment shown in FIG. 5. Thus, in the fourth exemplary embodiment, the same reference numerals are given to the same components as those in the first exemplary embodiment, and the detailed description thereof will be omitted.

Next, a description will be given of electric connections between the elements in the light-emitting chip C1.

As mentioned above, the light-emitting chip C1 in the fourth exemplary embodiment has a configuration in which the holding thyristors B, the connection diodes Db, the power supply line resistances Rb and the resistances Rc are additionally provided. Thus, the electric connections of the newly added elements are mainly described.

The anode terminals of the holding thyristors B1, B2, B3 . . . are connected to the substrate 80 of the light-emitting chip C1, similarly to the anode terminals of the transfer thyristors T1, T2, T3 . . . . These anode terminals are connected to the power supply line 104 (see FIG. 14) through the Vsub terminal provided on the substrate 80. To this power supply line 104, the reference potential Vsub is supplied. Gate terminals Gb1, Gb2, Gb3 . . . of the holding thyristors B1, B2, B3 . . . are connected to the power supply line 71 through the respective power supply line resistances Rb1, Rb2, Rb3 . . . that are provided so as to correspond to the respective holding thyristors B1, B2, B3 . . . .

Here, if the gate terminals Gb1, Gb2, Gb3 . . . are not distinguished, they are called gate terminals Gb.

The cathode terminals of the holding thyristors B1, B2, B3 . . . are connected to a holding signal line 77 through the resistances Rc1, Rc2, Rc3 . . . that are provided so as to correspond thereto. The holding signal line 77 is connected to a ϕb terminal that is an input terminal of the holding signal ϕb. To the ϕb terminal, the holding signal line 103 (see FIG. 14) is connected, and the holding signal ϕb is supplied thereto.

In the light-emitting chip C1 in the first exemplary embodiment shown in FIG. 5, the gate terminals Gm of the memory thyristors M and the gate terminals Gl of the light-emitting thyristors L are directly connected with each other. In the fourth exemplary embodiment, instead of the above configuration, the gate terminals Gb1, Gb2, Gb3 . . . of the holding thyristors B1, B2, B3 . . . are connected to the respective gate terminals Gm1, Gm2, Gm3 . . . of the memory thyristors M1, M2, M3 . . . each having the same number as the holding thyristors B one by one, through the respective connecting diodes Db1, Db2, Db3 . . . . In other words, the cathode terminals of the connecting diodes Db1, Db2, Db3 . . . are connected to the respective gate terminals Gb1, Gb2, Gb3 . . . of the holding thyristors B1, B2, B3 . . . , while the anode terminals of the connecting diodes Db1, Db2, Db3 . . . are connected to the respective gate terminals Gm1, Gm2, Gm3 . . . of the memory thyristors M1, M2, M3 . . . . Further, the connecting diodes Db are connected thereto in a current flow direction from the respective gate terminals Gm of the memory thyristors M to the respective gate terminals Gb of the holding thyristors B.

The connecting diodes Db are connected to the respective gate terminals Gb of the holding thyristors B and the respective gate terminals Gl of the light emitting thyristors L.

Next, a description will be given of the operation of the light-emitting portion 63 in the fourth exemplary embodiment. The pair of the first transfer signal ϕ1 and the second transfer signal ϕ2 and the holding signal ϕb are sharably supplied to the light-emitting chips C (C1 to C60) configuring the light-emitting portion 63, as shown in FIG. 14. Meanwhile, the memory signals ϕm (ϕm1 to ϕm60) based on the image dataset are individually supplied to the light-emitting chips C (C1 to C60). The light-up signals ϕI (ϕI1 to ϕI30) are respectively supplied to the corresponding pairs each formed of two of the light-emitting chips C so that each light-up signal ϕI is shared by the two of the light-emitting chips C configuring each pair, and are individually supplied to the light-emitting chips C configuring different pairs.

The fourth exemplary embodiment differs from the first exemplary embodiment only in the additionally-provided holding thyristors B. The operation of the light-emitting portion 63 is recognized if the operation of the light-emitting chip C1 is described, similarly to the description in the first exemplary embodiment. Accordingly, the description will be given of the operation of the light-emitting chips C by taking the light-emitting chip C1 as an example.

Figure 16:
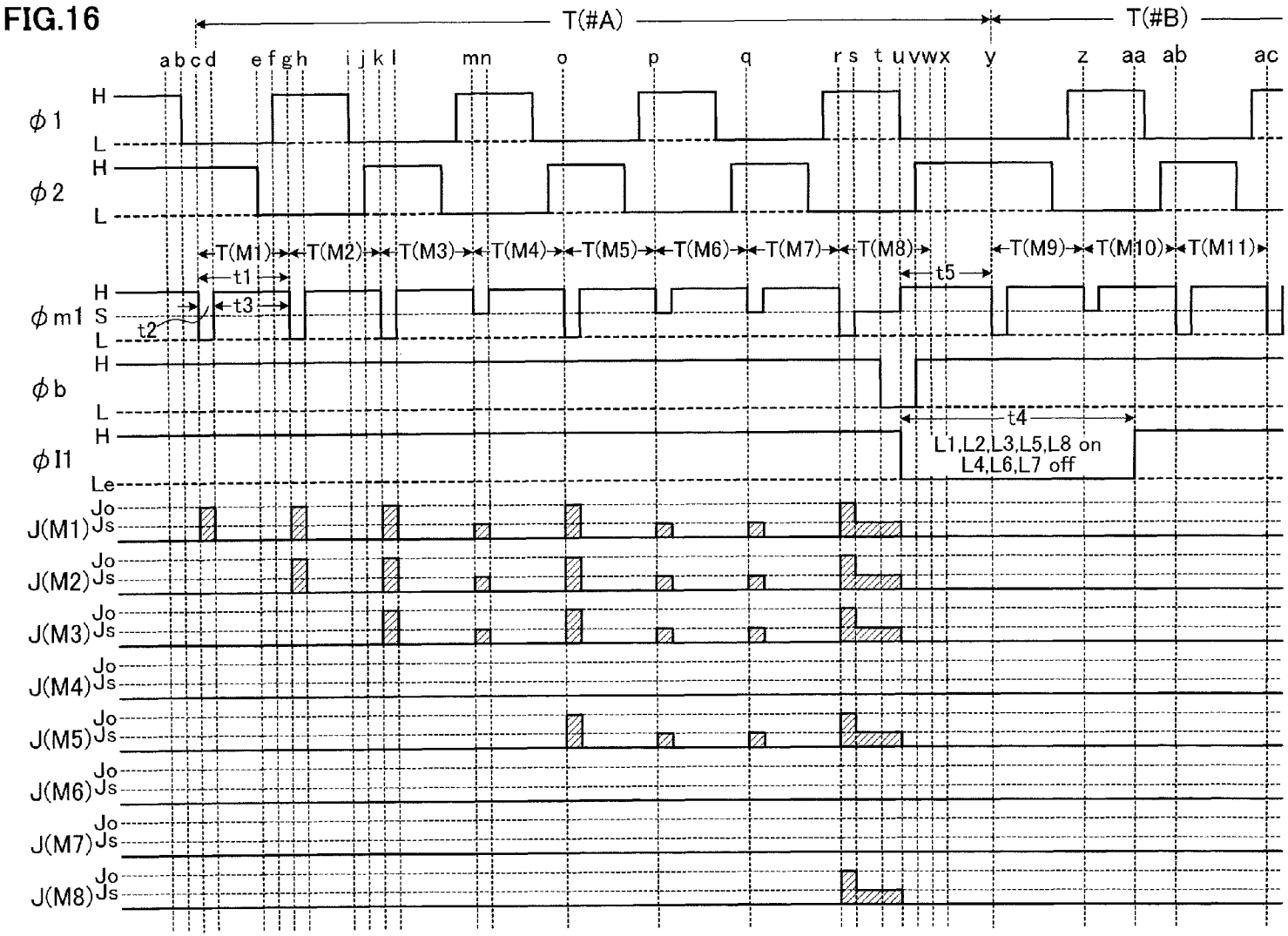
FIG. 16 is a timing chart for explaining the operation of the light-emitting chip in the fourth exemplary embodiment.

FIG. 16 is a timing chart for explaining the operation of the light-emitting chip C1 (C) in the fourth exemplary embodiment. In FIG. 16, it is assumed that time elapses from the time point a to a time point ac (from the time point a to a time point z in alphabetical order, and then time points aa, ab and ac follow). In FIG. 16, waveforms of the first transfer signal ϕ1, the second transfer signal ϕ2, the memory signal ϕm1, the holding signal ϕb, the light-up signal ϕI1 and currents J(M1) to J(M8) flowing into the respective memory elements M1 to M8 are shown.

FIG. 16 shows the light-up control period T(#A) (from the time point c to the time point y) and a part of the light-up control period T(#B) (from the time point y and the subsequent period) in the case where the light-up control is performed by using groups each formed of 8 light-emitting thyristors L shown in FIG. 6. Here, in the light-up control period T(#A), the light-emitting thyristors L1 to L8 in the group #A are light-controlled, and in the light-up control period T(#B), the light-emitting thyristors L9 to L16 in the group #B are light-controlled. Note that, the light-up control period T(#B) is followed by the light-up control period T(#C) when the light-emitting thyristors L17 to L24 in the group #C are light-controlled and the like, although the illustration thereof is omitted.

In a case where FIG. 16 and FIG. 7 are compared with each other, it is recognized that the light-up control period T(#A) in the fourth exemplary embodiment (from the time point c to the time point y) is shorter than the light-up control period T(#A) in the first exemplary embodiment. In other words, at the time point y prior to the time point aa when the lighting period t4 of the light-emitting thyristors L1 to L8 in the group #A is finished, the light-up control period T(#B) starts.

Note that, in the light-up control period T(#A) in FIG. 16, it is assumed that the light-emitting thyristors L1, L2, L3, L5 and L8 among the 8 light-emitting thyristors L1 to L8 in the group #A are caused to light up (emit light), and the light-emitting thyristors L4, L6 and L7 are maintained not to light up (to be off), similarly to the case in the first exemplary embodiment. Also, it is assumed that, the light-emitting thyristors L9, L11 and L12 are caused to light up (emit light) while the light-emitting thyristor L10 is maintained to be off in the light-up control period T(#B), as one example. In other words, it is assumed that the image dataset "11101001" is printed in the light-up control period T(#A), and the image dataset "1011 . . . " is printed in the light-up control period T(#B).

A description will be given of different portions of the waveforms of the respective signals from those in the first exemplary embodiment.

The waveforms in the period from the time point a to the time point s are the same as those in FIG. 7 in the first exemplary embodiment, except the holding signal ϕb.

The potential of the holding signal ϕb added in the fourth exemplary embodiment is "H" at the starting time point c of the light-up control period T(#A), and is changed from "H" to "L" at the time point t. Then, the potential thereof is changed from "L" to "H" at the time point v. The potential thereof is maintained at "H" at the finish time point y of the light-up control period T(#A).

The potential of the light-up signal ϕI1 is "H" at the starting time point c of the light-up control period T(#A), and is changed from "H" to "Le" at the time point u in the light-up control period T(#A), and is further changed from "Le" to "H" at the time point aa of the light-up control period T(#B).

In the first exemplary embodiment, the lighting period t4 of the light-emitting thyristors L in each group is included in the light-up control period (for example, the light-up control period T(#A)). However, in the fourth exemplary embodiment, the lighting period t4 (from the time point u to the time point aa) of the light-emitting thyristors L is included in the light-up control periods for two groups (for example, T(#A) and T(#B)).

The waveforms of the first transfer signal ϕ1, the second transfer signal ϕ2, the memory signal ϕm1 (ϕm) and the currents J(M1) to J(M8) flowing into the memory thyristors M are the same as those in the first exemplary embodiment except the above points, and thus the detailed description thereof will be omitted.

A description will be given of the operation of the light-emitting portion 63 and the light-emitting chips C in accordance with the timing chart shown in FIG. 16, with reference to FIG. 15. The operation of the light-emitting chips C is similar to the operation of the light-emitting chips C in the first exemplary embodiment except the portion related to the holding thyristors B newly provided in the fourth exemplary embodiment. Thus, the description will be mainly given of the operation of the light-emitting chips C related to the newly-provided holding thyristors B, and the description of the operation similar to that in the first exemplary embodiment will be omitted.

(Initial State)

At the time point a in the timing chart shown in FIG. 16, the Vsub terminal, which is provided on each of the light-emitting chips C (C1 to C60) of the light-emitting portion 63, is set at the reference potential Vsub (0 V). Meanwhile, each Vga terminal is set at the power supply potential Vga (−3.3 V) (see FIG. 14).

Further, the potentials of the first transfer signal ϕ1, the second transfer signal ϕ2, the memory signals ϕm (ϕm1 to ϕm60) and the holding signal ϕb are set at "H," and the potentials of the light-up signals ϕI (ϕI1 to ϕI30) are set at "H." Thereby, the potential of the holding signal line 103 added in the fourth exemplary embodiment becomes "H," and the potential of the holding signal line 77 of each light-emitting chip C becomes "H" through the ϕb terminal of each light-emitting chip C.

The anode terminals of the holding thyristors B are connected to the Vsub terminal and are supplied with "H" (0 V), similarly to the other thyristors (transfer thyristors T, memory thyristors M and light-emitting thyristors L). Meanwhile, the cathode terminals of the holding thyristors B are connected to the holding signal line 77 having the potential set at "H." Thereby, all of the potentials of the anode terminals and the cathode terminals of the holding thyristors B become "H," and thus the holding thyristors B are in the OFF state.

Since the other thyristors (transfer thyristors T, memory thyristors M and light-emitting thyristors L) are the same as those in the first exemplary embodiment, all of the thyristors (transfer thyristors T, memory thyristors M, holding thyristors B and light-emitting thyristors L) are in the OFF state.

Since the start diode Ds is the same as that in the first exemplary embodiment, the potential of the gate terminal Gt1 becomes −1.3 V by the start diode Ds. Thus, the threshold voltage of the transfer thyristor T1 is −2.6 V.

The potentials of the gate terminal Gt2 of the transfer thyristor T2 and the gate terminal Gm1 of the memory thyristor M1 are −2.6 V. However, since the gate terminal Gb1 of the holding thyristor B1 is connected to the gate terminal Gt1 having the potential of −1.3 V through two stages of the forward-biased diodes (connecting diode Dm1 and the connecting diode Db1), the gate terminal Gb1 is not affected by the gate terminal Gt1 having the potential of −1.3 V. Thus, the potential of the gate terminal Gb1 becomes the power supply potential Vga (−3.3 V). The potentials of the other gate terminals Gb of the holding thyristors B also become the power supply potential Vga (−3.3 V). Accordingly, the threshold voltages of the holding thyristors B are −4.6 V.

(Operating State)

When the potential of the first transfer signal ϕ1 is changed from "H" (0 V) to "L" (−3.3 V) at the time point b, the transfer thyristor T1 goes into the ON state, similarly to the case in the first exemplary embodiment.

The operation related to the memory thyristors M from the time point c to the time point s is the same as that in the first exemplary embodiment. Note that, the period from the time point c to the time point s in FIG. 16 is assumed to be the same as the period from the time point c to the time point s in FIG. 7.

A description will be given of the operation of the holding thyristors B from the time point c to the time point s.

When the memory thyristor M1 is turned on at the starting time point c of the writing period T(M1), the potential of the gate terminal Gm1 becomes "H" (0 V), and thus the on current Jo flows into the memory thyristor M1 as shown in the current J(M1). The gate terminal Gb1 of the holding thyristor B1 is connected to the gate terminal Gm1 through the forward-biased connecting diode Db1. Thus, the potential of the gate terminal Gb1 of the holding thyristor B1 becomes −1.3 V, and the threshold voltage of the holding thyristor B1 becomes −2.6 V. In addition, since the gate terminal Gb1 is also connected to the gate terminal Gl1 of the light-emitting thyristor L1, the threshold voltage of the light-emitting thyristor L1 also becomes −2.6 V.

However, since the potential of the holding signal ϕb is "H" (0 V) at the time point c, the holding thyristor B1 is not turned on. In addition, since the potential of the light-up signal ϕI1 (ϕI) is also "H" (0 V), the light-emitting thyristor L1 is not turned on, either, and thus does not light up (emit light).

Note that, since the gate terminal Gb2 of the holding thyristor B2 is connected to the gate terminal Gt1 having the potential of "H" (0 V) through the three stages of the forward-biased diodes (coupling diode Dc1, connecting diode Dm2 and connecting diode Db2), the gate terminal Gt1 having the potential of "H" (0 V) does not affect the gate terminal Gb2, and thus the gate terminal Gb2 is maintained at the power supply potential Vga (−3.3 V). Accordingly, the threshold voltage of the holding thyristor B2 is −4.6 V. The holding thyristors B each having a number not less than 3 are the same as the above. Also, the light-emitting thyristors L each having a number not less than 2 are the same as the above.

When the potential of the memory signal ϕm1 (ϕm) is changed from "L" to "H" at the time point d, the memory thyristor M1 is turned off. The potential of the gate terminal Gm1 starts to change from 0 V to −3.3 V. With this change, the potential of the gate terminal Gb1 of the holding thyristor B1 starts to change from −1.3 V to −3.3 V. The gate terminal Gl1 of the light-emitting thyristor L1 is the same as the above since it is connected to the gate terminal Gb1. Since the holding signal ϕb is maintained at the potential of "H" (0 V), the holding thyristor B1 is not turned on. Also, since the light-up signal ϕI1 (ϕI) is maintained at the potential of "H" (0 V), the light-emitting thyristor L1 is not turned on and thus does not light up (emit light).

In the subsequent writing periods T(M2) to T(M7), the memory thyristors M1, M2, M3 and M5 are alternately turned on and off, as described in the first exemplary embodiment. In response to this, the potentials of the gate terminals Gb of the holding thyristors B1 to B7 (the gate terminals Gl of the light-emitting thyristors L1 to L7) are changed between −1.3 V and −3.3 V. Thus, the threshold voltages of the holding thyristors B1 to B7 (light-emitting thyristors L1 to L7) are changed between −2.6 V and −4.6 V. In the writing periods T(M1) to T(M7), since the potential of the holding signal ϕb is "H" (0 V), the holding thyristors B1 to B7 are not turned on. In addition, since the potential of the light-up signal ϕI1 (ϕI) is also "H" (0 V), the light-emitting thyristors L1 to L7 are not turned on, and thus does not light up (emit light).

When the potential of the memory signal ϕm1 (ϕm) is changed from "H" to "L" at the time point r, the memory thyristors M1, M2, M3, M5 and M8 are turned on, similarly to the case in the first exemplary embodiment.

Even when the memory signal ϕm1 (ϕm) is changed from "L" to "S" at the time point s, the ON states of the memory thyristors M1, M2, M3, M5 and M8 are maintained.

Since the potential of the gate terminal Gm of the memory thyristor M that has been turned on becomes 0 V, the potential of the gate terminal Gb of the holding thyristor B connected to this gate terminal Gm through one stage of a forward-biased diode (connecting diode Db) becomes −1.3 V. Thereby, the threshold voltage of the holding thyristor B becomes −2.6 V. In other words, the threshold voltages of the holding thyristors B1, B2, B3, B5 and B8 are −2.6 V immediately after the time point s. Meanwhile, the threshold voltages of the holding thyristors B4, B6 and B7 are maintained at −4.6 V. Further, the threshold voltages of the holding thyristors B each having a number not less than 9 are −4.6 V.

At the time point t, the potential of the holding signal ϕb is changed from "H" (0 V) to "L" (−3.3 V). Thus, the holding thyristors B1, B2, B3, B5 and B8, which have the threshold voltage of −2.6 V, are turned on. The other holding thyristors B are not turned on.

In other words, information on the numbers (positions) of the light-emitting thyristors L to be caused to light up, which is memorized by the memory thyristors M, is copied to the holding thyristors B by turning on the holding thyristors B having the same numbers as the memory thyristors M being in the ON state.

Note that, the holding thyristors B are connected to the holding signal line 77 through the respective resistances Rc. Even if one of the holding thyristors B goes into the ON state, and the potential of the cathode terminal of the holding thyristor B becomes a value obtained by subtracting the diffusion potential Vd (1.3 V) from the potential "H" (0 V) of the anode terminal thereof, the holding signal line 77 is maintained at the potential of "L." Thus, the plural holding thyristors B (holding thyristors B1, B2, B3, B5 and B8, here) are ready to be turned on at the same time.

When the holding thyristors B1, B2, B3, B5 and B8 are turned on, the potentials of the gate terminals Gb1, Gb2, Gb3, Gb5 and Gb8 become 0 V that is the potential of the anode terminals. The threshold voltages of the light-emitting thyristors L1, L2, L3, L5 and L8 having the respective gate terminals Gl1, Gl2, Gl3, Gl5 and Gl8 connected to the respective gate terminals Gb1, Gb2, Gb3, Gb5 and Gb8 become −1.3 V. Meanwhile, the potentials of the gate terminals Gb4, Gb6 and Gb7 of the holding thyristors B4, B6 and B7 which are not turned on are maintained at −3.3 V. Accordingly, the threshold voltages of the holding thyristors B4, B6 and B7 are −4.6 V. The threshold voltages of the holding thyristors B each having a number not less than 9 are −4.6 V.

Therefore, the transfer thyristor T8, the memory thyristors M1, M2, M3, M5 and M8 and the holding thyristors B1, B2, B3, B5 and B8 are kept in the ON state.

When the potential of the light-up signal ϕI1 (ϕI) is changed from "H" to "Le" (−2.6 V<"Le"≦−1.3 V) at the time point u, the light-emitting thyristors L1, L2, L3, L5 and L8 are turned on and light up (emit light).

Note that, the light-emitting thyristors L are connected to the light-up signal line 75 without a resistance. However, since the light-up signal ϕI1 (ϕI) is driven with current, the plural light-emitting thyristors L1, L2, L3, L5 and L8 are ready to be turned on without a resistance.

Further, at the time point u, the potential of the memory signal ϕm1 (ϕm) is changed from "S" to "H." Thereby, the memory thyristors M1, M2, M3, M5 and M8 are turned off. Then, the potentials of the gate terminals Gm1, Gm2, Gm3, Gm5 and Gm8 gradually change from 0 V toward −3.3 V. Note that, the potentials of the gate terminals Gm4, Gm6 and Gm7 are maintained at −3.3 V.

When the potentials of the gate terminals Gm1, Gm2, Gm3, Gm5 and Gm8 become lower than −2 V (<−2 V), the memory thyristors M1, M2, M3, M5 and M8 are not turned on even if the potential of the memory signal ϕm1 (ϕm) is set at "L," as mentioned above. In other words, the memory in which the memory thyristors M1, M2, M3, M5 and M8 have been turned on, that is, the memory of the positions (numbers) of the light-emitting thyristors L is lost.

In the fourth exemplary embodiment, at the time point t prior to the time point u, the holding thyristors B1, B2, B3, B5 and B8 are caused to be turned on, and thereby the positions (numbers) of the light-emitting thyristors L to be caused to light up are transferred (copied) to the holding thyristors B. Accordingly, at the time point u and the subsequent period, there is no problem if the information on the positions (numbers) of the light-emitting thyristors L to be caused to light up is lost from the memory thyristors M.

Furthermore, at the time point u, the potential of the first transfer signal ϕ1 is changed from "H" to "L." Thereby, the transfer thyristor T9, which has the threshold voltage of −2.6 V, is turned on. Then, the gate terminal Gt9 of the transfer thyristor T9 becomes 0 V. Further, the potential of the gate terminal Gt10 of the transfer thyristor T10 becomes −1.3 V, and the threshold voltage of the transfer thyristor T10 becomes −2.6 V. Similarly, the threshold voltage of the memory thyristor M9 becomes −2.6 V.

Note that, in the fourth exemplary embodiment, at the time point u, the potential change of the light-up signal ϕI1 (ϕI) from "H" to "Le", the potential change of the memory signal ϕm1 (ϕm) from "S" to "H" and the potential change of the first transfer signal ϕ1 from "H" to "L" are performed at the same time. These changes may be performed in arbitrary order.

Specifically, if the potential change of the first transfer signal ϕ1 from "H" to "L" is firstly performed, the transfer thyristor T9 is turned on and the threshold voltage of the memory thyristor M9 becomes −2.6 V. Even in this case, since the memory signal ϕm1 (ϕm) is "S" (−2.5 V), the memory thyristor M9 is not turned on. In addition, although the holding thyristor B9 has the threshold voltage of −3.9 V, the holding thyristor B9 is not turned on since the potential of the holding signal ϕb is "L" (−3.3 V).

Alternatively, if the potential change of the first transfer signal ϕ1 from "H" to "L" is performed after the potential change of the memory signal ϕm1 (ϕm) from "S" to "H" is firstly performed, the transfer thyristor T9 is turned on, and the threshold voltage of the memory thyristor M9 becomes −2.6 V. However, the memory thyristor M9 is not turned on since the potential of the memory signal ϕm1 (ϕm) becomes "H" (0 V). Although the holding thyristor B9 has the threshold voltage of −3.9 V, the holding thyristor B9 is not turned on since the potential of the holding signal ϕb is −3.3 V.

Alternatively, if the potential change of the first transfer signal ϕ1 from "H" to "L" is firstly performed, the transfer thyristor T9 is turned on. As a result, the threshold voltage of the memory thyristor M9 becomes −2.6 V, and the threshold voltage of the light-emitting thyristor L9 becomes −3.9 V. Thereafter, even if the potential of the light-up signal ϕI1 (ϕI) is changed from "H" to "Le," the light-emitting thyristor L9 is not turned on. In addition, the memory thyristor M9 is not turned on since the potential of the memory signal ϕm1 (ϕm) is "S" (−2.5 V).

As described above, the order of the above-mentioned three changes is not limited.

Immediately after the time point u, the transfer thyristors T8 and T9, and the holding thyristors B1, B2, B3, B5 and B8 are kept in the ON state, and the light-emitting thyristors L1, L2, L3, L5 and L8 are kept in the lighting-up (on) state.

Next, when the potential of the second transfer signal ϕ2 is changed from "L" to "H" at the time point v, the transfer thyristor T8 is turned off.

Immediately after the time point v, the transfer thyristor T9 and the holding thyristors B1, B2, B3, B5 and B8 are kept in the ON state, and the light-emitting thyristors L1, L2, L3, L5 and L8 are kept in the lighting-up (on) state.

At the time point v, the potential of the holding signal ϕb is changed from "L" to "H." Thereby, the holding thyristors B1, B2, B3, B5 and B8 have the respective cathode and anode terminals having the potential "H," and thus the holding thyristors B1, B2, B3, B5 and B8 may not be kept in the ON state any longer, and are turned off.

Thereby, the memory of the positions (numbers) of the light-emitting thyristors L to be caused to light up is lost from the holding thyristors B. However, at the time point u before the time point v, the light-emitting thyristors L to be caused to light up have been already caused to light up, and thus there is no problem if the memory of the positions (numbers) of the light-emitting thyristors L to be caused to light up is lost from the holding thyristors B.

Immediately after the time point v, the transfer thyristor T9 is kept in the ON state, and the light-emitting thyristors L1, L2, L3, L5 and L8 are kept in the lighting-up (on) state.

Then, from the time point y, the light-up control period T(#B) for the light-emitting thyristors L9 to L16 in the group #B starts.

At the starting time point y of the writing period T(M9), the potential of the memory signal ϕm1 (ϕm) is changed from "H" to "L" in order to write a memory in which the light-emitting thyristor L9 is caused to light up. Thereby, the memory thyristor M9 having the threshold voltage of −2.6 V is turned on.

At this time, the memory thyristors M1, M2, M3, M5 and M8, which have been turned on in the light-up control period T(#A), are not allowed to be turned on any longer. Thus, at the time point y, it is necessary that the threshold voltages of these memory thyristors M1, M2, M3, M5 and M8 be lower than "H" (−3.3 V) (<−3.3 V), that is, the potentials of the gate terminals Gm1, Gm2, Gm3, Gm5 and Gm8 be less than −2 V (<−2 V). The potential changes of the gate terminals Gm1, Gm2, Gm3, Gm5 and Gm8 are determined by the time constant defined by the parasitic capacity of the gate terminal Gm and the power supply line resistance Rm. Thus, the reset period t5 from the time point u to the time point y is to be set sufficiently long so that the above requirement is satisfied.

Accordingly, immediately after the time point y, the transfer thyristor T9 and the memory thyristor M9 are kept in the ON state, and the light-emitting thyristors L1, L2, L3, L5 and L8, which have been caused to light up at the time point u in the light-up control period T(#A) are kept in the lighting-up (on) state.

At the time point z, in order to prevent the light-emitting thyristor L10 from lighting up, the potential of the memory signal ϕm1 (ϕm) is changed from "H" to "S."

Immediately after the time point z, the transfer thyristor T10 and the memory thyristor M9 are kept in the ON state, and the light-emitting thyristors L1, L2, L3, L5 and L8 are kept in the lighting-up (on) state.

At the time point aa, the potential of the light-up signal ϕI1 (ϕI) is changed from "Le" to "H." Thereby, the light-emitting thyristors L1, L2, L3, L5 and L8, which have been in the lighting-up (on) state, have the respective cathode and anode terminals having the potential of "H," and thus they may not be kept in the ON state, and are turned off to be put out.

Immediately after the time point aa, the transfer thyristor T10 and the memory thyristor M9 are kept in the ON state.

In other words, the light-emitting thyristors L1, L2, L3, L5 and L8, which are memorized to be caused to light up in the light-up control period T(#A), light up (emit light) in the lighting period t4 from the time point u included in the light-up control period T(#A) to the time point aa included in the light-up control period T(#B).

Note that, the finish time point of the lighting period t4 for the light-emitting thyristors L1, L2, L3, L5 and L8 is not necessary to be the time point aa included in the writing period T(M10). In other words, it is only necessary that the finish time point of the lighting period t4 be a time point prior to the time point when the light-emitting thyristors L9, L11 . . . to be caused to light up in the light-up control period T(#B) start to light up.

At the time point ab, the potential of the memory signal ϕm1 (ϕm) is changed from "H" to "L" in order to memorize information that the light-emitting thyristor L11 is caused to light up.

Immediately after the time point ab, the transfer thyristor T11 and the memory thyristors M9 and M11 are kept in the ON state.

At the time point ab and the subsequent period, the waveform of the memory signal ϕm1 (ϕm) based on the image dataset differs from that in the previous period. However, since it is similar to that at the time point k and the subsequent period in the light-up control period T(#A), the detailed description thereof will be omitted.

As described above, in the fourth exemplary embodiment, the lighting-up (light emission) of the light-emitting thyristors L and the writing to the memory thyristors M that is caused to memorize the positions (numbers) of the light-emitting thyristors L to be caused to light up are performed in parallel. Thereby, the lighting-up (light emission) of the light-emitting thyristors L may be performed with high light emission duty in comparison with the case in the first exemplary embodiment.

Thus, the writing time to the photoconductive drum 12 by the print head 14 becomes shorter.

This is attributed to the fact that, by providing the holding thyristors B, the positions (numbers) of the light-emitting thyristors L to be caused to light up, which are memorized in the memory thyristors M, are transferred to the holding thyristors B, the memory of the positions (numbers) of the light-emitting thyristors L to be caused to light up is deleted (cleared) from the memory thyristors M, and the positions (numbers) of the light-emitting thyristors L to be caused to light up next time are memorized in the memory thyristors M.

In other words, this is attributed to the fact that, by interposing the holding thyristors B therebetween, the change of the states of the memory thyristors M is prevented from affecting the light-emitting thyristors L, and an electric relationships between the memory thyristors M and the light-emitting thyristors L are cut off.

Note that, in FIG. 16, the image dataset in the light-up control period T(#A) is set at "11101001," and the image dataset in the light-up control period T(#B) is set at "101 . . . ." Similarly to the case in the first exemplary embodiment, when the light-emitting thyristors L are caused to light up, it is only necessary that the potential of the memory signal ϕm be set at "L," and when the light-emitting thyristors L are not caused to light up, it is only necessary that the potential of the memory signal ϕm be set at "S."

Thereby, plural light-emitting points (light-emitting thyristors L) are ready to light up at the same time in the one lighting period t4. Thereby, the lighting period t4 is allowed to be shortened per light-emitting chip C, in comparison with a case where the light-emitting points (light-emitting thyristors L) are light-controlled one by one. From the aspect of the print head 14, the writing time to the photoconductive drum 12 may be shortened.

Fifth Exemplary Embodiment

Figure 17:
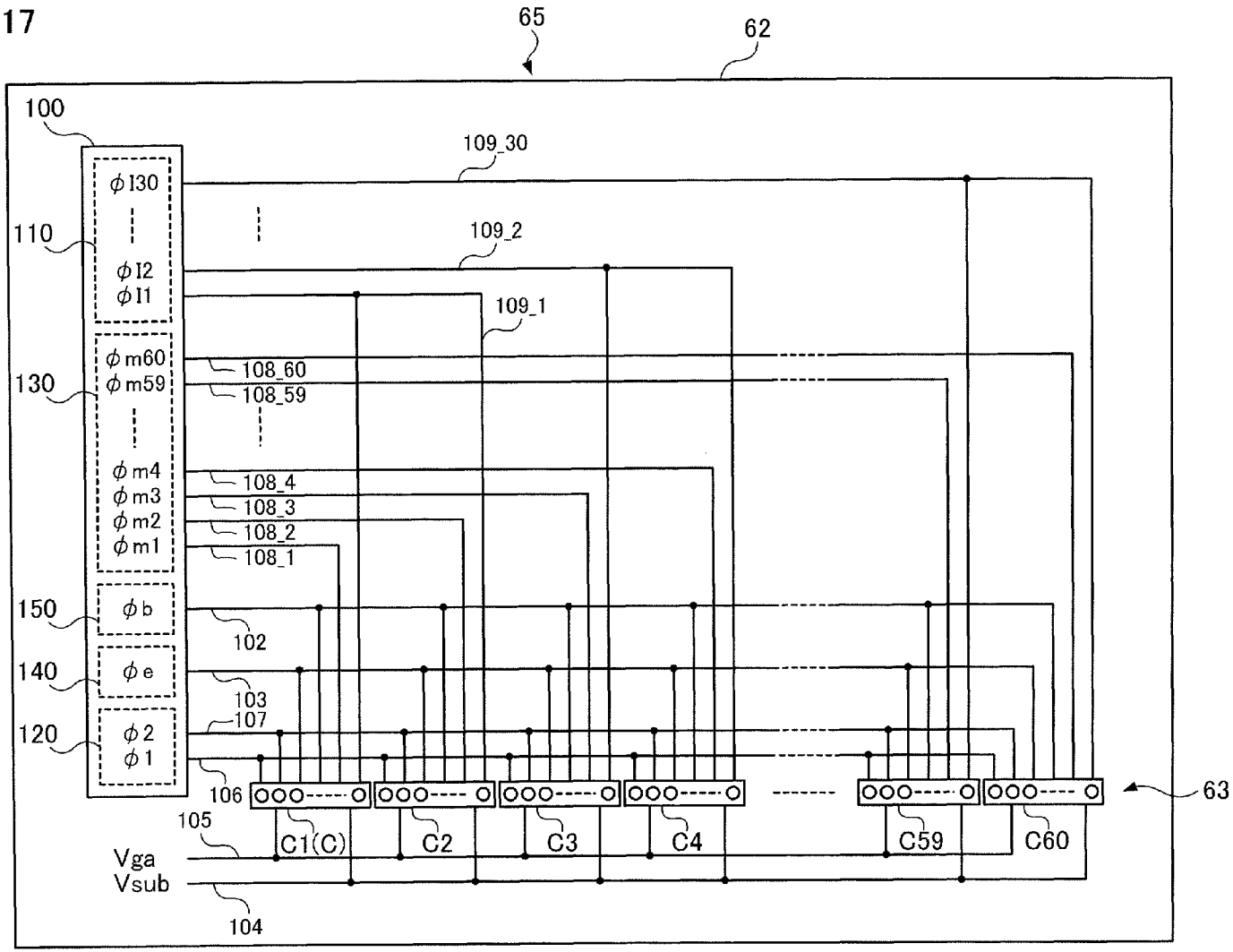
FIG. 17 is a diagram showing a configuration of the signal generating circuit and a wiring configuration between the signal generating circuit and each of the light-emitting chips in the light-emitting device in the fifth exemplary embodiment.

FIG. 17 is a diagram showing a configuration of the signal generating circuit 100 and a wiring configuration between the signal generating circuit 100 and each of the light-emitting chips C (C1 to C60) in the light-emitting device 65 in the fifth exemplary embodiment.

A difference between the fifth exemplary embodiment and the fourth exemplary embodiment shown in FIG. 14 is a newly-provided elimination signal generating unit 140 described in the third exemplary embodiment, in the fifth exemplary embodiment. The elimination signal generating unit 140 is used for the signal generating circuit 100 to transmit, to the light-emitting chips C (C1 to C60), an elimination signal ϕe for eliminating the electric charge accumulated in the parasitic capacity of each of the gate terminals Gm.

Thus, on the circuit board 62, an elimination signal line 102 is newly provided. The elimination signal line 102 transmits the elimination signal ϕe from the elimination signal generating unit 140 of the signal generating circuit 100 to the light-emitting portion 63. The elimination signal line 102 is connected to ϕe terminals (see FIG. 18 to be described later) of the light-emitting chips C (C1 to C60) in parallel. The other configuration is the same as that in the fourth exemplary embodiment shown in FIG. 14.

In the fourth exemplary embodiment, the positions (numbers) of the light-emitting thyristors L to be caused to light up, which are memorized in the memory thyristors M, are transferred to the holding thyristors B, and then the memory of the positions (numbers) of the light-emitting thyristors L to be caused to light up is deleted (cleared) from the memory thyristors M, and thereby the positions (numbers) of the light-emitting thyristors L to be caused to light up next time are memorized in the memory thyristors M during the lighting period of the light-emitting thyristors L. However, in order to delete (reset), from the memory thyristors M, the memory of the positions (numbers) of the light-emitting thyristors L to be caused to light up, it is necessary to wait until the potentials of the gate terminals Gm are lower than −2 V (<−2 V).

In the fifth exemplary embodiment, the fourth exemplary embodiment is combined with the elimination signal ϕe described in the third exemplary embodiment to shorten the reset period t5 until the potentials of the gate terminals Gm are less than −2 V (<−2V).

Note that, in the fifth exemplary embodiment, the same reference numerals are given to the same components as those in the fourth exemplary embodiment, and the detailed description thereof will be omitted.

Figure 18:
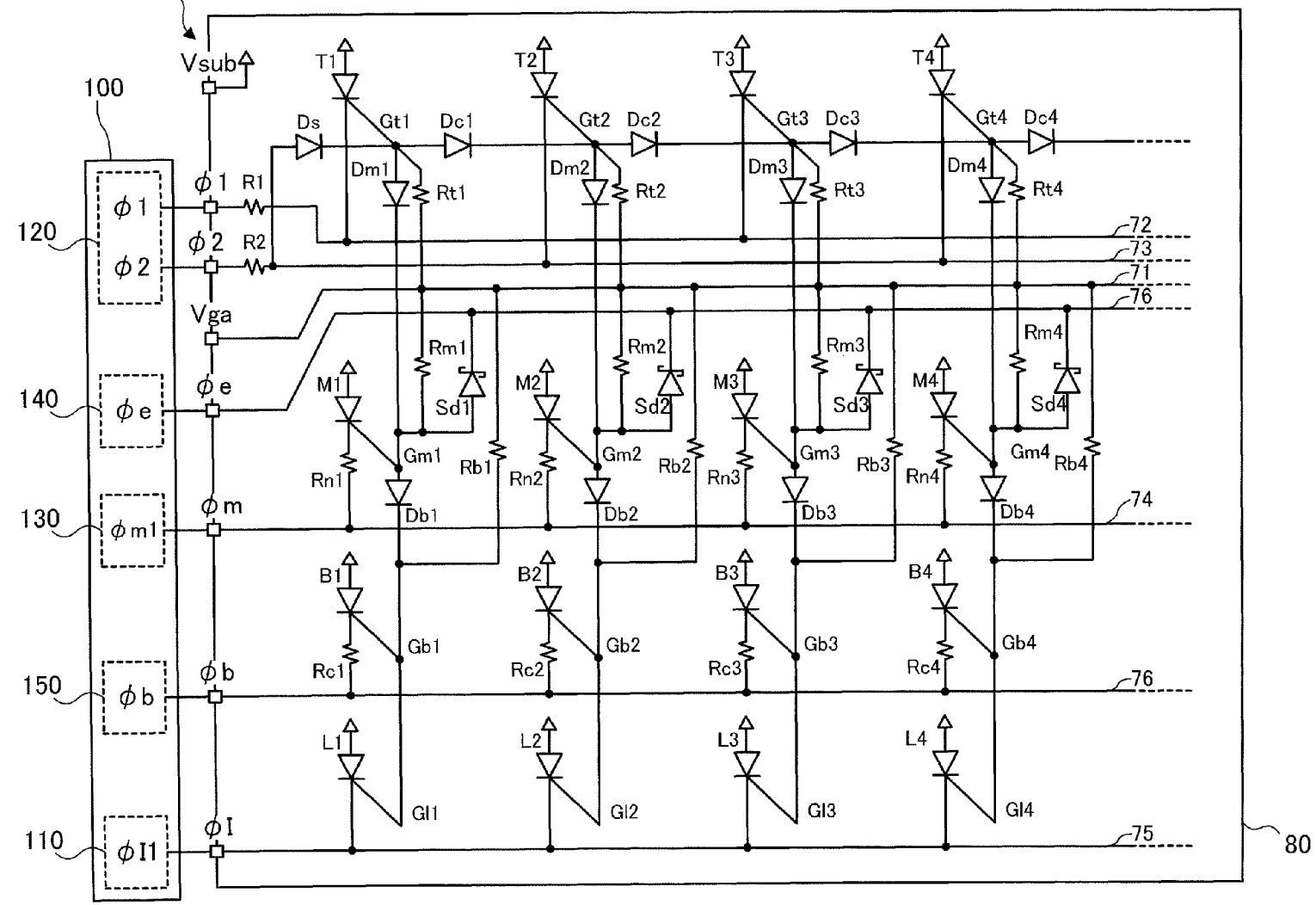
FIG. 18 is a diagram for explaining the circuit configuration of the light-emitting chips in the fifth exemplary embodiment.

FIG. 18 is a diagram for explaining the circuit configuration of the light-emitting chips C (C1 to C60), which are self-scanning light-emitting element array (SLED) chips, in the fifth exemplary embodiment. Here, a description will be given by taking the light-emitting chip C1 as an example. However, the other light-emitting chips C2 to C60 have the same configuration as the light-emitting chip C1. Note that, in FIG. 18, a portion including the transfer thyristors T1 to T4, the memory thyristors M1 to M4 and the light-emitting thyristors L1 to L4 is mainly shown.

The difference from the fourth exemplary embodiment shown in FIG. 14 is newly-provided elimination diodes Sd1, Sd2, Sd3 . . . in the fifth exemplary embodiment.

The light-emitting chip C1 (C) includes the elimination diodes Sd1, Sd2, Sd3 . . . arrayed in line on the substrates 80. The elimination diodes Sd1, Sd2, Sd3 . . . may be schottky diodes, similarly to those in the third exemplary embodiment.

Next, a description will be given of electric connections of the elimination diodes Sd in the light-emitting chip C1 (C). The electric connections of the elimination diodes Sd are the same as those in the third exemplary embodiment shown in FIG. 12.

In other words, each of the anode terminals of the elimination diodes Sd1, Sd2, Sd3 . . . is connected to the corresponding one of the gate terminals Gm1, Gm2, Gm3 . . . of the memory thyristors M1, M2, M3 . . . .

The cathode terminals of the elimination diodes Sd1, Sd2, Sd3 . . . are connected to the elimination signal line 76. Further, the elimination signal line 76 is connected to the ϕe terminal that is an input terminal of the elimination signal ϕe. To the ϕe terminal, the elimination signal line 102 (see FIG. 17) is connected, and the elimination signal ϕe is supplied thereto.

Next, a description will be given of the operation of the light-emitting portion 63 in the fifth exemplary embodiment. The pair of the first transfer signal ϕ1 and the second transfer signal ϕ2, the holding signal ϕb and the elimination signal ϕe are sharably supplied to the light-emitting chips C (C1 to C60) configuring the light-emitting portion 63, as show in FIG. 17. Meanwhile, the memory signals ϕm (ϕm1 to ϕm60) based on the image dataset are individually supplied to the light-emitting chips C (C1 to C60). The light-up signals ϕI (ϕI1 to ϕI30) are respectively supplied to the corresponding pairs each formed of two of the light-emitting chips C so that each light-up signal ϕI is shared by the two of the light-emitting chips C configuring each pair, and are individually supplied to the light-emitting chips C configuring different pairs.

The fifth exemplary embodiment differs from the fourth exemplary embodiment in the additionally-provided elimination diodes Sd. The operation of the light-emitting portion 63 is recognized if the operation of the light-emitting chip C1 is described, similarly to the description in the fourth exemplary embodiment. Accordingly, the description will be given of the operation of the light-emitting chips C by taking the light-emitting chip C1 as an example.

Figure 19:
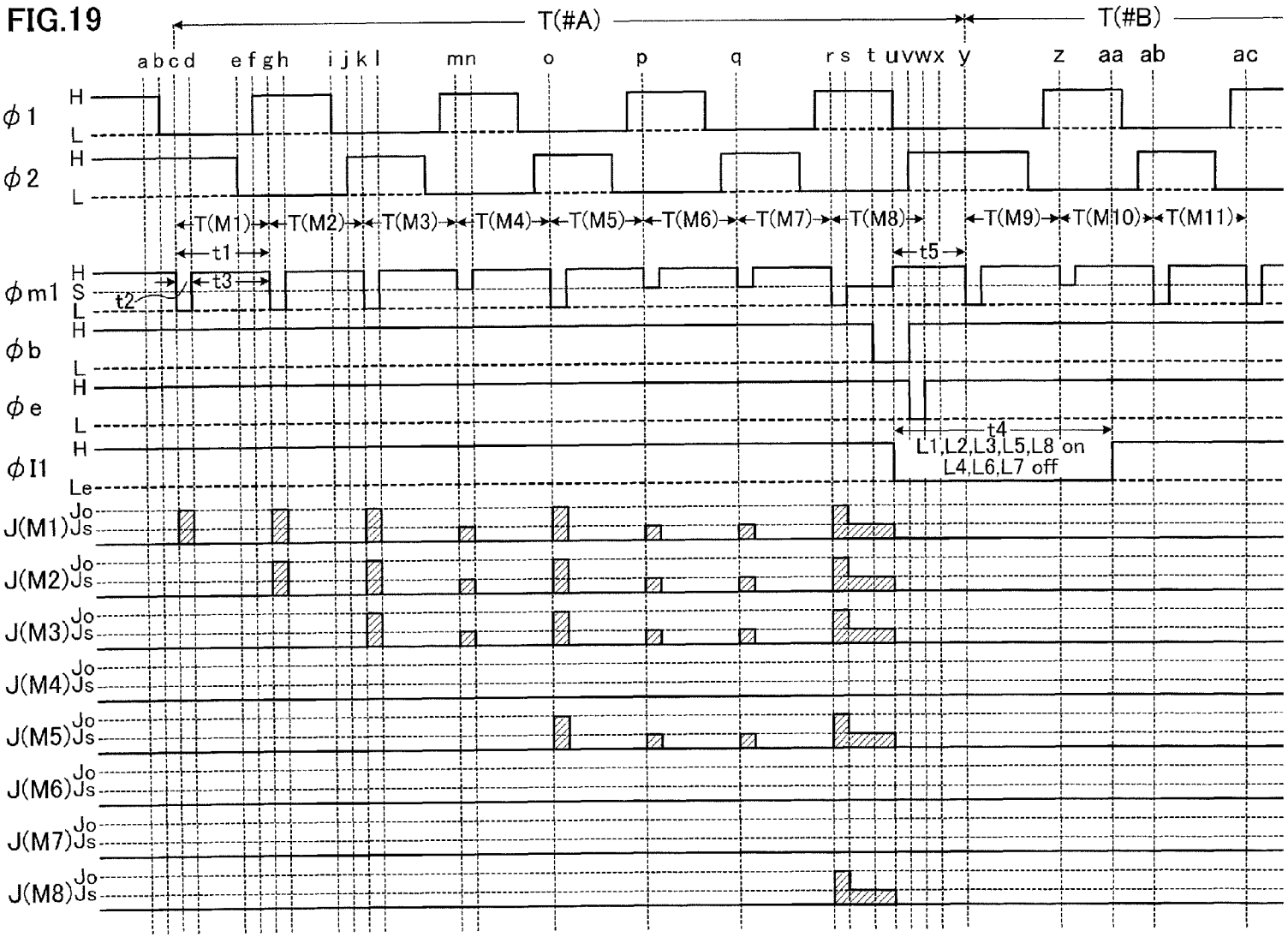
FIG. 19 is a timing chart for explaining the operation of the light-emitting chip in the fifth exemplary embodiment.

FIG. 19 is a timing chart for explaining the operation of the light-emitting chip C1 (C) in the fifth exemplary embodiment. Also in FIG. 19, it is assumed that time elapses from the time point a to the time point ac (from the time point a to the time point z in alphabetical order, and then the time points aa, ab and ac follow). In FIG. 19, waveforms of the first transfer signal ϕ1, the second transfer signal ϕ2, the memory signal ϕm1, the holding signal ϕb, the elimination signal ϕe, the light-up signal ϕI1 and the currents J(M1) to J(M8) flowing into the respective memory elements M1 to M8 are shown.

FIG. 19 shows the light-up control period T(#A) (from the time point c to the time point y) and a part of the light-up control period T(#B) (from the time point y and the subsequent period) in the case where the light-up control is performed by using the groups each formed of 8 light-emitting thyristors L shown in FIG. 6. Here, in the light-up control period T(#A), the light-emitting thyristors L1 to L8 in the group #A are light-controlled, and in the light-up control period T(#B), the light-emitting thyristors L9 to L16 in the group #B are light-controlled. Note that, the light-up control period T(#B) is followed by the light-up control period T(#C) when the light-emitting thyristors L17 to L24 in the group #C are light-controlled . . . , although the illustration thereof is omitted.

Note that, in the light-up control period T(#A) in FIG. 19, it is assumed that the light-emitting thyristors L1, L2, L3, L5 and L8 among the 8 light-emitting thyristors L1 to L8 in the group #A are caused to light up (emit light), and the light-emitting thyristors L4, L6 and L7 are maintained not to light up (to be off), similarly to the case in the fourth exemplary embodiment. Also, it is assumed that the light-emitting thyristors L9, L11 and L12 are caused to light up (emit light) while the light-emitting thyristor L10 is maintained to be off in the light-up control period T(#B), as one example. It is assumed that the image dataset "11101001" is printed in the light-up control period T(#A), and the image dataset "1011 . . . " is printed in the light-up control period T(#B).

In FIG. 19, the waveforms of the signals other than the elimination signal ϕe are the same as those shown in FIG. 16.

Here, the elimination signal ϕe will be mainly described.

The potential of the elimination signal ϕe in the light-up control period T(#A) is "H" at the time point c, and is changed from "H" to "L" at the time point v. Then, the potential thereof is changed from "L" to "H" at the time point w. At the finish time point y of the light-up control period T(#A), the potential thereof is maintained at "H."

In other words, the elimination signal ϕe has the potential of "L" once in the light-up control period T(#A).

As described above, the potential of the gate terminal Gm of the memory thyristor M that has been turned off after turned on changes from 0 V toward −3.3 V. The rate of this change is determined by the time constant defined by the parasitic capacity of the gate terminal Gm and the power supply line resistance Rm. As described above, if the potential change of the gate terminal Gm is slow, it may be good since the period t3 is set long, but it may be bad since the reset period t5 becomes longer.

In the fifth exemplary embodiment, in order to control the reset period t5, the elimination signal ϕe is provided. The elimination signal eliminates the electric charge accumulated in the parasitic capacity of the gate terminal Gm, and eliminates the memory of the memory thyristor M, in which the memory thyristor M has been turned on.

A description will be given of the operation of the light-emitting portion 63 and the light-emitting chip C1 (C) in accordance with the timing chart in FIG. 19, with reference to FIG. 18.

Note that, in FIG. 18, only a portion including the transfer thyristors T, the memory thyristors M, the light-emitting thyristors L and the like each having numbers of 1 to 4 is shown. The other portion (not shown in the figure) including these thyristors and the like each having numbers not less than 5 is a repeat of the above portion. In the following description, elements not only having numbers of 1 to 4 but also having the other numbers may be described.

The operation of the light-emitting portion 63 and the light-emitting chip C1 (C) from the initial state (time point a) to the time point s when the information that the light-emitting thyristor L8 is caused to emit light is memorized in the memory thyristor M8 has already been described in the third and fourth exemplary embodiments, and thus the detailed description thereof will be omitted.

When the potential of the holding signal ϕb is changed from "H" to "L" at the time point t, the holding thyristors B1, B2, B3, B5 and B8, which have the threshold voltage of −2.6 V, are turned on while the other holding thyristors B are not turned on. Thereby, the gate terminals Gb1, Gb2, Gb3, Gb5 and Gb8 of the holding thyristors B1, B2, B3, B5 and B8 that have been turned on become "H" (0 V) that is the potentials of the anode terminals.

The connecting diodes Db each have the anode terminal connected to the gate terminal Gm and the cathode terminal connected to the gate terminal Gb. As described above, the gate terminals Gm1, Gm2, Gm3, Gm5 and Gm8 start to change from 0V to −3.3 V from the time point u. On the other hand, the gate terminals Gm4, Gm6 and Gm7 and the gate terminals Gm of the holding thyristors B each having numbers not less than 9 are maintained at −3.3 V. Accordingly, the holding thyristors B go into the state of the reverse bias or the state where the anode and cathode terminals thereof have the same potential.

Immediately after the time point t, the transfer thyristor T8, and the memory thyristors M1, M2, M3, M5 and M8 are kept in the ON state, and the light-emitting thyristors L1, L2, L3, L5 and L8 are in the lighting-up (on) state.

Then, when the potential of the light-up signal ϕI1 (ϕI) is changed from "H" to "Le" (−2.6 V<"Le"≦−1.3 V) at the time point u, the light-emitting thyristors L1, L2, L3, L5 and L8 are turned on and light up (emit light).

Further, at the time point u, the potential of the memory signal ϕm1 (ϕm) is changed from "S" to "H." Thereby, the memory thyristors M1, M2, M3, M5 and M8, which have been turned on, are turned off, and the potentials of the gate terminals Gm1, Gm2, Gm3, Gm5 and Gm8 start to change from 0 V toward −3.3 V. The rate of this change is determined by the time constant defined by the parasitic capacity of the gate terminal Gm and the power supply line resistance Rm.

Furthermore, when the potential of the first transfer signal $\phi 1$ is changed from "H" to "L" at the time point u, the transfer thyristor T9 is turned on.

The relationship among the potential change of the light-up signal $\phi I1$ ($\phi I$) from "H" to "Le," the potential change of the memory signal $\phi m1$ ($\phi m$) from "S" to "H," and the potential change of the first transfer signal $\phi 1$ from "H" to "L" at the time point u is the same as those described in the fourth exemplary embodiment.

At the time point v, the potential of elimination signal $\phi e$ is changed from "H" (0 V) to "L" (−3.3 V). Thus, the elimination diodes Sd1, Sd2, Sd3, Sd5 and Sd8 are forward-biased, and thereby the potentials of the gate terminals Gm1, Gm2, Gm3, Gm5 and Gm8 become a value (−2.5 V) obtained by subtracting the forward-direction potential Vs (0.8 V) of the elimination diode Sd from −3.3 V ("L"), as described in the third exemplary embodiment.

In other words, by changing the elimination signal $\phi e$ from "H" to "L," the potentials of the gate terminals Gm of the memory thyristors M that have been turned on are forcibly set at −2.5 V, and the potential changes of the gate terminals Gm1, Gm2, Gm3, Gm5 and Gm8 are accelerated.

At the time point v, the potential of the holding signal $\phi b$ is changed from "L" to "H." By this change, the holding thyristors B1, B2, B3, B5 and B8 are turned off. Thereby, the memory of the positions (numbers) of the light-emitting thyristors L to be caused to light up is lost from the holding thyristors B. However, at the time point u, the light-emitting thyristors L1, L2, L3, L5 and L8 have already lighted up, and thus there is no problem.

Further, at the time point v, the potential of the second transfer signal $\phi 2$ is changed from "L" to "H." By this change, the transfer thyristor T8 is turned off.

Note that, at the time point v, the potential change of the elimination signal $\phi e$ from "H" to "L", the potential change of the holding signal $\phi b$ from "L" to "H" and the potential change of the second transfer signal $\phi 2$ from "L" to "H" are performed at the same time.

These changes may be performed in arbitrary order.

Specifically, if the potential change of the elimination signal $\phi e$ from "H" to "L" is firstly performed, only the potential change of the gate terminal Gm is accelerated, and the operation of the transfer thyristors T and the holding thyristors B is not affected.

Alternatively, if the potential change of the holding signal $\phi b$ from "L" to "H" is firstly performed to turn off the holding thyristors B, the potentials of the cathode terminals (gate terminals Gb) of the connecting diodes Db change from 0 V to −3.3 V. Meanwhile, from the time point u, the potentials of the gate terminals Gm1, Gm2, Gm3, Gm5 and Gm8, which are anode terminals of the coupling diodes Db, start to change from 0 V toward −3.3 V. Accordingly, if the connecting diodes Db are forward-biased during these potential changes, the potential changes of the gate terminals Gm (changes from 0 V toward −3.3 V) are more accelerated. Here, turning on the holding thyristors B does not affect the operation of the transfer thyristors T.

Further alternatively, if the potential change of the second transfer signal $\phi 2$ from "L" to "H" is firstly performed to turn off the transfer thyristor T8, the potential of the gate terminal Gt8 changes from 0 V toward the power supply potential Vga (−3.3 V). However, similarly to the above case where the potential change of the holding signal $\phi b$ from "L" to "H" is firstly performed, if the connecting diodes Dm are forward-biased during these potential changes, the potential changes of the gate terminals Gt (changes from 0 V toward −3.3 V) are more accelerated.

As described above, if these changes are performed in arbitrary order, the operation of the light-emitting chips C is not affected.

At the time point w, the potential of the elimination signal $\phi e$ is changed from "H" (0 V) to "L" (−3.3 V). Thereby, the elimination diodes Sd are forward biased, or have the anode and cathode terminals having the same potential. The potentials of the gate terminals Gm1, Gm2, Gm3, Gm5 and Gm8 further change toward −3.3 V in accordance with the time constant defined by the parasitic capacity of the gate terminal Gm and the power supply line resistance Rm.

Note that, the abstraction effect in which electric charge is abstracted by the elimination diodes Sd is obtained in a case where the elimination diodes Sd are forward-biased. Accordingly, if the potentials of the gate terminals Gm become a value obtained by subtracting the forward-direction potential Vs of the elimination diodes Sd from −3.3 V ("L"), the electric-charge abstraction effect by the elimination diodes Sd is not obtained any longer.

Thus, in order to accelerate the potential changes of the gate terminals Gm effectively, the potential of the elimination signal $\phi e$ may be changed from "L" to "H" immediately before the abstraction effect in which electric charge is abstracted by the elimination diodes Sd is lost due to the potentials of the gate terminals Gm.

At the time point y and the subsequent period, the operation thereof is the same as that in the fourth exemplary embodiment, and thus the detailed description thereof will be omitted.

In the fifth exemplary embodiment, since the potential changes of the gate terminals Gm are accelerated by the elimination diodes Sd, the reset period t5 from the time point u to the time point y may be set short in comparison with the case in the fourth exemplary embodiment. Accordingly, higher light emission duty of the light-emitting thyristors L is settable.

Note that, in the first to fifth exemplary embodiments, although the number of the light-emitting thyristors L included in each group shown in FIG. 6 is set at 8, the number is arbitrary settable. At this time, it is only necessary to change the timing of the signals (first transfer signal $\phi 1$, second transfer signal $\phi 2$, memory signal $\phi m$, holding signal $\phi b$, elimination signal $\phi e$ and light-up signal $\phi I$), without change of the configuration of the light-emitting chips C.

In addition, in the first to fifth exemplary embodiments, the descriptions have been given with the assumption that the number of the light-emitting thyristors L included in each light-emitting chip C is set at 128. However, this number is also arbitrarily settable. Further, one self-scanning light-emitting element array (SLED) is assumed to be mounted on one light-emitting chip C. However, plural SLEDs may be mounted thereon.

Further, the descriptions have been given with the assumption that the number of the light-emitting thyristors L is the same as the respective numbers of the transfer thyristors T, the memory thyristors M and the holding thyristors L. However, the number of the transfer thyristors T larger than the number of the light-emitting thyristors L may be acceptable. It is achieved by driving the device with provision of parts of the first transfer signal $\phi 1$ and the second transfer signal $\phi 2$ where image dataset is not written.

In the first to fifth exemplary embodiments, it has been assumed that the memory signals $\phi m$ are individually provided to the light-emitting chips C, and each of the light-up signal $\phi I$ is sharably supplied to the corresponding two of the light emitting chips C. However, the light-up signals $\phi I$ may be individually supplied thereto, or each of the light-up signals ϕI may be sharably supplied to each three or more of the light-emitting chips C.

Alternatively, by serially connecting the plural light-emitting chips C to form the plural light-emitting chips C like one self-scanning light-emitting element array (SLED) chip, the memory signal ϕm and the light-up signal ϕI may be sharably supplied to the plural light-emitting chips C serially connected to each other.

In the first to fifth exemplary embodiments, the descriptions have been given in a case of the anode common in which the substrate is set as the anode terminals of the thyristors. By changing the polarity of the circuit, cathode common thyristors, in which the substrate is set as the cathode terminals, may be usable.

Further, in the first to fifth exemplary embodiments, the light-emitting chips C are formed of a GaAs-based semiconductor, such as GaAs, GaAlAs or the like, but the material thereof is not limited to this. For example, the light-emitting chips C may be formed of another composite semiconductor, such as GaP, difficult to turn into a p-type semiconductor or an n-type semiconductor by ion implantation.

Note that, the usage of the light-emitting device in the present invention is not limited to an exposure device used in an electrophotographic image forming unit. The light-emitting device in the present invention may be also used in optical writing other than the electrophotographic recording, displaying, illumination, optical communication and the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A light-emitting device comprising:

a self-scanning light-emitting element array including:

a plurality of light-emitting elements that are arrayed in line;

a plurality of memory elements that are provided so as to correspond to the respective light-emitting elements, that are electrically connected to the respective light-emitting elements, that are each set at any one of an ON state and an OFF state, and that cause the respective light-emitting elements to be likely to be set at an ON state in a case of being set at the ON state in comparison with a case of being set at the OFF state; and a plurality of switch elements that are provided so as to correspond to the respective memory elements, that are electrically connected to the respective memory elements, that are each set at any one of an ON state and an OFF state, that are set so as to allow a sequential shift of the ON state from one end side to the other end side, and that causes the respective memory elements to be likely to be set at the ON state in a case of being set at the ON state in comparison with a case of the OFF state; and a light-up controller including:

a transfer signal generating unit that supplies, to the plurality of switch elements, a transfer signal that sets the plurality of switch elements so as to allow the sequential shift of the ON state from the one end side to the other end side;

a memory signal generating unit that supplies a memory signal to a plurality of the memory elements corresponding to a plurality of the light-emitting elements of a group among a plurality of groups into which the plurality of light-emitting elements are divided, the memory signal causing, in a case where a switch element corresponding to a light-emitting element forming the group is set at the ON state, a memory element corresponding to the switch element set at the ON state to be temporarily changed from the OFF state to the ON state if the light-emitting element corresponding to the switch element is intended to light up, and the memory element corresponding to the switch element set at the ON state to be kept in the OFF state if the light-emitting element corresponding to the switch element is not intended to light up, and then causing the memory element having been temporarily changed to the ON state to be temporarily set at the ON state again; and a light-up signal generating unit that supplies, to the plurality of light-emitting elements, for each group, a light-up signal that causes a light-emitting element intended to light up to be set at the ON state after causing a memory element corresponding to the light-emitting element intended to light up to be set at the ON state.

2. The light-emitting device according to claim 1, wherein the self-scanning light-emitting element array further includes a plurality of elimination elements that are provided so as to correspond to the respective memory elements, and that are electrically connected to the respective memory elements, and the light-up controller further includes an elimination signal generating unit that supplies, to the plurality of elimination elements, an elimination signal that prevents the memory element corresponding to the light-emitting element intended to light up in the group from being set at the ON state after the light-emitting element intended to light up is set at the ON state.

3. The light-emitting device according to claim 1, wherein the self-scanning light-emitting element array further includes a plurality of holding elements that are provided between the respective light-emitting elements and the respective memory elements so as to correspond to the respective light-emitting elements and the respective memory elements, that are electrically connected to the respective light-emitting elements and the respective memory elements, and that causes the respective light-emitting elements to be likely to light up in the case where the respective memory elements are set at the ON state in comparison with the case of the OFF state, and the light-up controller further includes a holding signal generating unit that supplies, to the plurality of holding elements, a holding signal that causes a holding element corresponding to a memory element being in the ON state to be set at the ON state after the memory element corresponding to the light-emitting element intended to light up in the group is caused to be set at the ON state.

4. A light-emitting device comprising:

a self-scanning light-emitting element array including:

a substrate;

a plurality of light-emitting thyristors that are formed on the substrate and arrayed in line;

a plurality of memory thyristors that are formed on the substrate and provided so as to correspond to the respective light-emitting thyristors, that are electrically connected to the respective light-emitting thyristors, that are each set at any one of an ON state and an OFF state; and that change respective threshold voltages of the plurality of light-emitting thyristors to a value which causes the respective light-emitting thyristors to be likely to be set at an ON state in a case of being set at the ON state in comparison with a case of being set at the OFF state; and a plurality of transfer thyristors that are formed on the substrate and provided so as to correspond to the respective memory thyristors, that are electrically connected to the respective memory thyristors, that are each set at any one of an ON state and an OFF state, that are set so as to allow a sequential shift of the ON state from one end side to the other end side, and that changes respective threshold voltages of the plurality of memory thyristors to a value which causes the respective memory thyristors to be likely to be set at the ON state in a case of being set at the ON state in comparison with a case of the OFF state; and a light-up controller including:

a transfer signal generating unit that supplies, to the plurality of transfer thyristors, a transfer signal that sets the plurality of transfer thyristors so as to allow the sequential shift of the ON state from the one end side to the other end side;

a memory signal generating unit that supplies a memory signal to a plurality of the memory thyristors corresponding to a plurality of the light-emitting thyristors of a group among a plurality of groups into which the plurality of light-emitting thyristors are divided, the memory signal causing, in a case where a transfer thyristor corresponding to a light-emitting thyristor forming the group is set at the ON state, a memory thyristor corresponding to the transfer thyristor set at the ON state to be temporarily changed from the OFF state to the ON state if the light-emitting thyristor corresponding to the transfer thyristor is intended to light up, and the memory thyristor corresponding to the transfer thyristor set at the ON state to be kept in the OFF state if the light-emitting thyristor corresponding to the transfer thyristor is not intended to light up, and then causing the memory thyristor having been temporarily changed to the ON state to be temporarily set at the ON state again; and a light-up signal generating unit that supplies, to the plurality of light-emitting thyristors, for each group, a light-up signal that causes a light-emitting thyristor intended to light up to be set at the ON state after causing a memory thyristor corresponding to the light-emitting thyristor intended to light up to be set at the ON state.

5. The light-emitting device according to claim 4, wherein the self-scanning light-emitting element array further includes a plurality of elimination diodes that are provided so as to correspond to the respective memory thyristors, and that are electrically connected to the respective memory thyristors, and the light-up controller further includes an elimination signal generating unit that supplies, to the plurality of elimination diodes, an elimination signal that prevents the memory thyristor corresponding to the light-emitting thyristor intended to light up in the group from being set at the ON state after the light-emitting thyristor intended to light up is set at the ON state.

6. The light-emitting device according to claim 5, wherein the elimination diodes of the self-scanning light-emitting element array are schottky diodes.

7. The light-emitting device according to claim 4, wherein the self-scanning light-emitting element array further includes a plurality of holding thyristors that are formed on the substrate, that are provided between the respective light-emitting thyristors and the respective memory thyristors so as to correspond to the respective light-emitting thyristors and the respective memory thyristors, that are electrically connected to the respective light-emitting thyristors and the respective memory thyristors, and that changes the respective threshold voltages of the plurality of light-emitting thyristors to a value which causes the respective light-emitting thyristors to likely to be set at the ON state in the case where the plurality of the memory thyristors are set at the ON state in comparison with the case of the OFF state, and the light-up controller further includes a holding signal generating unit that supplies, to the plurality of holding thyristors, a holding signal that causes a holding thyristor corresponding to a memory thyristor being in the ON state to be set at the ON state after the memory thyristor corresponding to the light-emitting thyristor intended to light up in the group is caused to be set at the ON state.

8. A print head comprising:

an exposure unit exposing an image carrier and including:

a self-scanning light-emitting element array including:

a plurality of light-emitting elements that are arrayed in line;

a plurality of memory elements that are provided so as to correspond to the respective light-emitting elements, that are electrically connected to the respective light-emitting elements, that are each set at any one of an ON state and an OFF state, and that causes the respective light-emitting elements to be likely to be set at an ON state in a case of being set at the ON state in comparison with a case of being set at the OFF state; and a plurality of switch elements that are provided so as to correspond to the respective memory elements, that are electrically connected to the respective memory elements, that are each set at any one of an ON state and an OFF state, that are set so as to allow a sequential shift of the ON state from one end side to the other end side, and that causes the respective memory elements to be likely to be set at the ON state in a case of being set at the ON state in comparison with a case of the OFF state; and a light-up controller including:

a transfer signal generating unit that supplies, to the plurality of switch elements, a transfer signal that sets the plurality of switch elements so as to allow the sequential shift of the ON state from the one end side to the other end side;

a memory signal generating unit that supplies a memory signal to a plurality of the memory elements corresponding to a plurality of the light-emitting elements of a group among a plurality of groups into which the plurality of light-emitting elements are divided, the memory signal causing, in a case where a switch element corresponding to a light-emitting element forming the group is set at the ON state, a memory element corresponding to the switch element set at the ON state to be temporarily changed from the OFF state to the ON state if the light-emitting element corresponding to the switch element is intended to light up, and the memory element corresponding to the switch element set at the ON state to be kept in the OFF state if the light-emitting element corresponding to the switch element is not intended to light up, and then causing the memory element having been temporarily changed to the ON state to be temporarily set at the ON state again; and a light-up signal generating unit that supplies, to the plurality of light-emitting elements, for each group, a light-up signal that causes a light-emitting element intended to light up to be set at the ON state after causing a memory element corresponding to the light-emitting element intended to light up to be set at the ON state; and an optical unit that causes light emitted from the exposure unit to focus on the image carrier.

* * * * *